US009802751B2

(12) United States Patent
Demarest et al.

(10) Patent No.: US 9,802,751 B2
(45) Date of Patent: Oct. 31, 2017

(54) ATTACHMENT MECHANISM FOR A CONTAINER

(71) Applicant: S.C. Johnson & Son, Inc., Racine, WI (US)

(72) Inventors: Scott W. Demarest, Basking Ridge, NJ (US); Donald J. Schumacher, Racine, WI (US); Christine D. Beilstein, Wadsworth, IL (US); Dirk K. Nickel, Mukwonago, WI (US); Jinsong Yu, Shenzhen (CN); Gang Liu, Shenzhen (CN); Xiaogang Tan, Shenzhen (CN); Yuanheng Liu, Shenzhen (CN)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 14/622,675

(22) Filed: Feb. 13, 2015

(65) Prior Publication Data

US 2015/0158659 A1 Jun. 11, 2015

Related U.S. Application Data

(63) Continuation of application No. 13/021,691, filed on Feb. 4, 2011, now Pat. No. 8,985,398.

(51) Int. Cl.

| | |
|---|---|
| ***B65D 83/22*** | (2006.01) |
| ***B65D 83/20*** | (2006.01) |
| ***B65D 83/26*** | (2006.01) |

(52) U.S. Cl.

CPC ..... *B65D 83/207* (2013.01); *B65D 83/22* (2013.01); *B65D 83/262* (2013.01); (Continued)

(58) Field of Classification Search

CPC .... B65D 83/22; B65D 83/207; B65D 83/262; B65D 83/40; B65D 47/121; B65D 50/045–50/046; B65D 50/048; B65D 50/061–50/062; B65D 55/02

USPC ... 222/182–183, 187, 399, 402.11, 503, 513, 222/515–516, 519–521, 555, 559–561, 222/153.1, 153.01–153.14; 70/472–486, 70/163–169; 49/394–395; 279/35, 77, (Continued)

(56) References Cited

U.S. PATENT DOCUMENTS 1,560,489 A 11/1925 Yager
1,691,975 A * 11/1928 Irwin ..... E05B 65/006 292/2

(Continued)

FOREIGN PATENT DOCUMENTS

DE 29322 11/1884
DE 670454 1/1939

(Continued)

OTHER PUBLICATIONS

PCT/US2012/023079 International Search Report dated May 7, 2012.

(Continued)

*Primary Examiner* — Patrick M Buechner
*Assistant Examiner* — Andrew P Bainbridge

(57) ABSTRACT

An attachment mechanism for a container includes a housing with a locking element extending therefrom. At least one opening extends through the locking element to selectively receive a portion of the container. A resilient member is disposed within the locking element.

19 Claims, 73 Drawing Sheets

(52) U.S. Cl.
CPC ..... *Y10T 29/49826* (2015.01); *Y10T 70/5562* (2015.04); *Y10T 279/17803* (2015.01)

(58) Field of Classification Search
USPC ..... 279/81, 106–107; 292/1–3, 10, 19, 32, 292/37–38, 80, 83–84, 91, 137, 156, 180, 292/140–141, DIG. 11, DIG. 15, DIG. 38; 141/20, 346, 382–385; 239/44, 268, 326, 239/538–539, 587.1–588; 215/225
See application file for complete search history.

(56) References Cited

U.S. PATENT DOCUMENTS 2,173,610 A 9/1939 Haven
2,731,273 A 1/1956 Edens
2,961,128 A 11/1960 Cochran
3,013,700 A 12/1961 Steinkamp
3,137,414 A 9/1964 Steinkamp
3,149,757 A 9/1964 Sarianoff
3,156,382 A 11/1964 Michel
3,180,532 A 4/1965 Michel
3,329,314 A 7/1967 Kolodziej
3,497,110 A 2/1970 Bombero et al.
3,591,059 A 7/1971 Stearns
3,601,290 A * 8/1971 Nigro ..... B65D 83/205 222/402.11
3,690,519 A 9/1972 Wassilieff
3,706,401 A * 12/1972 Gach ..... B65D 41/06 220/915
3,721,423 A 3/1973 Shay
3,747,807 A 7/1973 Gach
3,764,044 A 10/1973 Pajak
3,768,707 A 10/1973 Nigro
3,819,090 A * 6/1974 Birrell ..... B65D 83/40 215/223
3,885,712 A 5/1975 Libit
3,901,412 A 8/1975 Copia
3,915,348 A 10/1975 Suhr
3,954,201 A 5/1976 Ostrowsky et al.
4,121,383 A 10/1978 Holmes et al.
4,133,448 A 1/1979 Balfanz
4,222,595 A * 9/1980 Schmidt ..... A45C 13/10 24/627
4,233,913 A 11/1980 Herrmann
4,260,067 A * 4/1981 Andruchiw ..... B65D 50/06 215/216
4,342,208 A * 8/1982 Evans ..... B60K 15/0409 220/210
4,449,647 A 5/1984 Reed et al.
4,562,709 A * 1/1986 Canadas ..... B60K 15/0409 220/210
4,752,020 A 6/1988 Grueter
5,213,223 A 5/1993 Minnette
5,248,212 A 9/1993 Lhuisset
5,300,031 A 4/1994 Neer
5,356,043 A 10/1994 Glynn
5,364,027 A 11/1994 Kuhn
5,370,317 A 12/1994 Weston
5,383,580 A 1/1995 Winder
5,489,047 A 2/1996 Winder
5,509,438 A 4/1996 Leonard et al.
5,549,228 A 8/1996 Brown
5,741,003 A * 4/1998 Segien, Jr. ..... F16K 31/60 16/441
5,868,126 A 2/1999 Long et al.
5,915,595 A 6/1999 Dow et al.
5,927,313 A 7/1999 Hart
6,216,925 B1 4/2001 Garon
6,283,332 B1 9/2001 Ragno
6,296,156 B1 10/2001 Lasserre et al.
6,302,302 B1 10/2001 Albisetti
6,321,742 B1 11/2001 Schmidt et al.
6,338,424 B2 1/2002 Nakamura
6,405,768 B1 6/2002 McClaran
6,430,877 B1 8/2002 Rosenquist et al.
6,439,259 B1 8/2002 Beaver
6,520,464 B1 2/2003 Morrissey et al.
6,644,073 B1 11/2003 Gartside et al.
6,688,146 B2 2/2004 Michels et al.
6,758,373 B2 7/2004 Jackson et al.
6,877,643 B2 4/2005 Schneider
6,918,512 B2 7/2005 Kondoh
6,974,091 B2 12/2005 McLisky
7,044,337 B1 5/2006 Kou
7,066,442 B2 6/2006 Rose
7,070,215 B2 7/2006 Kelley et al.
RE39,727 E 7/2007 Sprick
7,281,670 B2 10/2007 Lakatos et al.
7,434,594 B1 10/2008 Robbins et al.
7,487,891 B2 2/2009 Yerby et al.
7,611,032 B2 11/2009 Brunerie et al.
7,624,889 B2 * 12/2009 Tharp ..... B60K 15/0406 220/210
7,637,393 B2 12/2009 Mineau et al.
7,699,190 B2 4/2010 Hygema
7,866,497 B2 * 1/2011 Belden, Jr. ..... E05B 73/0017 215/223
8,201,710 B2 6/2012 Helf et al.
8,870,030 B2 * 10/2014 Demarest ..... B65D 83/207 222/153.14
8,985,398 B2 * 3/2015 Demarest ..... B65D 83/207 222/182
2003/0075932 A1 * 4/2003 Dolan ..... B65D 50/062 292/300
2003/0168473 A1 * 9/2003 Ho ..... B65D 50/045 222/153.13
2004/0011885 A1 1/2004 McLisky
2008/0053949 A1 3/2008 Farrar et al.
2008/0179347 A1 7/2008 Yerby
2008/0230505 A1 9/2008 Kerman et al.
2008/0308554 A1 * 12/2008 Farrar ..... B65D 45/325 220/281
2008/0315016 A1 12/2008 Octeau et al.
2009/0014679 A1 1/2009 Hygema et al.
2010/0025437 A1 2/2010 Oshimo et al.
2010/0089950 A1 * 4/2010 Helf ..... B65D 83/206 222/153.09
2010/0155432 A1 * 6/2010 Christianson ..... B05B 1/3436 222/402.1
2010/0301128 A1 12/2010 Pisklak
2013/0062303 A1 * 3/2013 Serell ..... A61J 1/03 215/206

FOREIGN PATENT DOCUMENTS

DE 1848935 3/1962
DE 1868294 2/1963
DE 1150399 6/1963
DE 2265039 A1 2/1976
DE 2624710 A1 12/1977
DE 2800701 A1 7/1978
DE 2800701 C2 10/1978
DE 4411393 A1 10/1994
DE 4411393 B4 12/2005
EP 0278873 A1 8/1988
EP 0496460 A1 7/1992
EP 0981005 A1 2/2000
FR 2850166 7/2004
WO 2008001406 1/2008

OTHER PUBLICATIONS

Australian Patent Examination Report No. 1 dated Apr. 12, 2013 for related Australian Patent Application No. 2012203571, 4 pages.
Australian Patent Examination Report No. 1 dated Apr. 15, 2013 for related Australian Patent Application No. 2012203526. 3 pages.
International Preliminary Search Report on Patentability dated Aug. 6, 2013 for related International Patent Application No. PCT/20121023077, 8 pages.
International Preliminary Search Report on Patentability dated Aug.

(56) References Cited

OTHER PUBLICATIONS 6, 2013 for related International Patent Application No. PCT/20121023079, 9 pages.

* cited by examiner

ATTACHMENT MECHANISM FOR A CONTAINER

CROSS REFERENCE TO RELATED APPLICATIONS

This application is a continuation of U.S. patent application Ser. No. 13/021,691, filed on Feb. 4, 2011, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present invention relates generally to an attachment mechanism for an overcap and a container, and more particularly, to an attachment mechanism having an annular ring attached to the container, which is adapted to interact with a locking mechanism extending from the overcap.

2. Description of the Background of the Invention

Aerosol containers are commonly used to store and dispense a product such as air freshening agents, deodorants, insecticides, germicides, decongestants, perfumes, or any other known products. The product is forced from the container through an aerosol valve by a hydrocarbon or non-hydrocarbon propellant. Typical aerosol containers comprise a body with an opening at a top end thereof. A mounting cup is crimped to the opening of the container to seal the top end of the body. The mounting cup is generally circular in geometry and may include an outer wall that extends upwardly from a base of the mounting cup adjacent the area of crimping. A pedestal also extends upwardly from a central portion of the base. A valve assembly includes a valve stem, a valve body, and a valve spring. The valve stem extends through the pedestal, wherein a distal end extends upwardly away from the pedestal and a proximal end is disposed within the valve body. The valve body is secured within an inner side of the mounting cup. A dip tube may be attached to the valve body. The dip tube extends downwardly into an interior of the body of the container. The distal end of the valve stem is axially depressed along a longitudinal axis thereof to open the valve assembly. In other containers, the valve stem is tilted or displaced in a direction transverse to the longitudinal axis to radially actuate the valve stem. When the valve assembly is opened, a pressure differential between the container interior and the atmosphere forces the contents of the container out through an orifice of the valve stem.

Aerosol containers frequently include a protective cap to prevent the displacement of the valve stem during transport of the aerosol container and prior to use. Such protective caps are removed from the container prior to actuation of the valve stem and may be placed back onto the container after actuation to protect the valve stem from being inadvertently actuated. Typical protective caps are releasably attached to the container by way of an outwardly protruding ridge, which circumscribes the interior lower edge of the overcap and interacts with a crimped seam that circumscribes a top portion of the container. When the protective cap is placed onto the top portion of the container, downward pressure is applied to the overcap, which causes the ridge to ride over an outer edge of the seam and lock under a ledge defined by a lower surface of the seam. In other systems, a container includes a protective cap that may releasably attach to some portion of the mounting cup of the container. Typically, these protective caps are utilized in child-proof systems and require a user to apply inward pressure in some area of the cap to be able to remove the cap from the container.

Actuation of the aerosol valve by movement of the valve stem may be accomplished manually, as noted above, or by an automated system. In automated systems, conventional actuator mechanisms may include motor driven linkages that actuate the valve stem to open an aerosol valve. Automated actuation systems attach to the container and nozzle in various ways. For example, some existing automated actuation systems are contained within a housing unit, which is adapted to receive the container therein. Alternatively, other automated actuation systems are contained within an overcap that can be releasably attached to a top end of the container prior to use. Still other automated actuation systems provide both housings and overcaps.

Prior art automated systems typically include intricate timing and actuation mechanisms that generally require exact precision with respect to the interface between the actuating system and the valve stem of the container. To that end, these prior art automated systems employ a more permanent attachment such that securement of the container to the system is complicated and time-consuming for the consumer during setup or replacement of the container. Removing the container from these types of systems is difficult. In instances where the container is attached to the overcap using a mechanism that is simpler and easier to operate, the systems are frequently unstable and susceptible to leakage and breakage.

In addition to the aforementioned drawbacks, some existing automated actuation systems suffer from numerous other disadvantages. For example, containers are manufactured in a variety of shapes and sizes and may include mounting cups, valve stems, and/or other components that make attachment of the automated actuation system difficult once the initial product is expired and the user wishes to install the automated actuation system on a different container. If a user forces the container into an automated actuation system that is not adapted to support that specific container, the system is susceptible to an incorrect and/or unsecure attachment between the container and overcap. This type of attachment causes fluid leakage, breakage at the connection point, imprecise timing and spraying sequences, and overall stability issues with maintaining the container on the automated actuation system.

A known advantage to some of the prior art systems includes a "lock and key" type setup between the container and an automated actuation system to prevent the unauthorized insertion of a container therein. For example, a "lock" may be provided on some portion of an actuating system such that only an authorized "key" disposed on some portion of the container will allow the system to work upon interaction thereof. However, known systems have had limited success in solving the aforementioned problems.

Therefore, a solution is provided herein that provides for a standardized adapter, which is adapted to be releasably attached to a container. The adapter is configured to interact with a locking portion disposed on part of an overcap, housing, or other surface. The overcap preferably includes an automated actuation system. The present solutions provide for a stable connection between the overcap and the container (or any surface and a container) to assist in effective emission of a product by the automated actuation system and to ensure a precise interface between the valve assembly of the container and the automated actuation system. Further, the solutions presented herein also offer the user an intuitive and easy to use means to connect a container to an overcap. Still further, solutions are also provided herein that assist in the controlled attachment of the container and overcap by the provision of guiding means, which may prevent inappropriate connection that could damage or render the device inoperable.

SUMMARY OF THE INVENTION

According to one aspect, an attachment mechanism for a container includes a housing having a locking element extending therefrom. At least one opening extends through the locking element to selectively receive a portion of the container. A resilient member is disposed within the locking element.

According to another aspect, a lock includes a locking element extending from a base. The locking element includes an orifice to receive a portion of a container and further includes an opening in a sidewall thereof. The lock also includes a resilient member disposed within the locking element.

According to a different aspect, an attachment mechanism includes a locking element including an orifice to receive a portion of a container. The orifice extends through the locking element. A sidewall extends from the locking element. The sidewall has an opening. A resilient member is disposed within the locking element.

BRIEF DESCRIPTION OF THE DRAWINGS

FIG. 106 is a bottom isometric view of the annular ring of FIG. 104 partially disposed within the locking element of FIG. 105;

FIG. 107 is an alternative embodiment of a locking element adapted for use with any of the annular rings discussed herein;

FIG. 108A is an isometric view of the container of FIG. 8B having the annular ring of FIG. 57 disposed thereon and further including a wick extending upwardly therefrom;

FIG. 108B is a top isometric view of the container of FIG. 108A and further including the base of FIG. 77;

FIG. 108C is a front isometric view of the container of FIG. 108A disposed within a housing;

FIG. 109A is a front isometric view of the container of FIG. 8C having the annular ring of FIG. 57 disposed thereon in combination with the resilient member of FIG. 69;

Figure 8:
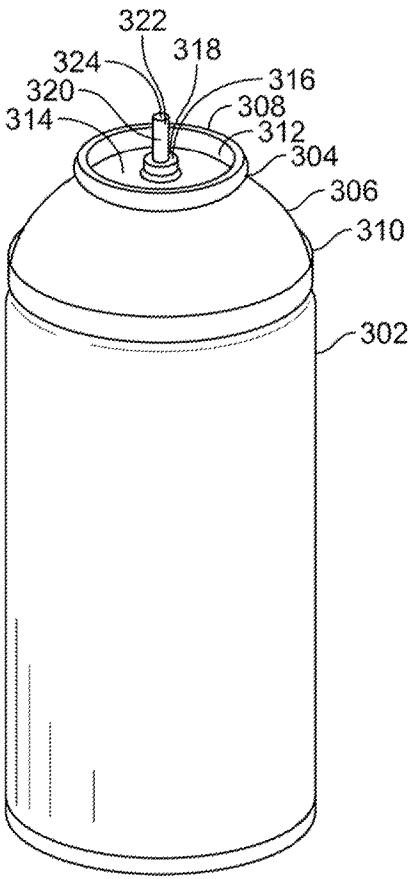
FIG. 8 is an isometric view of a container adapted for use in the product dispensing system of FIG. 1.
Figure 8B:
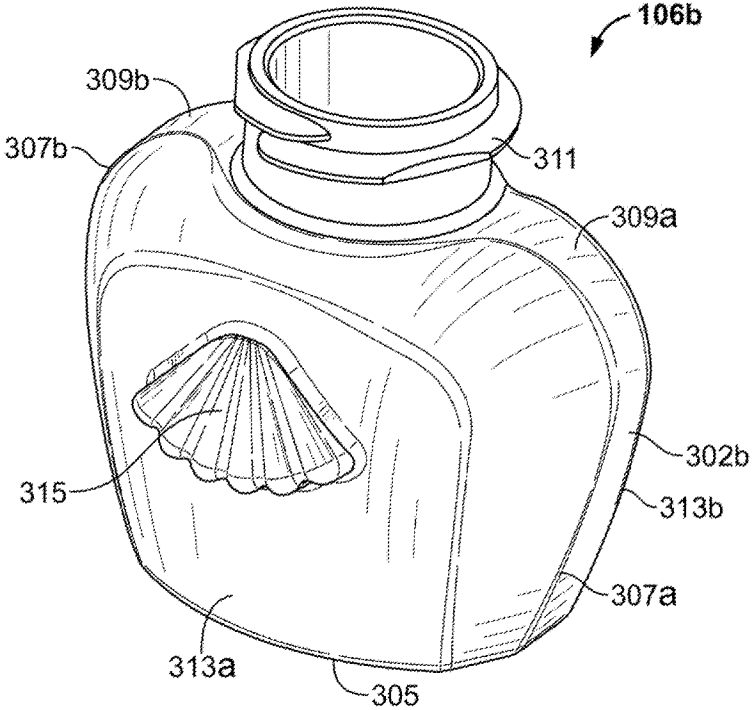
FIG. 8B is an isometric view of another embodiment of a container.
Figure 8A:
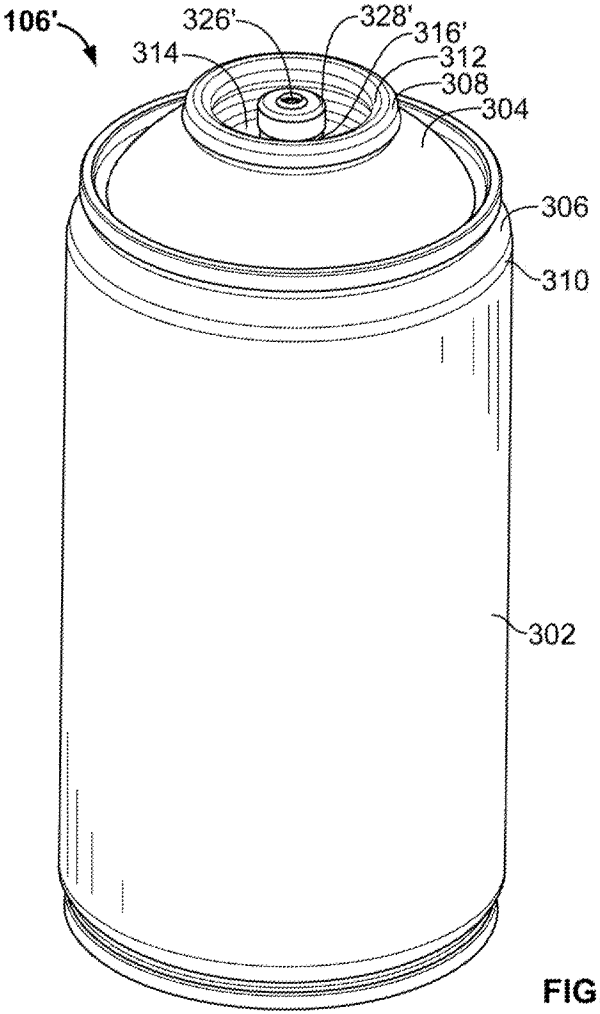
FIG. 8A is an isometric view of a different embodiment of a container.
Figure 8D:
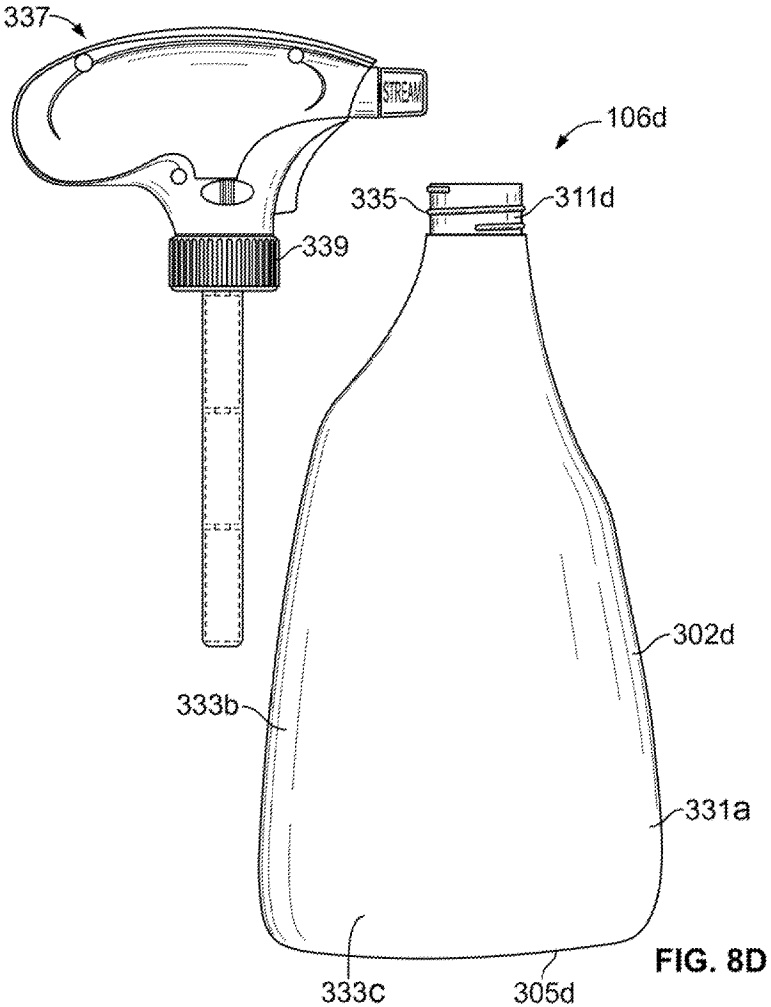
FIG. 8D is an isometric view of another embodiment of a container.
Figure 57:
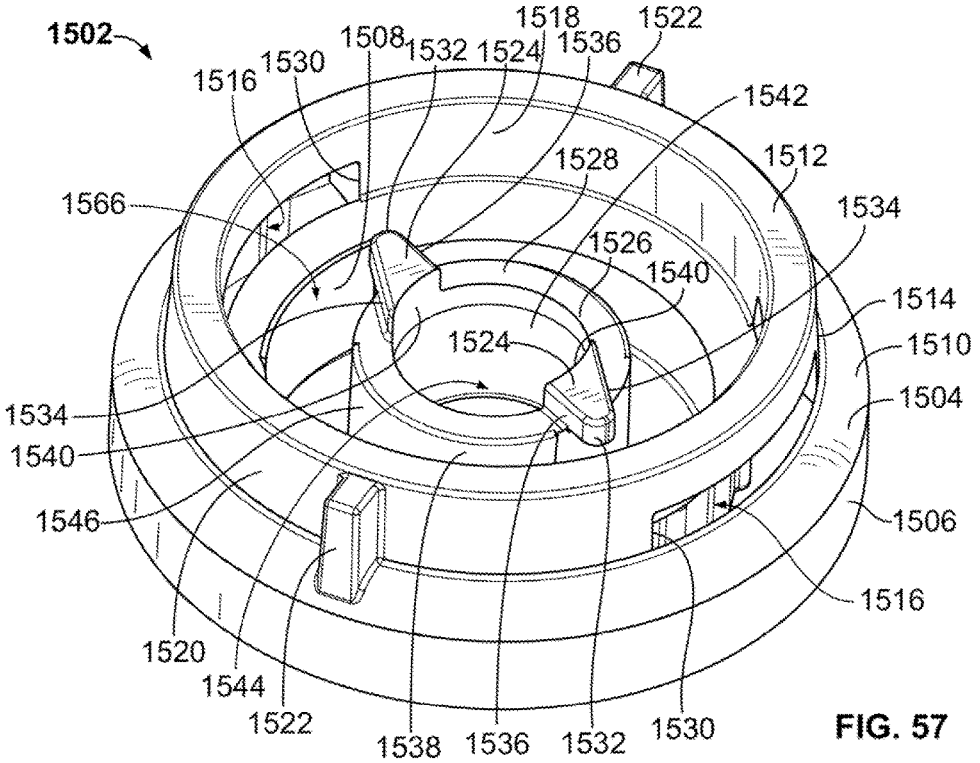
FIG. 57 is a top isometric view of a seventh embodiment of an annular ring adapted for use in an attachment mechanism.
Figure 77:
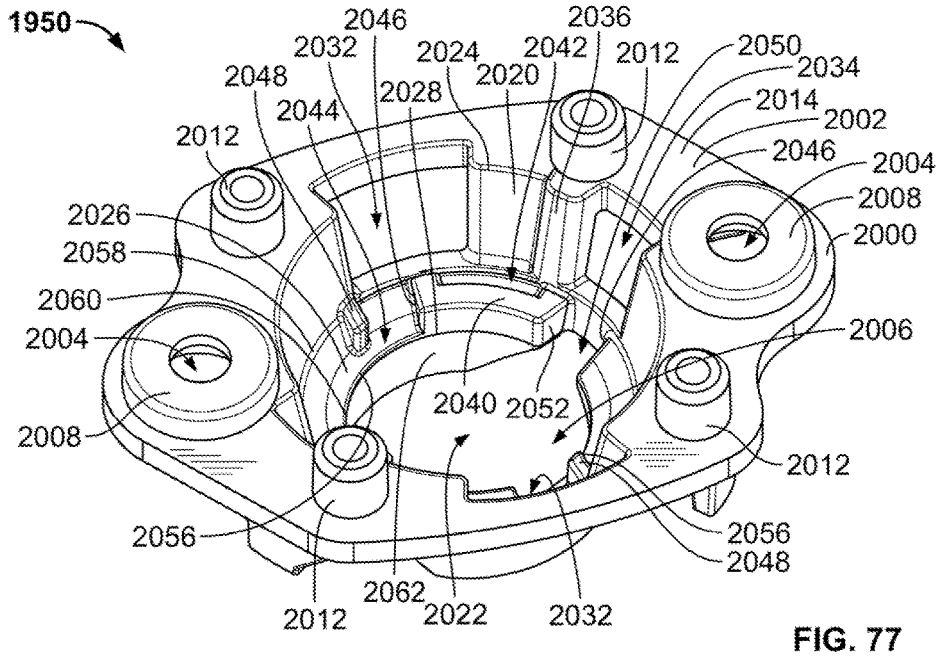
FIG. 77 is a top isometric view of the locking element of FIG. 76.
Figure 109B:
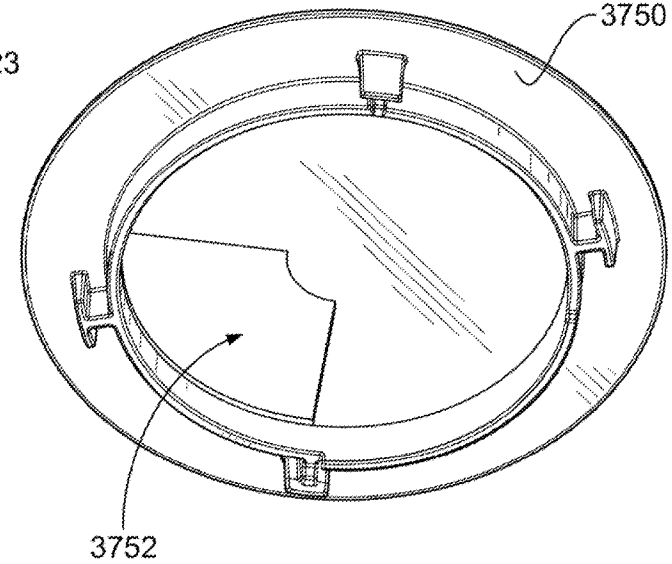
Figure 109A:
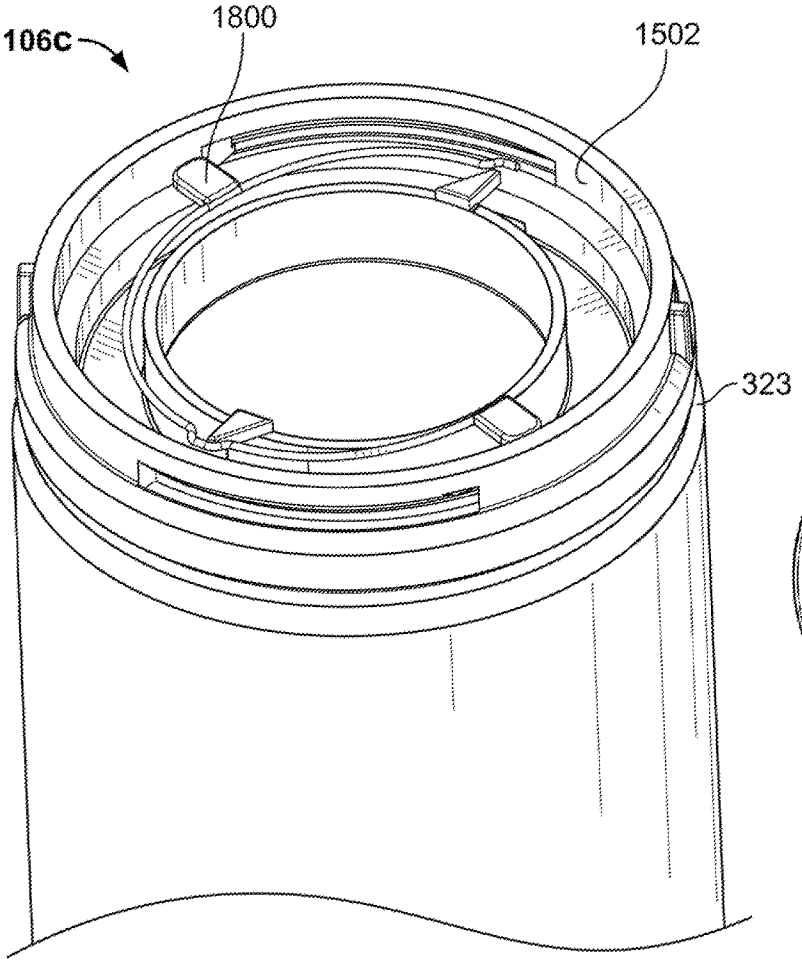
Figure 110:
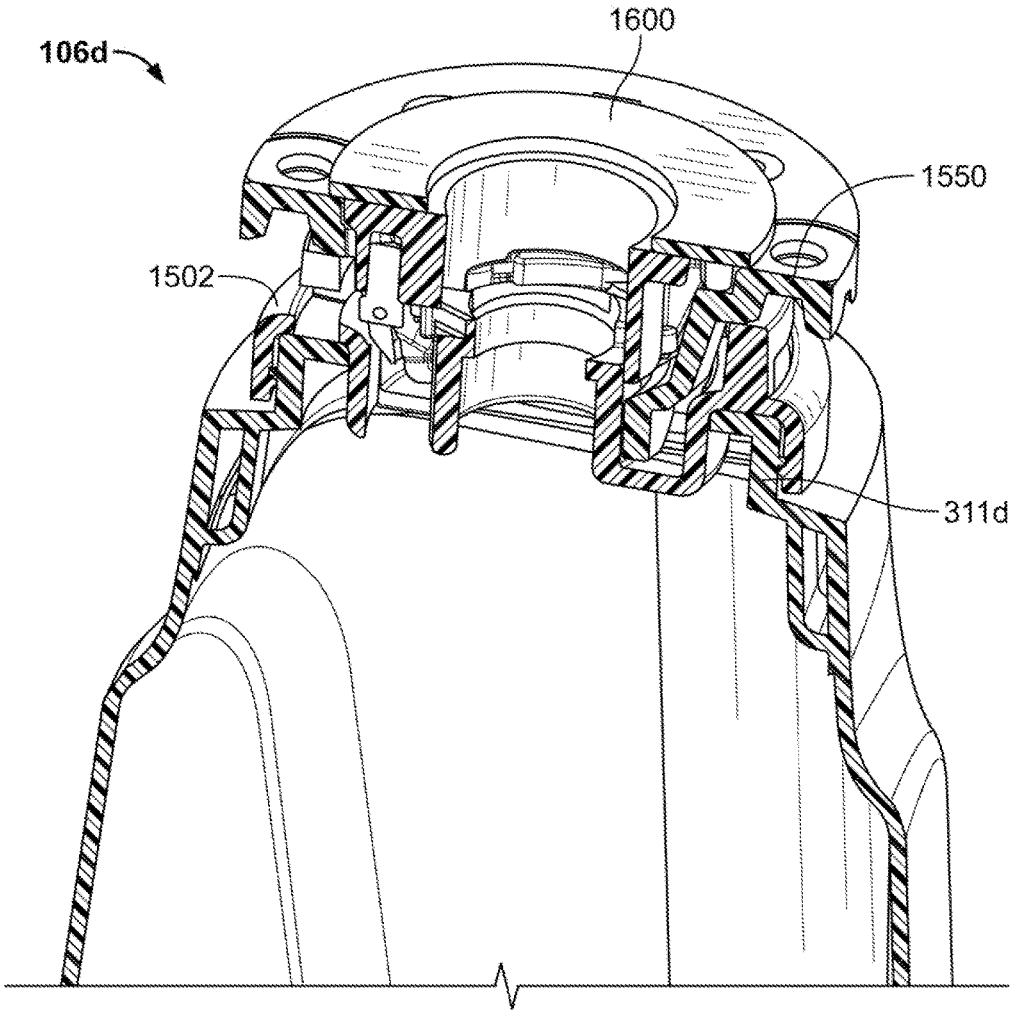

FIG. 109B is a bottom isometric view of a locking element similar to the locking element of FIGS. 63-69 adapted for use with the container of FIG. 109A; and FIG. 110 is a partial isometric cross-sectional view of a container similar to the container depicted in FIG. 8D having the annular ring of FIG. 57 disposed thereon in combination with the base of FIG. 77 and the locking element of FIGS. 63-69.

Other aspects and advantages of the present invention will become apparent upon consideration of the following detailed description, wherein similar structures have similar reference numerals.

DETAILED DESCRIPTION OF THE DRAWINGS

Figure 1:
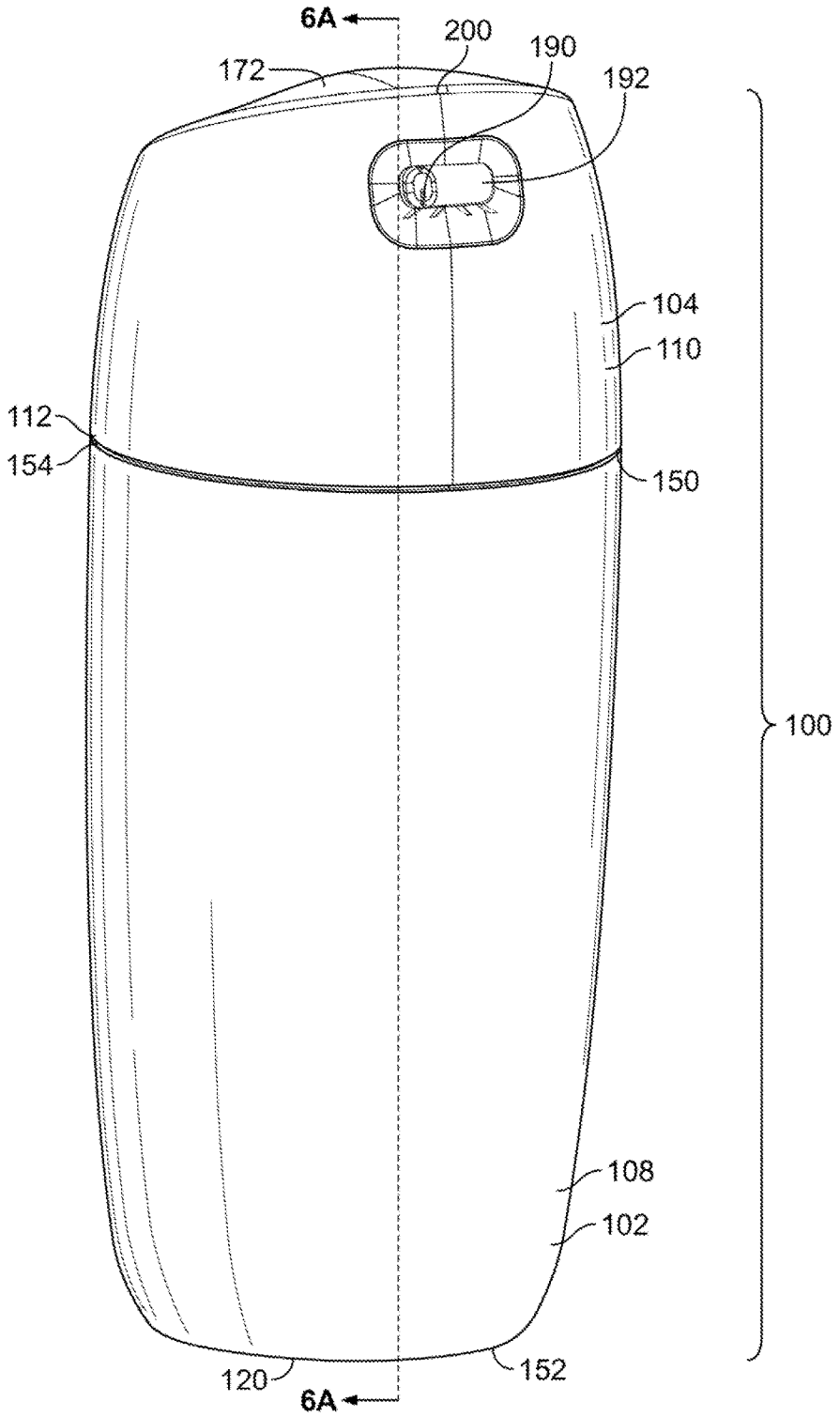
FIG. 1 is a rear isometric view of a product dispensing system that includes a housing, an overcap attached thereto, and a container (not shown) disposed therein.

FIG. 1 depicts a product dispensing system 100 that includes a housing 102 and an overcap 104. The housing 102 and overcap 104 are releaseably attached to form a compartment adapted to retain a container 106 (not shown in FIG. 1). The overcap 104 may be removed from the housing 102 to insert and/or remove the container 106 from the housing 102 prior to and after use. The housing 102 and the overcap 104 are generally cylindrical in shape and each include a sidewall 108, 110 respectively, that tapers outwardly such that the diameter of the product dispensing system 100 is at its greatest at an area adjacent a seam 112 formed by the intersection of the housing 102 and the overcap 104. The product dispensing system 100 is adapted to release any product as is known in the art, which is explained in more detail hereinbelow. Although specific containers and overcaps are discussed herein, it is anticipated that the various locking/keying mechanisms described throughout may be used with any number of containers and overcaps known to those in the art.

Figure 2:
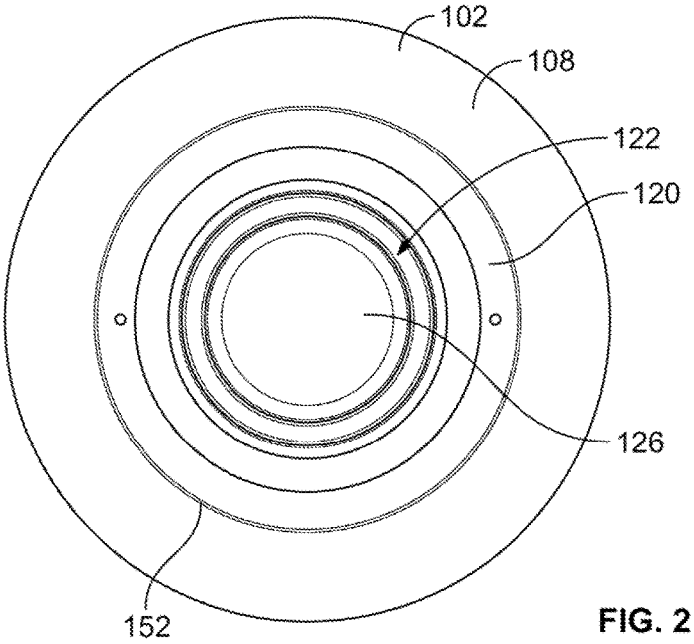
FIG. 2 is a bottom plan view of the housing of FIG. 1.

As best seen in FIGS. 1 and 2, the housing 102 includes a substantially flat circular base 120 with the sidewall 108 extending upwardly therefrom. The base 120 includes an annular groove 122 disposed centrally therein, which is adapted to interact with a wall adapter 124 (see FIG. 3) described below. A circular portion 126 is disposed interiorly of the groove 122, and along with a portion of the base 120, forms a substantially bowl-shaped surface. Peripheral portions of the base 120 provide a substantially flat surface upon which the housing 102 may rest upon a horizontal support surface to stay upright.

Figure 3:
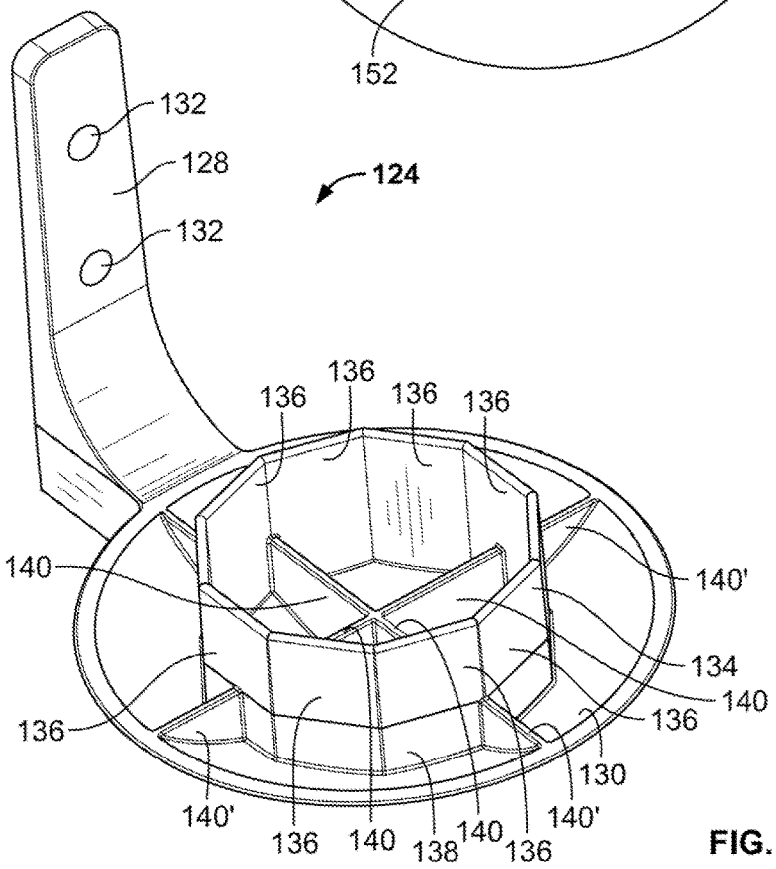
FIG. 3 is an isometric view of a wall adapter, which is adapted to interact with the housing of FIG. 1.

As shown in FIG. 3, the wall adapter 124 includes an L-shaped wall mount 128 and a circular base 130 extending outwardly therefrom. The wall mount 128 includes a plurality of holes 132 that may be used in conjunction with screws or nails, for example, to attach the wall mount 128 to a vertical support surface. The circular base 130 includes a central segmented pedestal 134 extending upwardly therefrom. The pedestal 134 is defined by a plurality of discrete segments 136 forming a continuous sidewall 138 with a decagonal shape. Four stabilizing ribs 140 are disposed within an interior of the sidewall 138 and four additional stabilizing ribs 140' are disposed on an exterior. The stabilizing ribs 140 disposed on the inside of the pedestal 134 provide a support surface for the housing 102 as described in more detail hereinbelow.

In use, the wall adapter 124 is preferably attached to a vertical support surface (not shown) in a level manner such that the sidewall 138 of the pedestal 134 is parallel to the vertical surface. During attachment to the vertical support surface, the L-shaped wall mount 128 is preferably disposed adjacent the support surface such that screws or nails can be positioned to extend from one side of the L-shaped wall mount 128, through the plurality of holes 132, and secured to the support surface. The housing 102 is adapted to be supported by the wall adapter 124 when the product dispensing system 100 is in use. After the wall adapter 124 is attached to the support surface, the housing 102 is placed on top of the base 130 of the adapter 124. Correct alignment of the housing 102 will cause the sidewall 138 of the pedestal 134 to be aligned with and inserted into the groove 122 of the housing 102. In this position, the wall adapter 124 provides a support surface that is adapted to hold the weight of the product dispensing system 100. Although the wall adapter 124 is described in conjunction with the housing 102 herein, it is contemplated that the product dispensing system 100 can be used without any type of surface mounting adapter and/or with other types of mounting adapters.

Referring again to FIG. 1, the sidewall 108 of the housing 102 extends upwardly from the base portion 120 and tapers outwardly before terminating at a top edge 150. The diameter of the sidewall 108 is narrowest at an area 152 adjacent the base 120 and greatest at an area 154 adjacent the top edge 150 of the housing 102. A groove (not shown) is disposed around the circumference of an interior surface of the sidewall 108 of the housing 102. The groove is adapted to interact with portions of the overcap 104 to releasably secure the overcap 104 to the housing 102.

Figure 4:
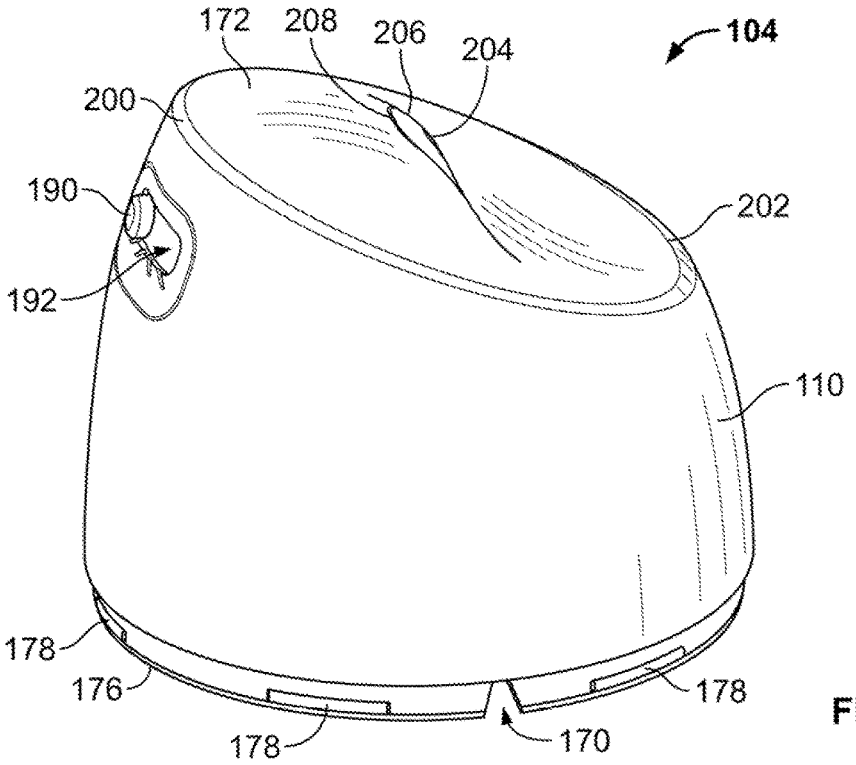
FIG. 4 is a rear isometric view of the overcap of FIG. 1.
Figure 5:
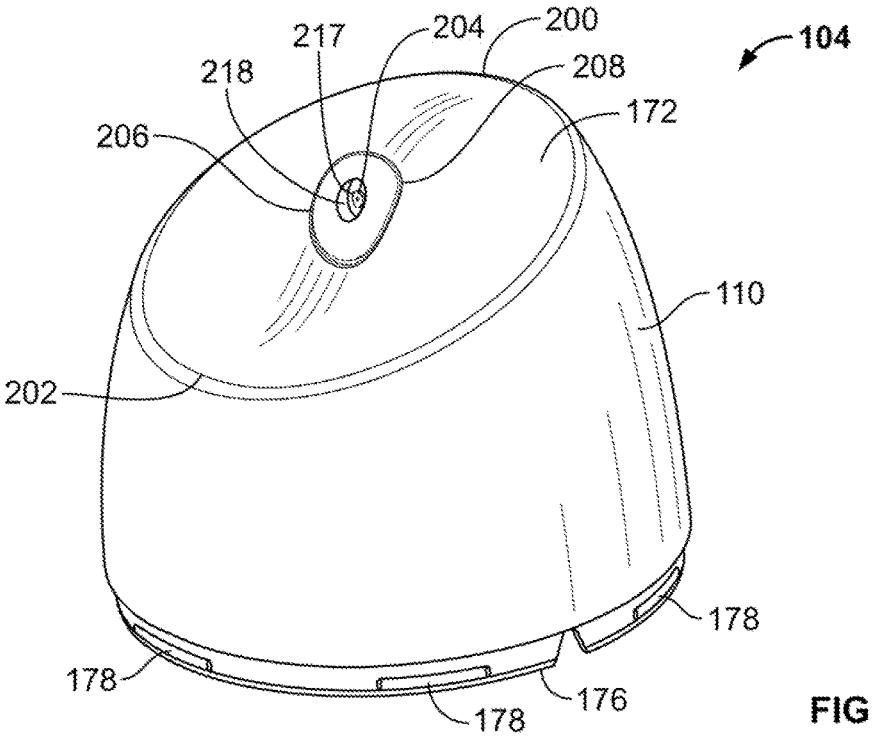
FIG. 5 is a front isometric view of the overcap of FIG. 1.
Figure 6A:
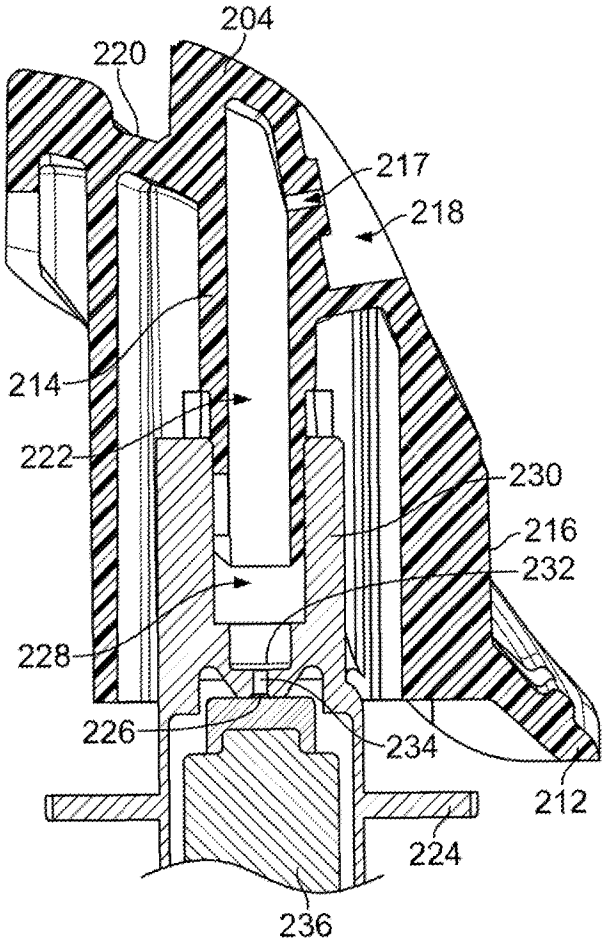
FIG. 6A is a partial cross-sectional side view of a nozzle assembly and a solenoid valve assembly adapted for use with the overcap of FIG. 1 taken generally along the line 6A-6A shown in FIG. 1.
Figure 6:
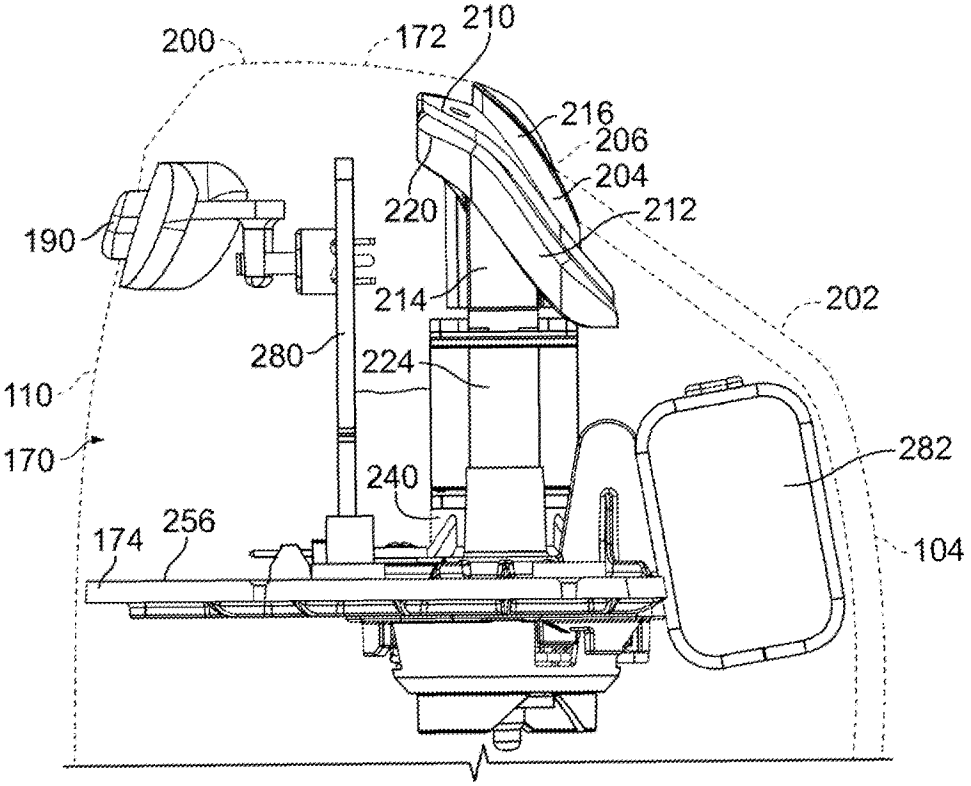
FIG. 6 is a partial side view of various internal components of the overcap of FIG. 1, wherein portions of the overcap are depicted in phantom lines or removed therefrom for clarity.

As best seen in FIGS. 4-6, a cylindrical chamber 170 is defined between a contoured top wall 172 and the cylindrical sidewall 110, which tapers outwardly therefrom. The sidewall 110 extends downwardly toward a platform 174 (shown in FIG. 6) and a bottom edge 176 of the sidewall 110. The platform 174 extends across the bottom of the sidewall 110 to close the internal chamber 170 of the overcap 104. The internal chamber 170 is adapted to contain various mechanical and/or electrical components of the product dispensing system 100.

The bottom edge 176 of the overcap 104 circumscribes the sidewall 110 and is inset therefrom. The bottom edge 176 is defined by a diameter that substantially corresponds to a diameter of the housing 102 adjacent the top edge 150. The bottom edge 176 further includes a plurality of outwardly extending elongate ribs 178 disposed around an exterior surface thereof. The ribs 178 are adapted to interact with a groove (not shown) circumscribing an interior portion of the sidewall 108 of the housing 102 to secure the overcap 104 to the housing 102 in a snap-fit type manner.

As best seen in FIGS. 1 and 4, the sidewall 110 of the overcap 104 further includes a switch 190 disposed on a rear face of the sidewall 110 adjacent the top wall 172. The switch 190 extends from a racetrack shaped opening 192 formed in the sidewall 110. The switch 190 is adapted to control various operational aspects of the product dispensing system 100. For example, the switch 190 may be used to set various time parameters, on/off modes, spray modes, and/or any other operational parameters. In one embodiment, a spray sequence may be used such as that described with respect to application Ser. No. 11/805,976, filed on May 25, 2007, and hereby incorporated by reference. In other embodiments the switch 190 may be omitted all together.

As depicted in FIGS. 4 and 5, the contoured top wall 172 slopes downwardly from a first edge 200 adjacent the rear face, toward a second edge 202 on an opposing front face of the overcap 104. The second edge 202 is disposed below the first edge 200. A nozzle assembly 204 is disposed adjacent a centerpoint 206 of the top wall 172 within a circular opening 208. The nozzle assembly 204 is adapted to allow the product to be dispensed therethrough. The nozzle assembly 204 is surrounded by a flexible member in the form of a gasket 210 (see FIG. 6) to prevent the leakage of volatile material through the opening 208. Although a circular opening 208 is disclosed herein, it is contemplated that openings of other sizes and shapes may be provided in the overcap 104 to allow the product to be dispensed therethrough.

As best seen in FIGS. 6 and 6A, the nozzle assembly 204 extends downwardly into the chamber 170 of the overcap 104 and includes a contoured body 212 and a circular sidewall 214. A pedestal 216 protrudes upwardly from the body 212 and includes an opening 217 therein to allow the product to flow therethrough. The opening 217 is disposed in a recess 218 (see FIG. 5) formed in a central portion of the pedestal 216. The gasket 210 is adapted to rest on an upper surface 220 of the body 212 and surround the pedestal 216. The sidewall 214 defines a channel 222 extending the length thereof that is adapted to provide fluid communication between various internal dispensing components and the opening 217. The sidewall 214 and corresponding channel 220 are adapted to interact with and provide fluid communication to a solenoid valve assembly 224 disposed adjacent thereto.

A sealing surface 226 is provided between the nozzle assembly 204 and the solenoid valve assembly 224. The sealing surface 226 provides a substantially fluid tight seal when the product dispensing system 100 is not in use. As best seen in FIG. 6A, the sidewall 214 of the nozzle assembly 204 is adapted to be fittingly received into a cylindrical chamber 228 disposed at an upper end 230 of the solenoid valve assembly 224. A lower end 232 of the cylindrical chamber 228 includes an opening 234 that defines one part of the sealing surface 226. A plunger 236 is disposed adjacent the opening 234 on an opposite side thereto. The plunger 236 is adapted to move axially within the solenoid valve assembly 224 to press against and cover the opening 234 to create the sealing surface 226 when the solenoid valve assembly 224 is not energized (as shown in FIG. 6A). When the solenoid valve assembly 224 is energized, the plunger 236 moves axially downwardly away from the opening 234 to allow product to flow therethrough. However, it is anticipated that any automatic or manual actuation system may be used in the product dispensing system 100.

Figure 7:
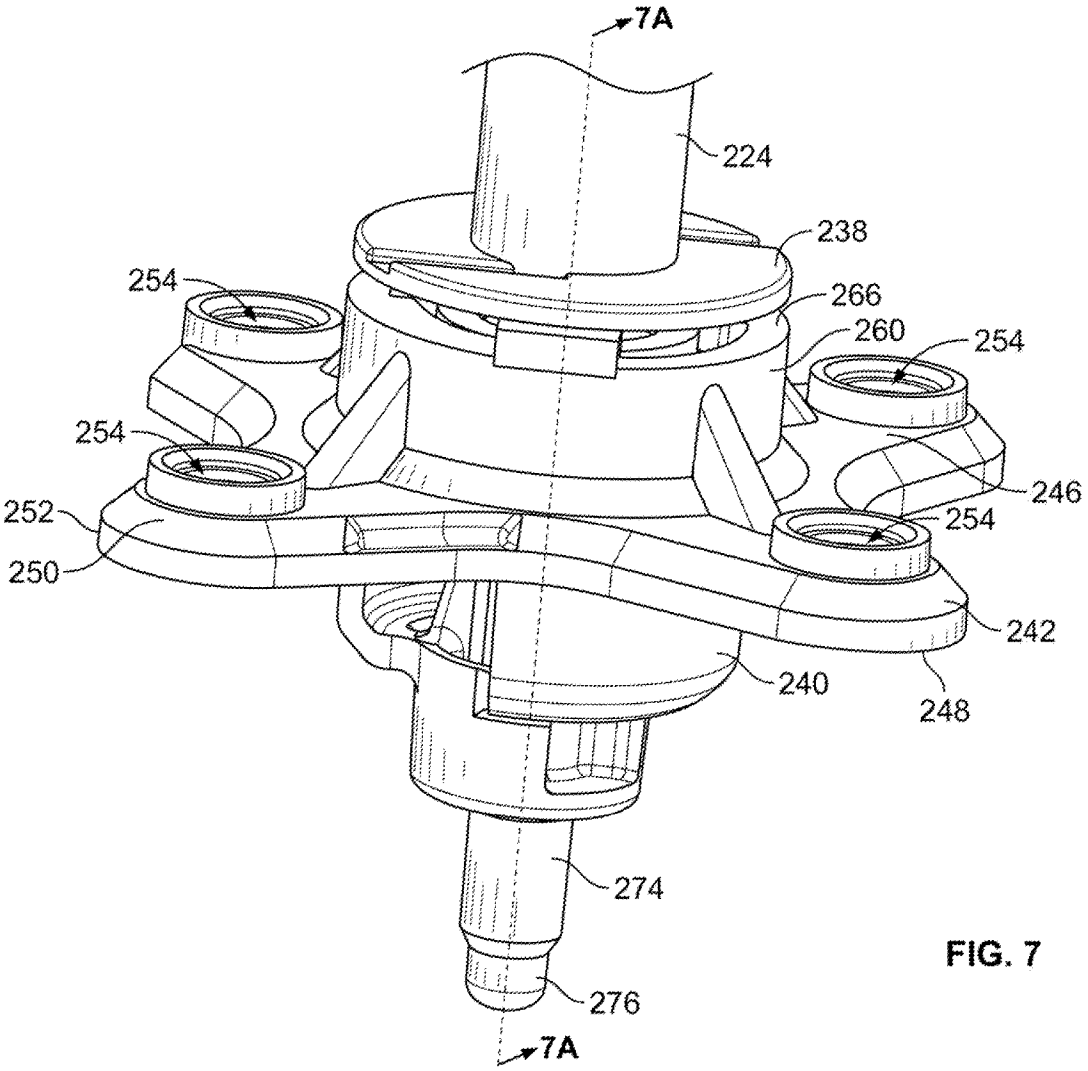
FIG. 7 is a partial isometric view of a lower portion of the solenoid valve assembly of FIG. 6A attached to an actuating member.

As best seen in FIG. 7, a lower end 238 of the solenoid valve assembly 224 is adapted to interact with an actuating member 240. The actuating member 240 includes a star-shaped base 242 defining a circular orifice 244 therein. The base 242 includes an upper surface 246 and a lower surface 248 with a downwardly angled ledge 250 around an edge 252 thereof. A plurality of holes 254 extend through the base 242 and are adapted to receive screws (not shown) to attach the actuating member 240 to the platform 174. As shown in FIG. 6, the actuating member 240 is attached to an upper surface 256 of the platform 174 and extends through an opening (not shown) of the platform 174 downwardly toward the container 106.

Figure 7A:
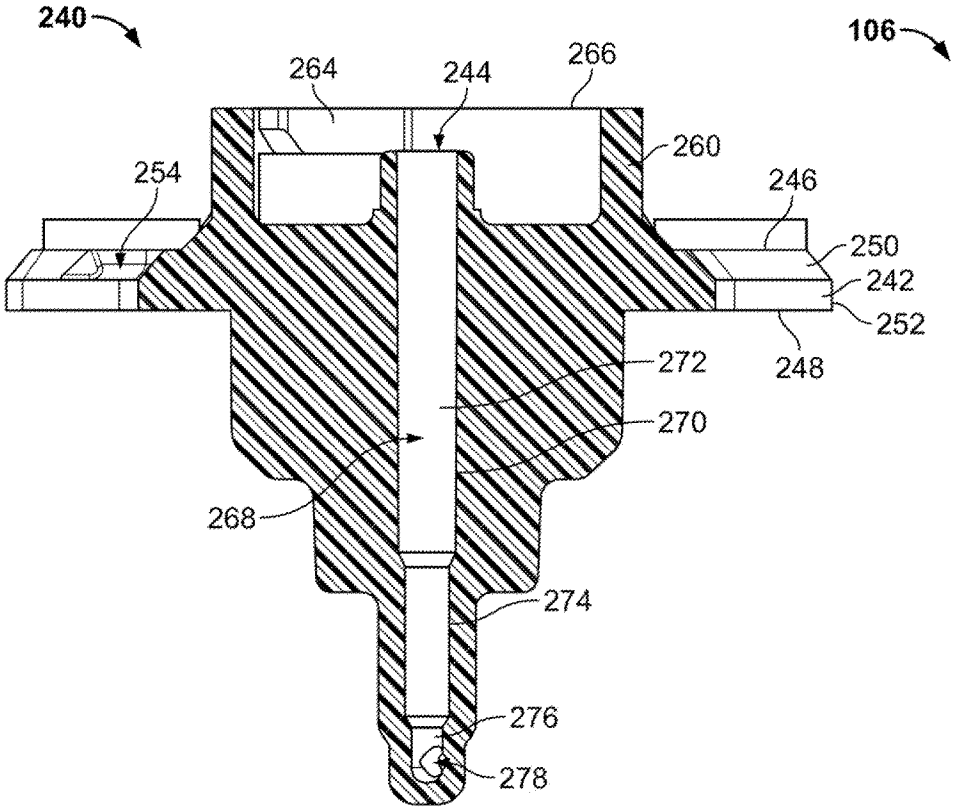
FIG. 7A is a cross-sectional view of the actuating member of FIG. 7 taken generally along the line 7A-7A shown in FIG. 7.

Referring to FIG. 7A, an annular wall 260 extends upwardly from the upper surface 246 of the base 242 and includes two curved ledges 264. The curved ledges 264 extend inwardly from a top edge 266 of the annular wall 260 toward the orifice 244. The ledges 264 are adapted to interact with a sloped portion (not shown) on the solenoid valve assembly 224 to retain the solenoid valve assembly 224 thereon. The orifice 244 in the actuating member 240 provides fluid communication between the solenoid valve assembly 224, the actuating member 240, and the container 106. The orifice 244 defines a cylindrical fluid flow channel 268 defined by a stepped cylindrical sidewall 270 that extends downwardly throughout the length of the orifice 244.

As best seen in FIG. 7A, the stepped cylindrical sidewall 270 includes a widened top portion 272 that tapers into a narrowed medial portion 274 and terminates at a tip 276. A rounded opening 278 is formed in the tip 276 that allows for product flow therethrough. The tip 276 is adapted to interact with the container 106 as described in more detail hereinbelow to actuate the product dispensing system 100.

As best seen in FIG. 6, the solenoid valve assembly 224 is electrically connected to a circuit board 280 and to a battery 282. The circuit board 280 is electrically attached to the switch 190 in the overcap 104, which allows a user to control various operating parameters of the dispensing system 100. The circuit board 280 translates the switch mode that is selected by the user into the appropriate energizing/ de-energizing sequence of the solenoid valve assembly 224. The battery 282 supplies power to the dispensing system 100.

Now turning to FIG. 8, one type of aerosol container 106 is shown that may be used in connection with the disclosed embodiments. The aerosol container 106 comprises a substantially cylindrical body 302 with an opening 304 at a top end 306 thereof. A mounting cup 308 is crimped to a tapered portion of the container 106, which defines the opening 304. The mounting cup 308 seals the top end 306 of the body 302. A second crimped portion at a bottom end of the tapered portion defines a seam 310. The seam 310 and/or mounting cup 308 provide a location in which a protective cap, overcap (not shown), or other structure may be attached thereto, as is known in the art.

Still referring to FIG. 8, the mounting cup 308 is generally circular-shaped and may include an annular wall 312 that protrudes upwardly from a base 314 of the mounting cup 308 adjacent the area of crimping. A central pedestal 316 extends upwardly from a central portion 318 of the base 314. A conventional valve assembly (not shown in detail) includes a valve stem 320, which is connected to a valve body (not shown) and a valve spring (not shown) disposed within the container 106. The valve stem 320 extends upwardly through the pedestal 316, wherein a distal end 322 extends upwardly away from the pedestal 316 and is adapted to interact with an actuator disposed within the overcap 104.

The actuator (not shown) may be assembled onto the distal end 322 of the valve stem 320. A user may manually or automatically operate the actuator to open the valve assembly, which causes a pressure differential between the container interior and the atmosphere to force the contents of the container 106 out through an orifice 324 of the valve stem 320, through the aforementioned dispensing components of the overcap 104, and into the atmosphere through the nozzle assembly 204. While the present disclosure describes the applicants' invention with respect to the aerosol container 106, the present invention may be practiced with any type of container known to those skilled in the art, but preferably includes a pedestal and/or mounting cup as described previously herein.

As best seen in FIG. 8A, an alternative embodiment of an aerosol container 106' that may be used in connection with any of the disclosed embodiments is depicted, which is similar to the container 106 except for the below-noted differences. The pedestal 316' of the present embodiment includes an opening 326' disposed at a distal end 328' thereof. The actuating member 240 (shown in FIG. 7) extends from the platform 174 in the overcap 104 and is adapted to be inserted into the opening 326'. Specifically, insertion of the tip 276 of the actuating member 240 into the opening 326' causes the actuating member 240 to engage a valve body (not shown) and a valve spring (not shown) disposed within the container 106' to open a valve assembly and allow for the emission of the product. A user may manually or automatically operate the actuator to open the valve assembly, which causes a pressure differential between the container interior and the atmosphere to force the contents of the container 106' out through the actuating member 240, through the solenoid valve assembly 224, and into the atmosphere through the nozzle assembly 204.

It is specifically contemplated that the below noted attachment mechanisms may be used with either male valve stem activated containers (see FIG. 8) or female valve stem activated containers (see FIG. 8A), which are two conventional manners in which valve assemblies of pressurized containers may be operated. However, any pressurized container having a valve assembly may be used in connection with any of the disclosed embodiments and it will be readily apparent to one of ordinary skill how such containers may be used with the embodiments described with particularity herein. It is also contemplated that the present embodiments may be used with vertically or radially, i.e., tilt, activated valve stems. Indeed, the present embodiments provide attachment mechanisms for any type of container.

It is contemplated that the attachment mechanisms disclosed herein may be used with containers that do not include a valve assembly. Now turning to FIG. 8B, a different type of container 106*b* is depicted that may be used in conjunction with any of the embodiments disclosed herein. In a preferred embodiment, the container 106*b* is utilized in conjunction with a dispensing mechanism that utilizes heat to promote the emission of a volatile material through a wick extending from the container 106*b*. The container 106*b* includes a body 302*b* with a product disposed therein. The body 302*b* includes a base portion 305 and first and second opposing walls 307*a*, 307*b* that extend upwardly and outwardly before curving inwardly at first and second top walls 309*a*, 309*b*, respectively, which are integral with a neck 311. The body 302*b* further includes third and fourth opposing curvilinear walls 313*a*, 313*d* that extend upwardly and curve inwardly toward the neck 311. The container 106*b* optionally includes a raised portion 315 extending outwardly from the third and fourth opposing walls 313*a*, 313*b*. Any of the attachment mechanisms disclosed herein may be adapted to be attached to the neck 311 of the container 106*b* (see FIGS. 108A and 108B). Further, the raised portion 315 may be excluded from the container 106*b* in the event that an attachment mechanism is used.

Figure 8C:
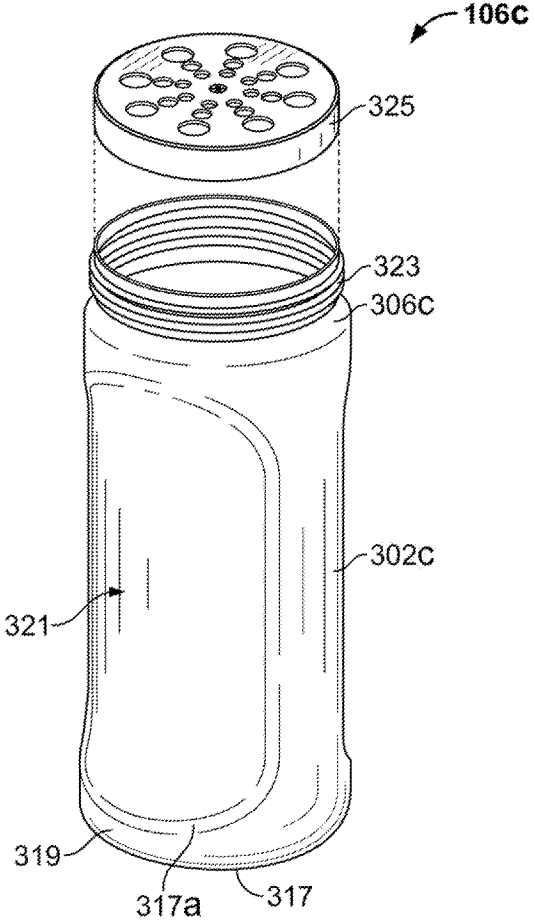
FIG. 8C is an isometric view of a further embodiment of a container.

The various attachment mechanisms disclosed herein may also be used in conjunction with containers that include solids that may be poured or otherwise dispensed through variously sized apertures or openings. As seen in FIG. 8C, another embodiment of a container 106*c* is depicted that comprises a body 302*c*, which extends from a bottom end 317 toward a top end 306*c*. The container 106*c* includes a first portion 319 that generally tapers outwardly from the bottom end 317 to a circular cylindrical portion 317*a*. A gripping surface 321 is provided adjacent the first portion 319. A neck 323 of the body 302*c* adjacent the top end 306*c* is also cylindrical in shape. The neck 323 is adapted to utilize any of the attachment mechanisms as disclosed herein. More specifically, any of the annular rings are adapted to attach to and extend from the neck 323. Further, any of the resilient members and/or locks discussed herein may be attached to a cap 325, which is adapted to seal the top end 306*c* of the container 106*c* (see FIGS. 109A and 109B).

Further, any of the disclosed attachment mechanisms may be used with containers that include pump-type assemblies for the emission of a product, such as the container 106*d* shown in FIG. 8D. The container 106*d* includes a body 302*d* with a product disposed therein. The body 302*d* includes a base portion 305*d* and first and second narrow curvilinear opposing walls 331*a*, 331*b* that extend upwardly before terminating at a neck 311*d*. The body 302*d* further includes third and fourth opposing walls 333*c*, 333*d* (not shown) that are substantially flat and terminate at the neck 311*d*. The neck 311*d* includes threading 335 circumscribing an exterior surface thereof that is adapted to correspond to threading (not shown) disposed on an interior surface of a neck 339 of a sprayer cap 337. The sprayer cap 337 is adapted to be attached to the container 106*d* for manual actuation thereof. The attachment mechanisms disclosed herein may be used in lieu of and/or in conjunction with the threading to attach the sprayer cap 337 to the container 106*d*, for example, in a manner as described in connection with the embodiment shown in FIG. 110.

While the embodiments disclosed herein are generally described in connection with containers 106, 106', 106*b*, 106*c*, and 106*d*, it is intended that the attachment mechanisms may be used with any conventional container. Indeed, any type of container with a metering device may be suited for use with the presently disclosed attachment mechanisms. For example, the containers 106 and 106' employ a valve assembly metering device, whereas the container 106*d* utilizes a pump-type sprayer or an opening adapted to be placed in alignment with a pump-type sprayer as a metering device. Further, the container 106*b* utilizes a wick to meter the emission of a product and the container 106*c* includes an opening adjacent the neck and/or one or more apertures that may be alternatively opened and closed to meter the dispensing of a product. A metering device in its broadest form may comprise an opening in a container that allows for the outflow of a product. It is contemplated that any type of metering device, which effects the emission or dispensing of a product, may be used in connection with any of the embodiments disclosed herein.

In use, the product dispensing system 100 is adapted to release a product from the container 106 upon the occurrence of a particular condition. The condition could be the manual activation of the overcap 104 or the automatic activation of the overcap 104 in response to an electrical signal from a timer or a sensor. The product discharged may be a fragrance or insecticide disposed within a carrier liquid, a deodorizing liquid, or the like. The product may also comprise other actives, such as sanitizers, air fresheners, odor eliminators, mold or mildew inhibitors, insect repellents, and/or the like, and/or that have aromatherapeutic properties. The product alternatively comprises any solid, liquid, or gas known to those skilled in the art that may be dispensed from a container. It is also contemplated that the container may contain any type of pressurized or non-pressurized product and/or mixtures thereof. The product dispensing system 100 is therefore adapted to dispense any number of different products.

Once the overcap 104 and the container 106 are mated, the actuating member 240 engages the valve structure to open same and allow product to flow through the opening 326' and into the solenoid valve assembly 224. The present description is illustrative of one type of actuation system. However, it is contemplated that any type of solenoid or non-solenoid based actuation system may be used in connection with the described attachment mechanisms.

Figure 9:
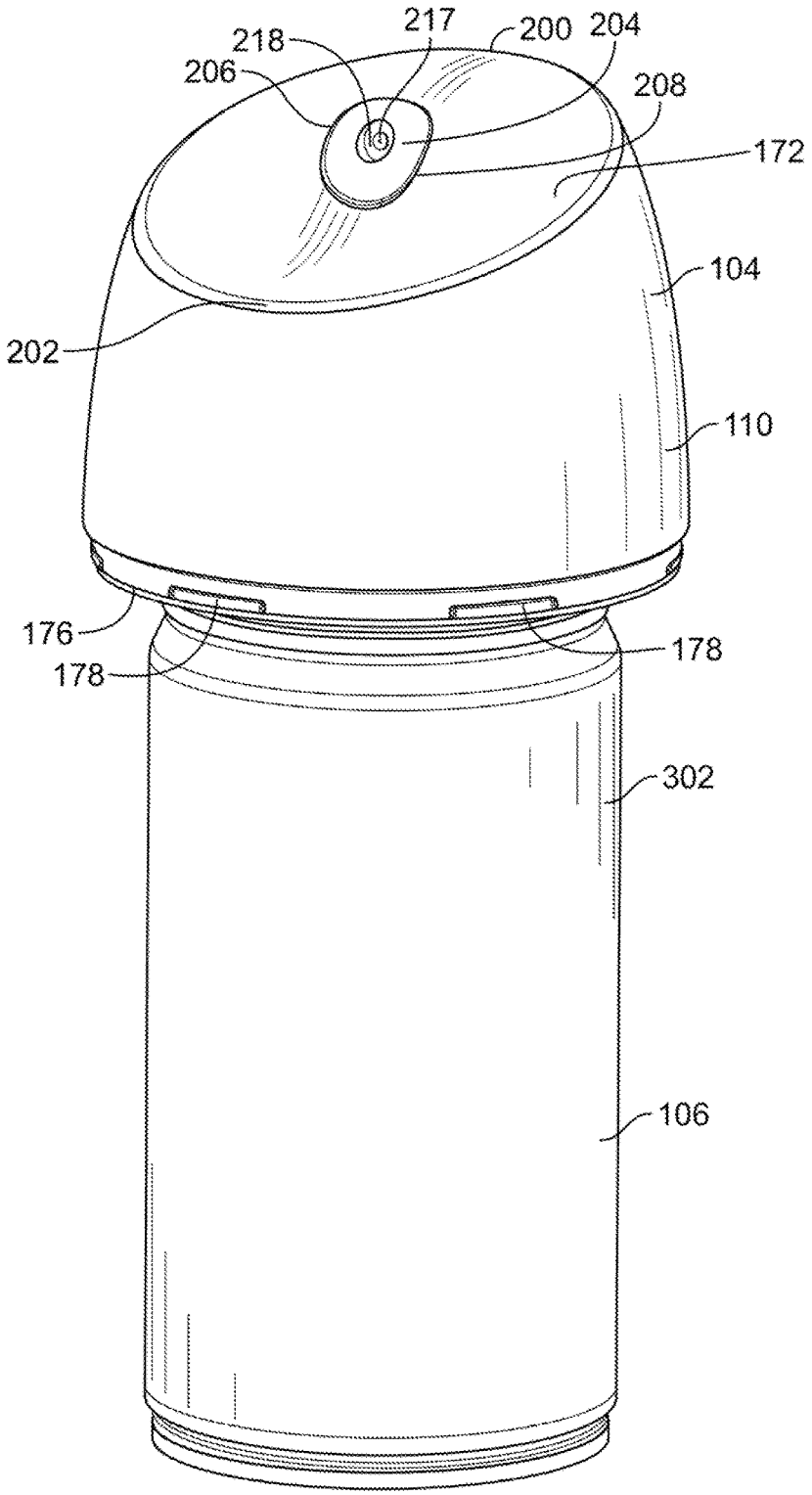
FIG. 9 is a front isometric view of the overcap of FIG. 1 attached to the container of FIG. 8A with the housing of FIG. 1 removed for clarity.

Various connection methods are described herein with respect to releasably attaching the overcap 104 to the housing 102 to form the product dispensing system 100. As shown in FIG. 9, the overcap 104 is adapted to be attached to the container 106. The overcap 104/container 106 combination is thereafter adapted to be inserted into the housing 102 depicted in FIGS. 1 and 2. In a different embodiment, the overcap 104/container 106 combination is used without the housing 102.

FIGS. 10-15 depict a first embodiment of an attachment mechanism 400, which includes a bracket or adapter, which in the present embodiment is an annular ring 402 adapted to be attached to the mounting cup 308 of the container 106. The annular ring 402 is adapted to interact with a corresponding lock provided in the form of a projection 404. As shown in FIGS. 10-14, the annular ring 402 comprises a substantially U-shaped body 406, which is shown in cross-section in FIGS. 12 and 14. The U-shaped body 406 comprises an outer wall 408 and an inner wall 410 that are substantially parallel with one another and connected via a curved upper wall 412. The outer wall 408, inner wall 410, and upper wall 412 form an annular cavity 414, which is adapted to receive and be releasably attached to the mounting cup 308 of the container 106. An opening 416 is formed by the annular ring 402, which is defined by portions of the inner wall 410. The opening 416 is sized to receive portions of the mounting cup 308 and the valve stem 320 of the container 106.

Figure 13:
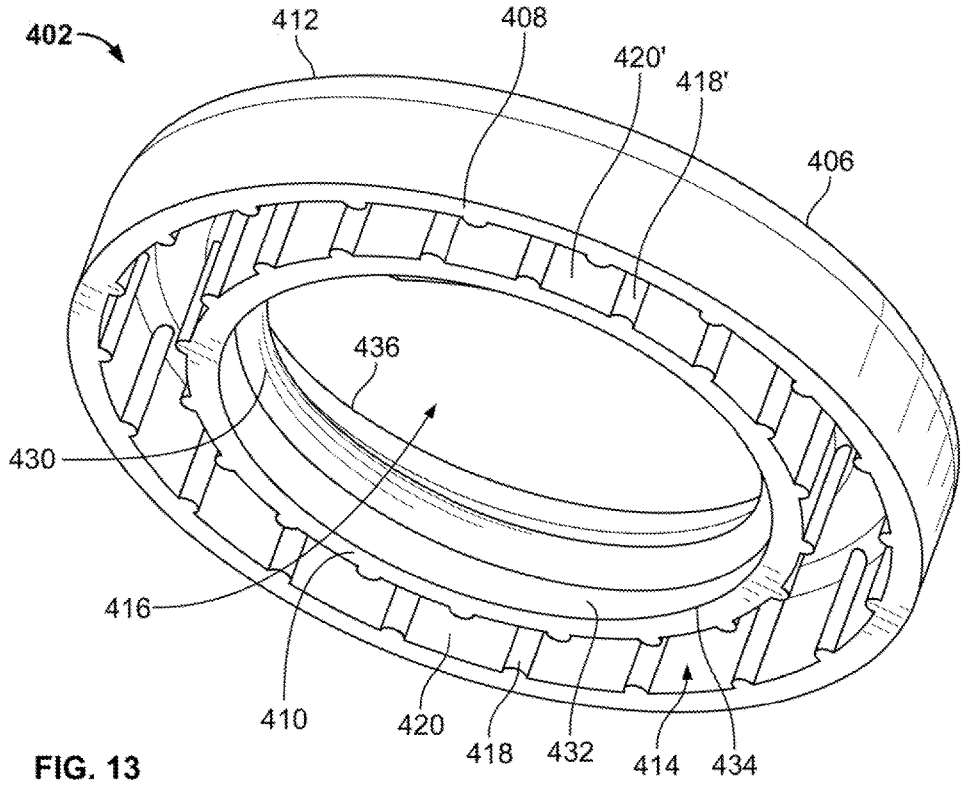
FIG. 13 is a bottom isometric view of the annular ring of FIG. 10 further including a first embodiment of a gripping mechanism.
Figure 14:
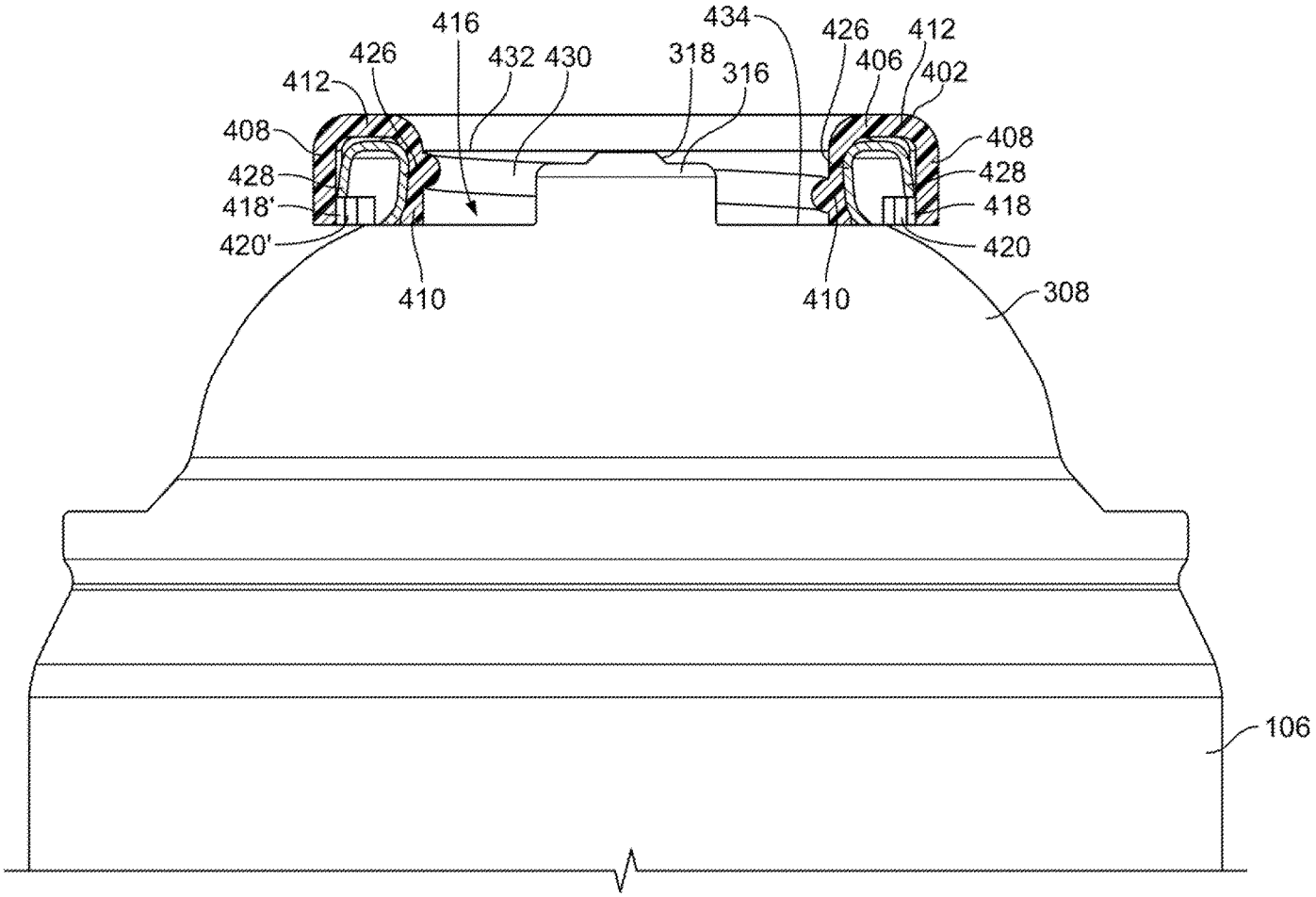
FIG. 14 is a partial cross-sectional view of the annular ring of FIG. 10 taken along the line 12-12 in FIG. 11 disposed on the container of FIG. 8A.

As best seen in FIG. 13, the outer wall 408 and the inner wall 410 include a gripping mechanism in the form of ribs 418, 418' on interior surfaces 420, 420', respectively, thereof, which are adapted to provide a gripping surface to engage portions of the mounting cup 308. In the present embodiment, the ribs 418, 418' extend radially outward from the interior surfaces 420, 420' between about 0.1 mm to about 1.5 mm. The ribs 418, 418' are preferably spaced apart from one another in a substantially uniform manner to provide a uniform gripping pressure around the entire circumference of the annular ring 402 and to restrict movement of the annular ring 402 through torque and rotational forces as well as tension and pull-forces. In the present embodiment, the ribs 418 are spaced apart from one another between about 5 degrees to about 90 degrees. In one embodiment, the annular ring 402 is attached to the container 106 in the manufacturing process. In a different embodiment, a user attaches the annular ring 402 to the container 106 prior to use. As shown in FIG. 14, as the annular ring 402 is pressed downwardly onto the mounting cup 308, the ribs 418, 418' contact both an internal wall 426 and an external wall 428 of the mounting cup 308 to secure the annular ring 402 thereto. As the annular ring 402 is pressed downwardly, the pedestal 316 of the container 106 extends upwardly into, and is partially surrounded by, the opening 416.

Now turning to FIGS. 14A-14F, alternative embodiments of annular rings are shown that comprise various embodiments of gripping mechanisms. For example, an annular ring 402*a* includes a U-shaped body 406*a*, which is shown in cross-section in FIG. 14A. The U-shaped body 406*a* comprises an outer wall 408*a* and an inner wall 410*a* that are substantially parallel with one another and connected via a curved upper wall 412*a*. The outer wall 408*a*, inner wall 410*a*, and upper wall 412*a* form an annular cavity 414*a*, which is adapted to receive and be releasably attached to the mounting cup 308 of the container 106. Still referring to FIG. 14A, the outer wall 408*a* includes a gripping mechanism in the form of a tab 418*a* extending from an interior surface 420*a* thereof that is adapted to provide a gripping surface and to engage portions of the mounting cup 308. The tab 418*a* extends inwardly toward the cavity 414*a* and further includes a ledge 421*a* on a top surface thereof. The annular ring 402*a* optionally includes one or more openings 423*a* disposed adjacent the ledge 421*a* that adds flexibility to the annular ring 402*a*.

In the present embodiment, two ribs 418*a* are depicted that are segmented and disposed on opposing sides of the annular ring 402*a*. As shown in FIG. 14D, as the annular ring 402*a* is pressed downwardly onto the mounting cup 308, the ribs 418*a* contact an external wall 428*a* of the mounting cup 308 to secure the annular ring 402*a* thereto. As the annular ring 402*a* is pressed downwardly, the openings 423*a* allow the annular ring 402*a* to flex outwardly enough such that the ledge 421*a* extends under a crimped portion of the mounting cup 308.

Figure 14A:
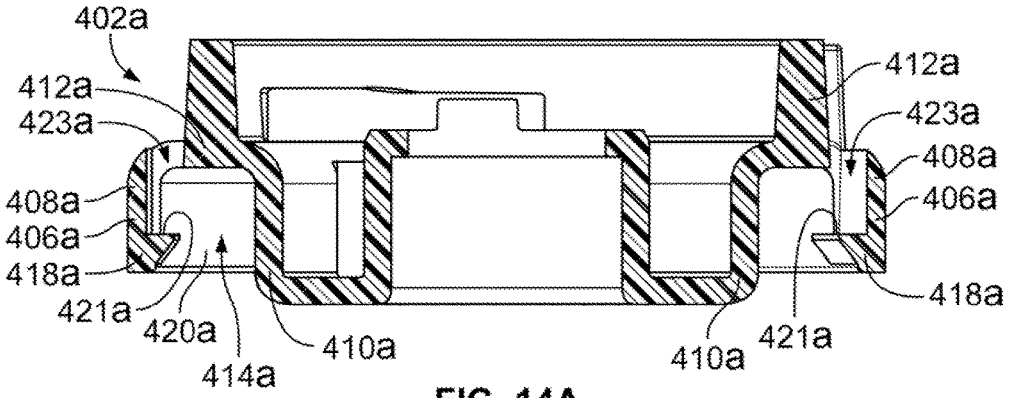
FIG. 14A is a cross-sectional view of an annular ring similar to the annular ring of FIG. 57 including a different embodiment of a gripping mechanism.
Figure 14B:
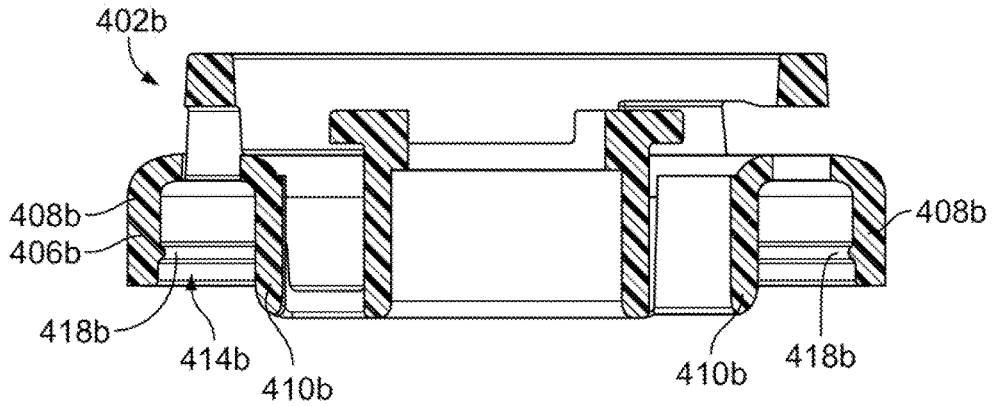
FIG. 14B is a cross-sectional view of an annular ring similar to the annular ring of FIG. 57 including another embodiment of a gripping mechanism.
Figure 14C:
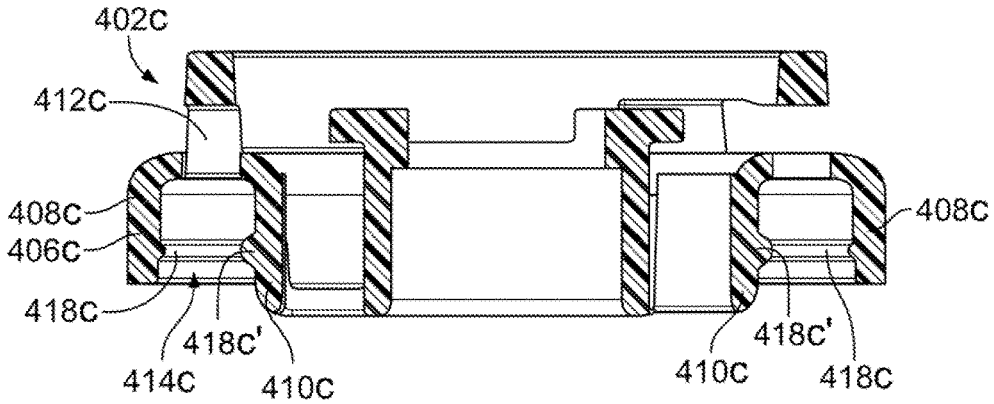
FIG. 14C is a cross-sectional view of an annular ring similar to the annular ring of FIG. 57 including yet a different embodiment of a gripping mechanism.
Figure 14D:
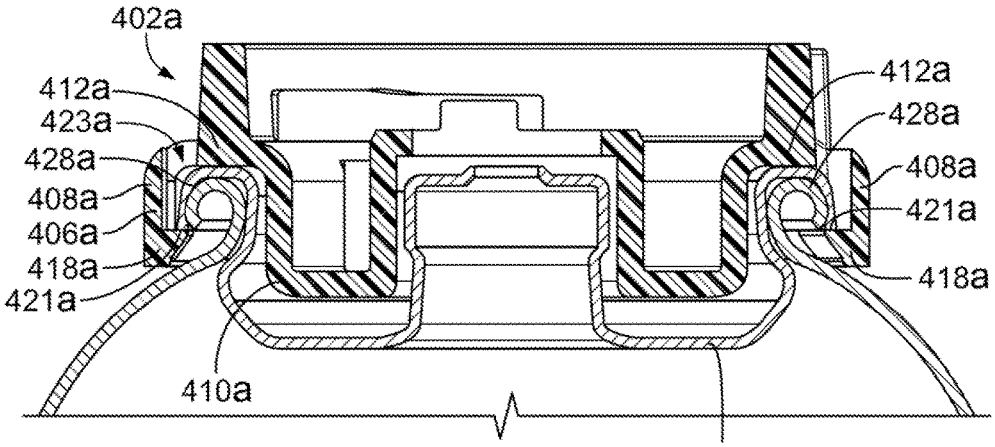
FIG. 14D is a partial cross-sectional view of the container of FIG. 8A with the annular ring of FIG. 14A disposed thereon.
Figure 14E:
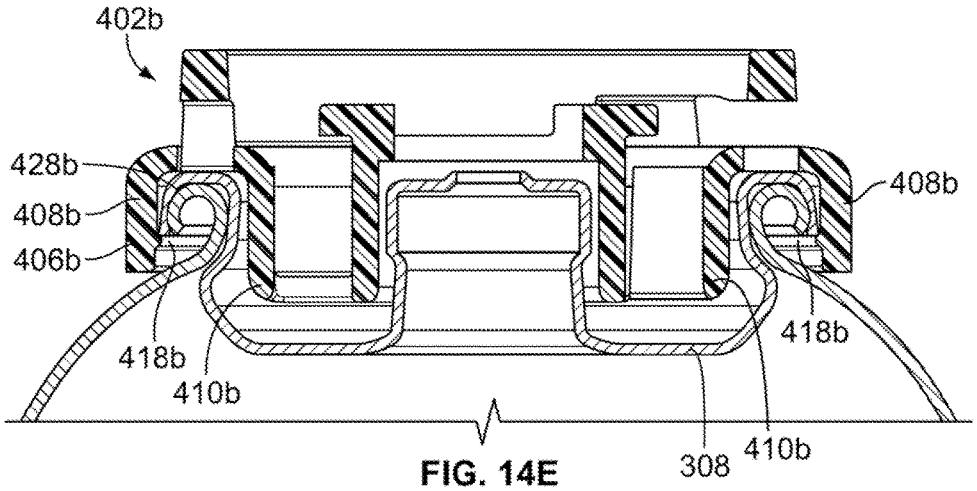
FIG. 14E is a partial cross-sectional view of the container of FIG. 8A with the annular ring of FIG. 14B disposed thereon.
Figure 14F:
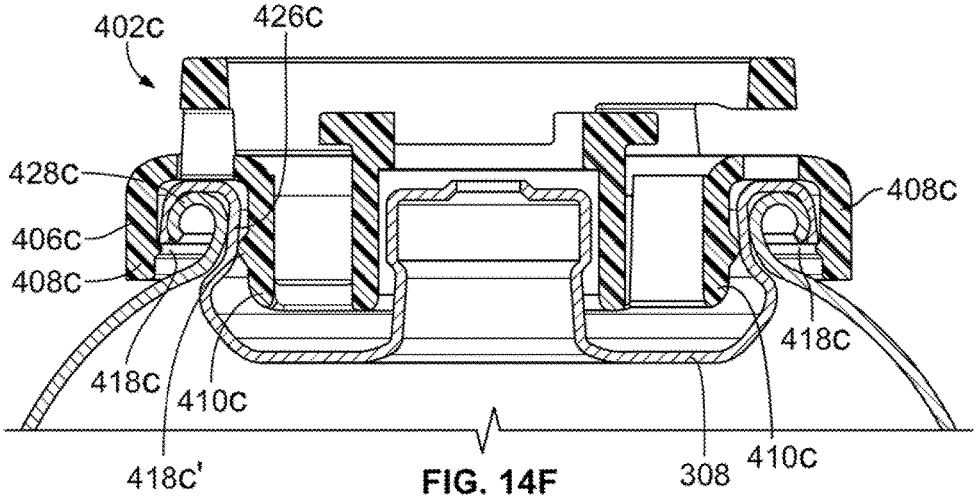
FIG. 14F is a partial cross-sectional view of the container of FIG. 8A with the annular ring of FIG. 14C disposed thereon.

Although two ribs 418*a* are shown in FIG. 14A, any number of ribs may extend from both the inner and/or outer walls 410*a*, 408*a*, respectively, and may be continuous or segmented. For example, FIGS. 14B and 14E depict an annular ring 402*b* having a different embodiment of a gripping mechanism. The annular ring 402*b* includes a U-shaped body 406*b* with an inner wall 410*b* and an outer wall 408*b*. A rounded rib 418*b* circumscribes the entirety of the outer wall 408*b* and extends into a cavity 414*b*. As depicted in FIG. 14E, the annular ring 402*b* is pressed downwardly onto the mounting cup 308 and the rib 418*b* contacts an external wall 428*b* and extends under a seam of the mounting cup 308 to secure the annular ring 402*b* thereto. FIGS. 14C and 14F depict an annular ring 402*c* utilizing another embodiment of a gripping mechanism. The annular ring 402*c* includes a U-shaped body 406*c* with an inner wall 410*c* and an outer wall 408*c*. Two rounded ribs 418*c*, 418*c*' circumscribe the entirety of both the inner wall 410*c* and the outer wall 408*c*, respectively, and extend into a cavity 414*c*. As depicted in FIG. 14F, the annular ring 402*c* is pressed downwardly onto the mounting cup 308 and the ribs 418*c*, 418*c*' contact both an external wall 428*c* and an internal wall 426*c*, respectively, and extend under a seam of the mounting cup 308 to secure the annular ring 402*b* thereto.

While the presently described embodiment contemplates a particular size and spacing of the ribs 418, 418', 418*a*, 418*b*, 418*c*, 418*c*' it is anticipated that other variously shaped ribs may be used to effectively attach the annular ring 402 to the mounting cup. For example, the ribs could be narrower or thicker than the ribs described above, or could extend to a lesser or greater extent about the interior surfaces. It is also contemplated that the ribs could take on other rectangular, curved, triangular, or oval shapes, as would be known to one of ordinary skill. Further, any number of ribs may be used, insofar as it provides an effective attachment to the mounting cup. It is also envisioned that some embodiments may not use any ribs. Rather, the inner surfaces of the annular ring 402 may be attached to the mounting cup by one or more of an interference fit, adhesive, molding process, or any other means that secures the attachment mechanism 400 to the mounting cup 308. Further, the annular ring may be attached to the pedestal of the mounting cup by threading or snapping onto the pedestal by using other methods described herein.

Figure 11:
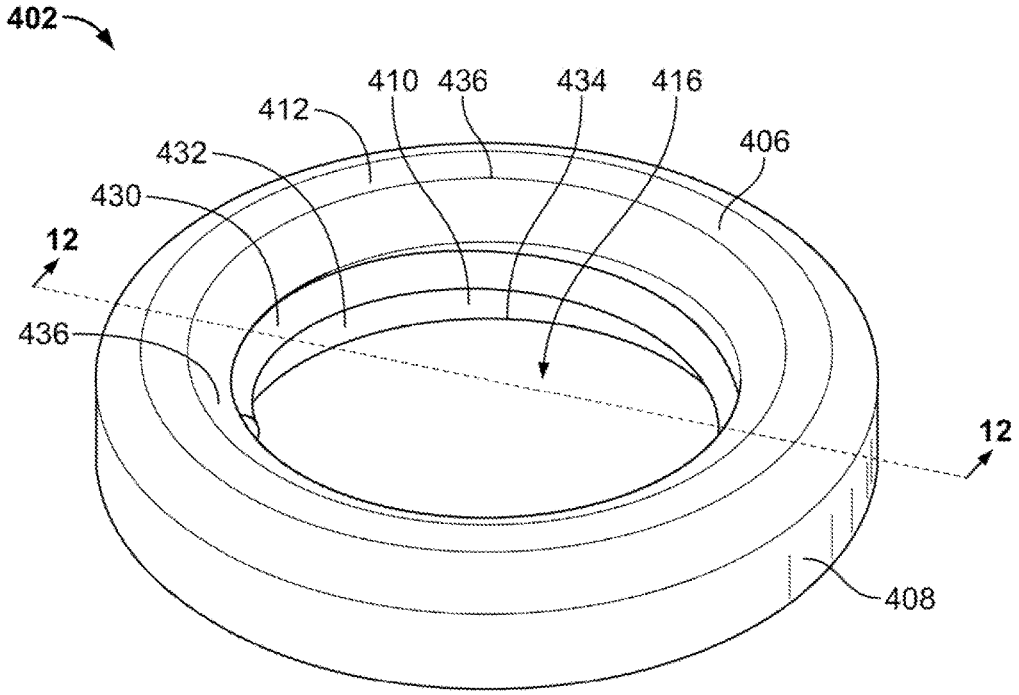
FIG. 11 is a top isometric view of the annular ring of FIG. 10.
Figure 12:
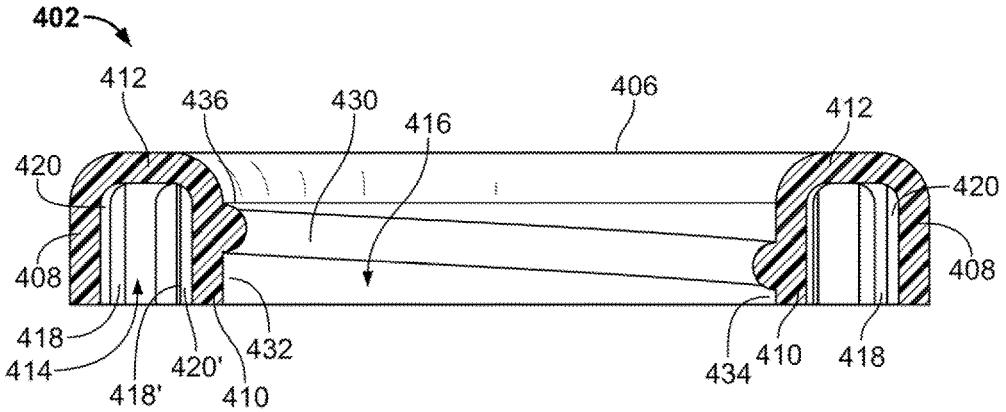
FIG. 12 is a cross-sectional view of the annular ring of FIG. 10 taken generally along the line 12-12 in FIG. 11.

As best seen in FIGS. 11-13, the annular ring 402 further includes a corkscrew-shaped protrusion in the form of a first thread 430 disposed on and extending from an external surface 432 of the inner wall 410. The first thread 430 circumscribes the external surface 432 starting at an area adjacent a lower edge 434 of the inner wall 410 and winds upwardly around the external surface 432 toward a top edge 436 of the inner wall 410. The first thread 432 is adapted to interact with the projection 404 as described in more detail hereinbelow.

Figure 15:
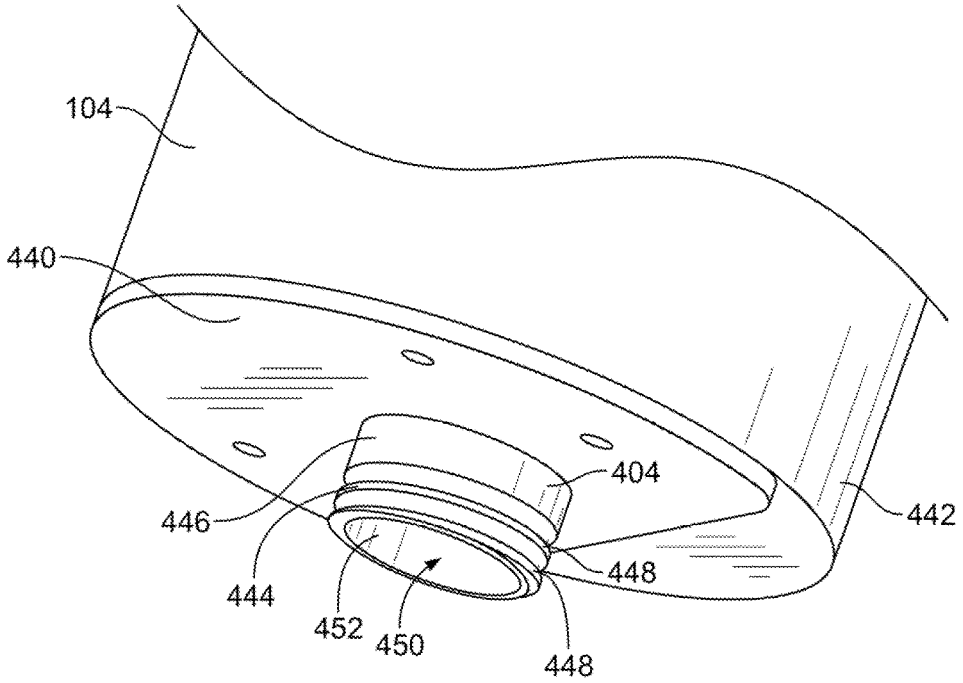
FIG. 15 is a partial bottom isometric view of the overcap of FIG. 1 including the threaded projection of FIG. 10 extending downwardly therefrom.

After the annular ring 402 has been connected to the mounting cup 308, the overcap 104 may be releasably attached to the annular ring 402. As best seen in FIG. 15, the overcap 104 preferably includes a base in the form of a substantially flat wall 440 extending from or otherwise attached to the overcap 104, which is disposed across a lower end 442 thereof. It is anticipated that numerous sizes and shapes of the wall 440 may be practiced with the embodiments herein, including walls that have curved or cutout portions insofar as they allow for the effective connection of the corresponding attachment mechanism. The wall 440 includes the projection 404 extending outwardly therefrom. The projection 404 includes a second thread 444 circumscribing a portion of an external surface 446 thereof. The second thread 444 includes a plurality of ramped portions 448 that are adapted to interact with the first thread 430 of the annular ring 402 to releasably lock the overcap 104 to the container 106. The projection 404 includes an orifice 450 extending through a central portion 452 thereof. The orifice 450 provides access to interior portions of the overcap 104 and allows for portions of the overcap 104 to access the valve assembly of the container to place the product dispensing system 100 in an operable condition.

Figure 10:
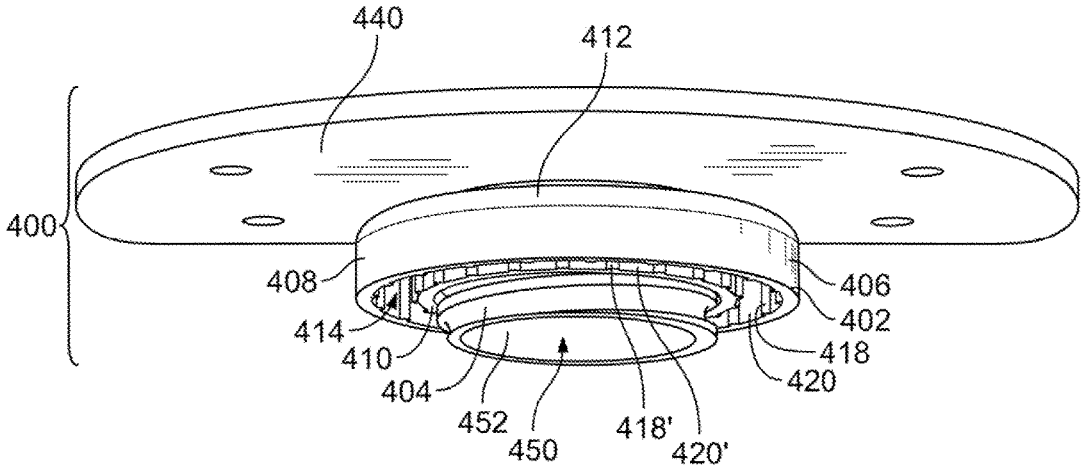
FIG. 10 is an isometric view of an attachment mechanism comprising an annular ring adapted to interact with a threaded projection.

To attach the overcap 104 to the container 106, the overcap 104 is lowered onto the container 106 such that the second thread 444 of the projection 404 is positioned adjacent the first thread 430 of the annular ring 402. The container 106 is held in place by a user's hand while the overcap 104 is turned in a clockwise manner. In a different embodiment, the container 106 is held in place by a user's hand while the overcap 104 is turned in a counter-clockwise manner. In other scenarios, the container 106 could be moved toward the overcap 104 and/or the container 106 rotated. As the overcap 104 is turned, the second thread 444 and the first thread 430 are mated with one another to lock the overcap 104 and the container 106 together. In the present embodiment, the upper wall 412 of the annular ring 402 abuts the wall 440 of the overcap 104, such as shown in FIG. 10. In other embodiments, it is contemplated that there may be a spacing or gap between the annular ring 402 and the overcap 104. After the overcap 104 is attached to the container 106, the container 106 is lowered into the housing 102 and the overcap 104 and the housing 102 are releasably attached as described previously hereinabove. In this position, the product dispensing system 100 is ready for operation.

Now turning to FIGS. 16-21, a second embodiment of an attachment mechanism 500 is shown. The attachment mechanism 500 includes a bracket or adapter. In the present embodiment the adapter comprises an annular ring 502 similar to the annular ring 402 described in connection with the embodiment shown in FIGS. 10-15, except for the differences noted hereinbelow. Instead of the first thread 430 disposed on the exterior surface 432 of the annular ring 402, the annular ring 502 includes a plurality of elongate discrete projections 504 that extend outwardly from an external surface 506 into a central opening 508.

Figure 16:
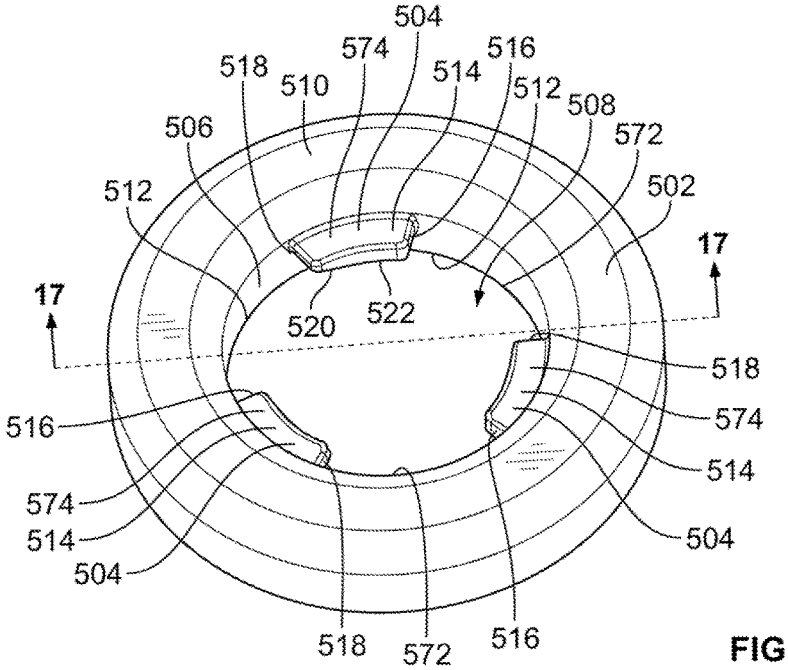
FIG. 16 is a top isometric view of a second embodiment of an annular ring adapted for use in an attachment mechanism.
Figure 17:
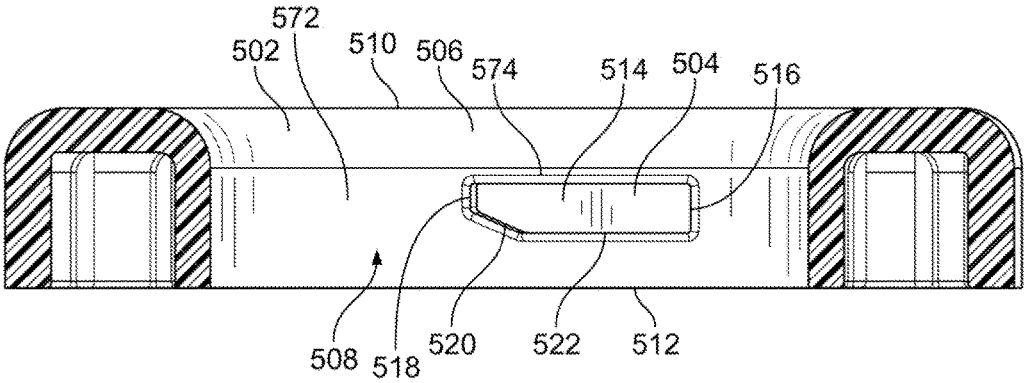
FIG. 17 is a cross-sectional view of the annular ring of FIG. 16 taken generally along the line 17-17 shown in FIG. 16.

As best seen in FIGS. 16 and 17, the projections 504 are disposed approximately halfway between a top edge 510 and a bottom edge 512 of the annular ring 502. Each projection 504 includes a rectilinear member 514 that has a flat first end 516. A second end 518 of the projection 504 includes a sloped surface 520 that truncates a portion of a bottom edge 522. Although the projections 504 are described as elongate members, the projections 504 may be of any size, shape, or number so long as the projections 504 extend interiorly from the external surface 506 and into the opening 508.

Figure 18:
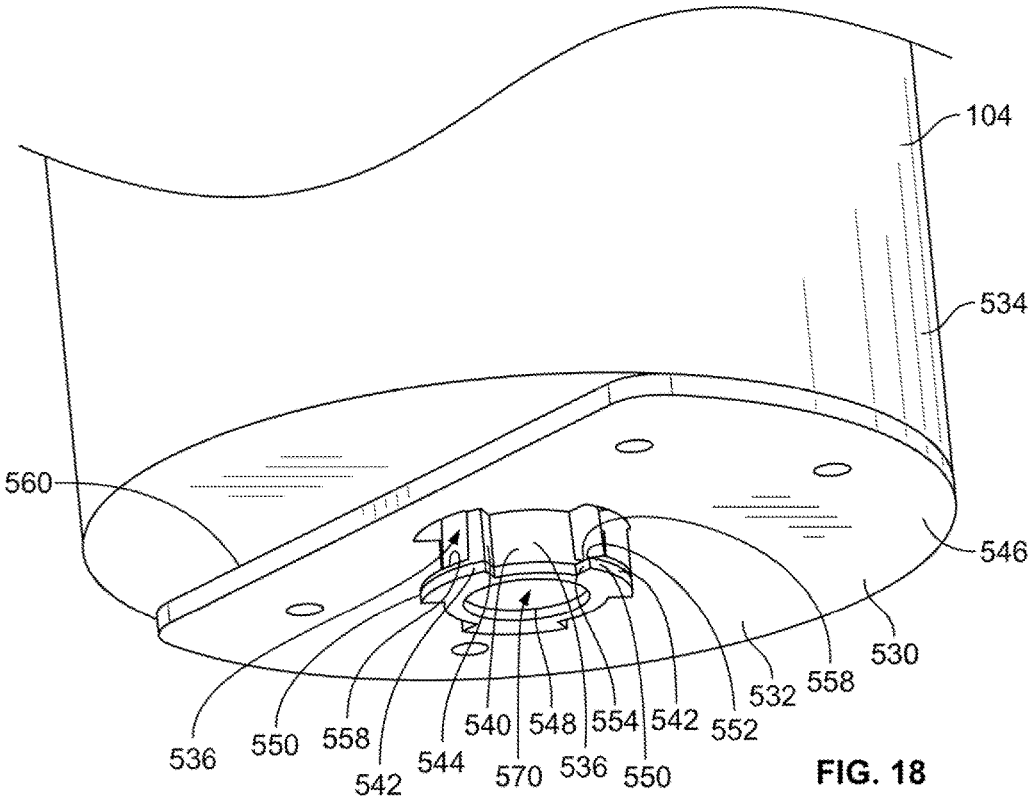
FIG. 18 is a partial bottom isometric view of the overcap of FIG. 1 including a base and locking member extending from a lower portion of the overcap.

Now turning to FIG. 18, a base 530 is shown that is similar to the base described in connection with FIGS. 10-15. The base 530 includes a substantially flat wall 532 disposed across a portion of a lower end 534 of the overcap 104. The wall 532 includes a locking member 536 extending downwardly therefrom. The locking member 536 is provided with an external surface 540, in which a plurality of L-shaped members 542 extend radially outward therefrom. In the present embodiment, there are three L-shaped members 542. However, in other embodiments there could be one or more of the L-shaped members 542.

Figure 19:
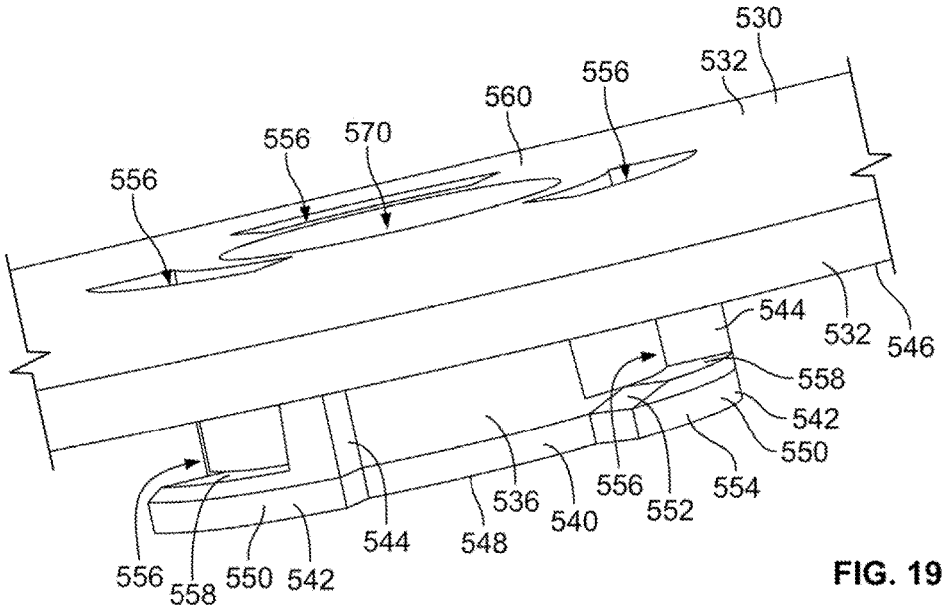
FIG. 19 is a partial isometric view of the base and locking member of FIG. 18.
Figure 20:
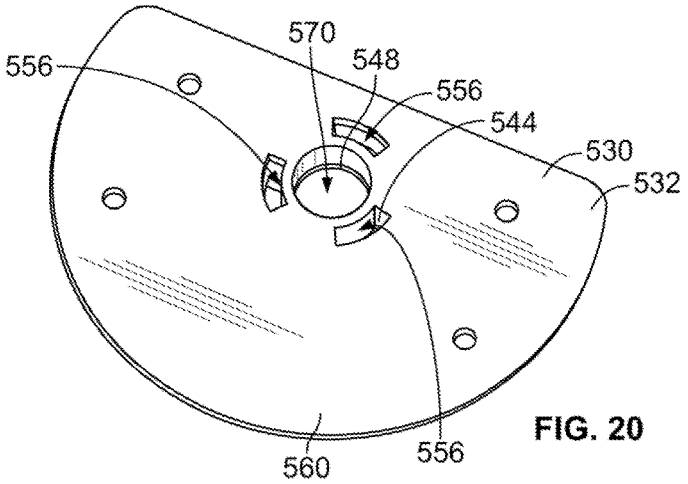
FIG. 20 is a top isometric view of the base of FIG. 18.
Figure 21:
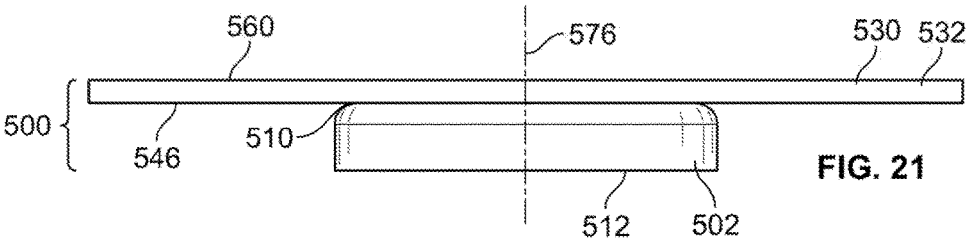
FIG. 21 is a side elevational view of the annular ring of FIG. 16 engaged with the locking member of FIG. 18.

As best seen in FIG. 19, the L-shaped members 542 have a vertical end wall 544 that extends downwardly from a lower surface 546 of the base 530 toward a lower edge 548 of the locking member 536. A horizontal wall 550 is substantially perpendicular to, and extends circumferentially outwardly from, the vertical end wall 544 adjacent the lower edge 548. The horizontal wall 550 further includes a sloped portion 552 disposed at an end 554 opposite the vertical end wall 544. FIGS. 19 and 20 depict a slot 556 formed above a top surface 558 of each horizontal wall 550 within the base 530. The slot 556 extends through an upper surface 560 of the base 530. The locking member 536 defines an orifice 570 in a central portion thereof, which is adapted to allow portions of the overcap 104 to access the valve assembly of the container to place the product dispensing system 100 in an operable condition.

To attach the overcap 104 to the container 106, the L-shaped members 542 are positioned between the projections 504 extending from the annular ring 502. The locking member 536 is prevented from being misaligned with the annular ring 502 by one or more of the lower edge 548 impacting portions of the ring 502 or from portions of the L-shaped members abutting a top surface 574 of the projections 504. Upon proper alignment, the overcap 104 and container 106 are turned in opposite directions (or one is turned while the other is held steady) such that the sloped surface 520 of each of the projections 504 contact the sloped portions 552 of the L-shaped members 542. The overriding sloped surfaces 520 and portions 552 cause the projections 504 and the horizontal walls 550 of the L-shaped members 542 to effectively engage one another. Continued rotational movement of one or more of the overcap 104 and the container 106 causes the upper wall 412 of the annular ring 502 to be lifted and pressed against the lower surface 546 of the base 530 (see FIG. 21). The L-shaped members 542 and projections 504 are appropriately sized to allow for a tight-fit engagement therebetween, wherein the engagement of the upper wall 412 of the annular ring 502 and the lower surface 546 of the base 530 provides for force components in opposing directions about a longitudinal axis 576 (see FIG. 21). Such an engagement assists in preventing instability within the combination of the overcap 104 and the container 106 that could adversely effect any spraying operation. Turning to FIGS. 17-19, when the projections 504 are fully engaged with the L-shaped members 542, the bottom edge 522 and the second end 518 of the projections 504 will be disposed adjacent the top surface 558 and the vertical end wall 544 of the L-shaped member 542, respectively. After the overcap 104 is attached to the container 106, the container 106 is lowered into the housing 102 and the overcap 104 and housing 102 are releasably attached to one another.

Figure 22:
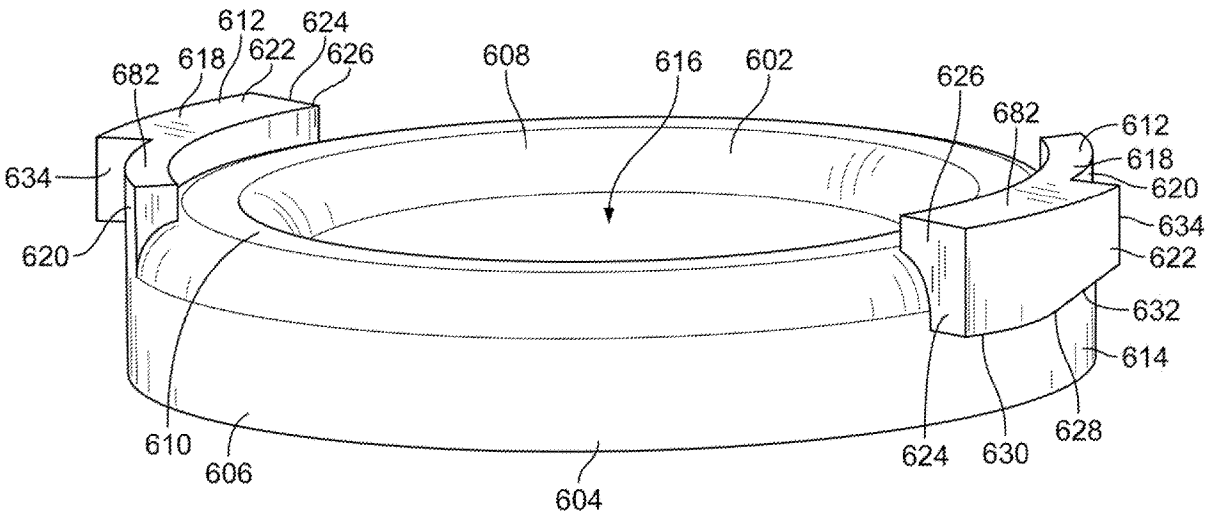
FIG. 22 is an isometric view of a third embodiment of an annular ring adapted for use in an attachment mechanism.
Figure 23:
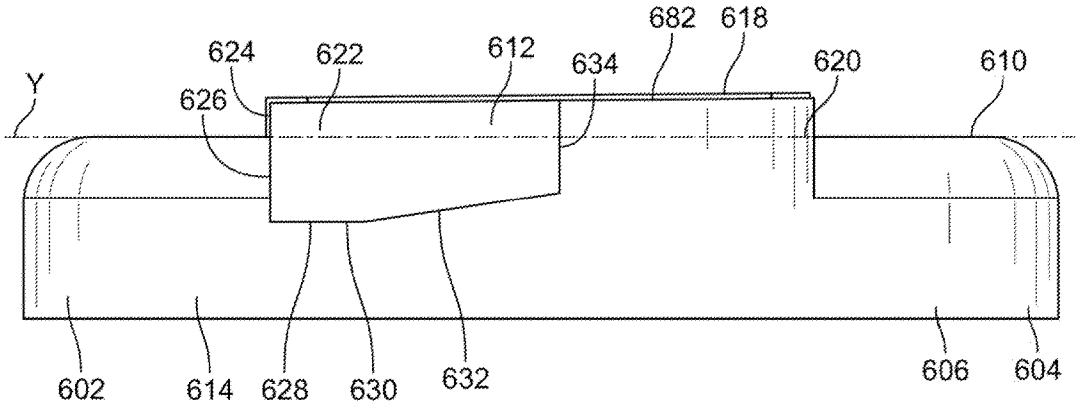
FIG. 23 is a side elevational view of the annular ring of FIG. 22.

Now turning to FIGS. 22-28, a third embodiment of an attachment mechanism 600 is shown that includes a bracket or adapter. The bracket of the present embodiment is an annular ring 602 similar to the annular ring 402. The annular ring 602 includes a substantially U-shaped body 604, which includes an outer wall 606 and an inner wall 608 that are connected by a curved transverse upper wall 610. A plurality of elongate ledges 612 extends outwardly from an external surface 614 of the outer wall 606 and the upper wall 610. The elongate ledges 612 also extend upwardly beyond an axis Y, shown in FIG. 23, which is coincident with the upper wall 610. The present embodiment includes two oppositely disposed elongate ledges 612. However, in other embodiments one or more ledges may be provided. For example, in one particular embodiment it is contemplated that three equidistantly spaced ledges may be provided. As best seen in FIG. 22, the elongate ledges 612 include a wall 618 that partially circumscribes the annular ring 602 and has a substantially similar radius of curvature as that of the outer wall 606. The wall 618 has a rectilinear first end 620 and a shelf 622 extending outwardly from the elongate ledge 612 adjacent a second end 624 thereof. As best seen in FIG. 23, the shelf 622 includes a vertical end wall 626 disposed adjacent the second end 624 and a bottom surface 628 that includes a flat portion 630 that extends into an upwardly sloped portion 632. The sloped portion 632 terminates at a vertical end wall 634.

Figure 24:
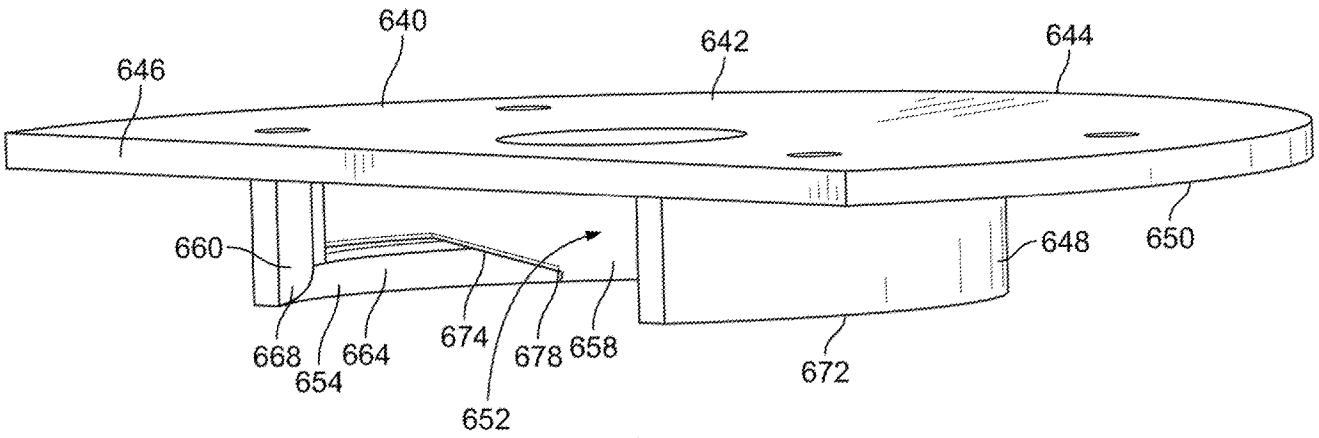
FIG. 24 is a left side isometric view of a third embodiment of a base adapted to interact with the annular ring of FIG. 22.
Figure 25:
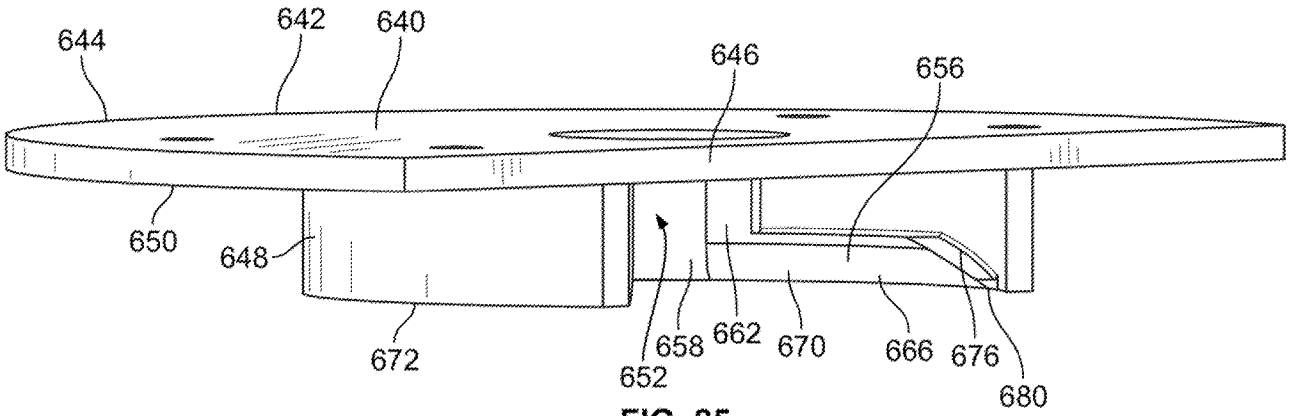
FIG. 25 is a right side isometric view of the base of FIG. 24.

Now turning to FIGS. 24 and 25, a base 640 is shown that includes a substantially flat wall 642 attached to the overcap (not shown) and disposed across a portion of a lower end thereof. The wall 642 includes a semi-circular edge 644 and a flat edge 646 that truncates the semi-circular edge 644. A semi-circular skirt 648 extends downwardly from a bottom surface 650 of the wall 642. The skirt 648 includes an opening 652 disposed adjacent the flat edge 646 of the wall 642, which is sized to receive portions of the annular ring 602 as will be described in more detail hereinbelow.

Figure 26:
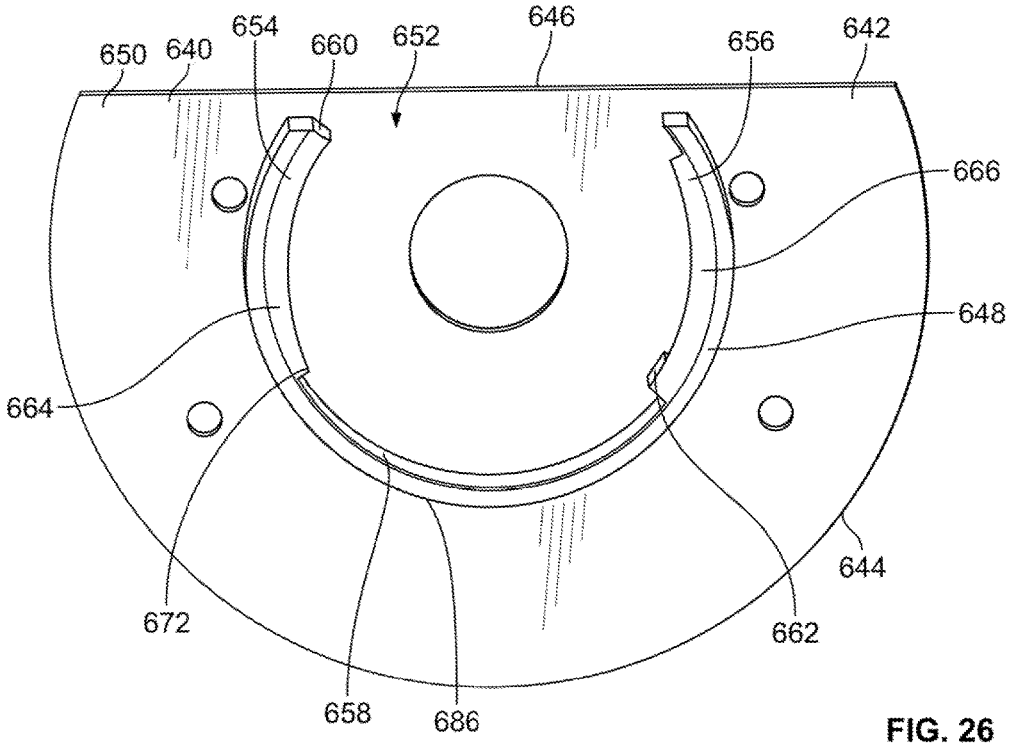
FIG. 26 is a bottom elevational view of the base of FIG. 24.

As best seen in FIGS. 24-26, the skirt 648 includes first and second substantially L-shaped support walls 654, 656, respectively, that extend outwardly from an interior surface 658 of the skirt 648. The support walls 654, 656 include vertical end walls 660, 662, respectively. Substantially horizontal walls 664, 666 extend laterally from lower edges 668, 670 of the vertical end walls 660, 662, respectively. The horizontal walls 664, 666 are disposed adjacent a bottom edge 672 of the skirt 648. Still referring to FIGS. 24 and 25, each horizontal wall 664, 666 includes a sloped portion 674, 676 disposed adjacent second ends 678, 680 thereof that are distal of the vertical end walls 660, 662. The sloped portions 674, 676 terminate at the second ends 678, 680 and are adapted to interact with the elongate ledges 612 of the annular ring 602 as described in more detail hereinbelow.

Figure 27:
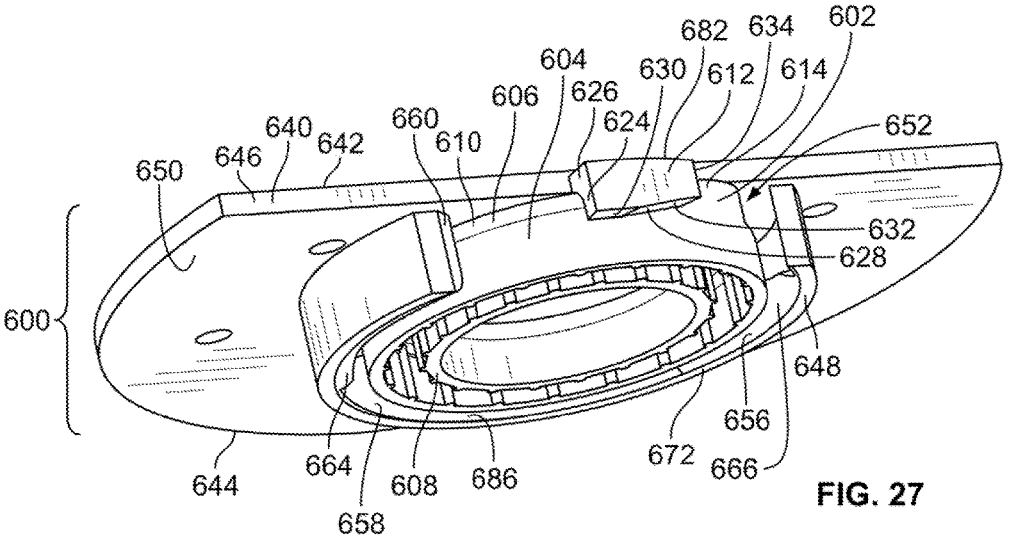
FIG. 27 is a bottom isometric view of the base of FIG. 24 with the annular ring of FIG. 22 disposed therein in a first, unlocked position.
Figure 28:
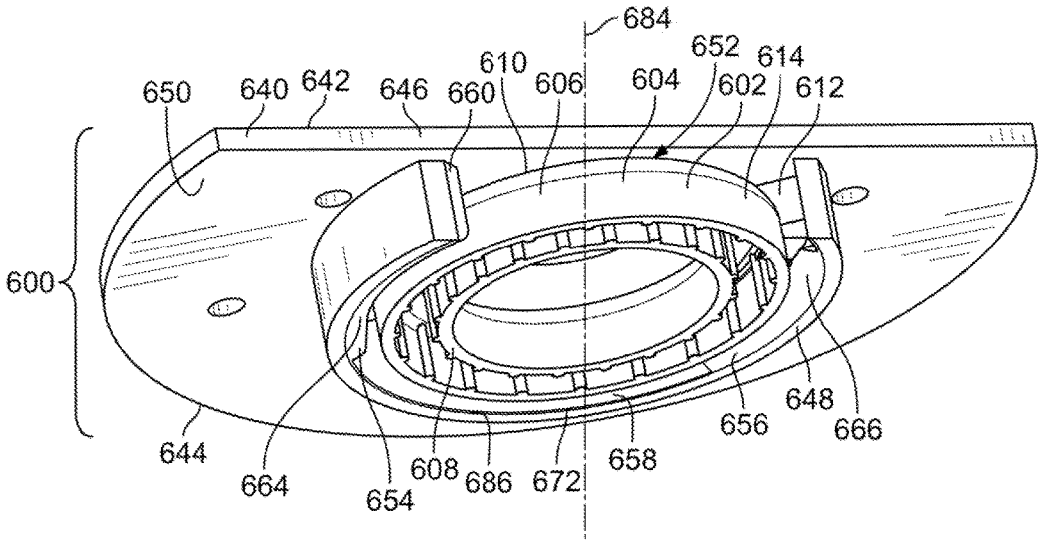
FIG. 28 is a bottom isometric view of the base of FIG. 24 with the annular ring of FIG. 22 fully engaged therewith in a second, locked position.

To attach the overcap 104 to the container 106, the annular ring 602 is positioned within the base 640 so that one of the elongate ledges 612 is disposed adjacent the opening 652 of the skirt 648 and the other ledge (not visible) is disposed adjacent a back wall 686 of the skirt 648 (see FIG. 27). The opening 652 is appropriately sized to receive the annular ring 602 so that a side thereof with one of the elongate ledges 612 must be inserted first. Otherwise, portions of the base 630 will prevent the annular ring 602 from being received therein. This provides a guiding function to the user and assists in preventing misalignment of the system. Thereafter, one or more of the overcap 104 and the container 106 are turned such that the sloped portions 632 of the elongate ledges 612 contact the sloped portions 674, 676 of the horizontal walls 664, 666, respectively. The overriding sloped portions 632, 674, 676 cause the elongate ledges 612 and the horizontal walls 664, 666 of the support walls 654, 656 to effectively engage one another. Continued rotational movement of one or more of the overcap 104 and the container 106 causes upper portions 682 of the elongate ledges 612 of the annular ring 602 to be lifted and pressed against the bottom surface 650 of the wall 642 defining the base 640 (see FIG. 28). The spacing between the horizontal walls 664, 666 and the bottom surface 650, and the dimensions of the elongate ledges 612, are appropriately sized to allow for a tight-fit engagement therebetween. The engagement of the upper portions 682 of the elongate ledges 612 and the bottom surface 650 of the base 530 provides for force components in opposing directions about a longitudinal axis 684, as shown in FIG. 28. Such an engagement assists in preventing instability within the combination of the overcap 104 and the container 106 that could adversely effect any spraying operation. Once the ledges 612 are fully engaged with the support walls 654, 656, the vertical end walls 634 of the ledges 612 abut the vertical end walls 660, 662 of the first and second support walls 654, 656. After the overcap 104 is attached to the container 106, the container 106 is lowered into the housing 102 and the overcap 104 and housing 102 are releasably attached to one another.

Figure 29:
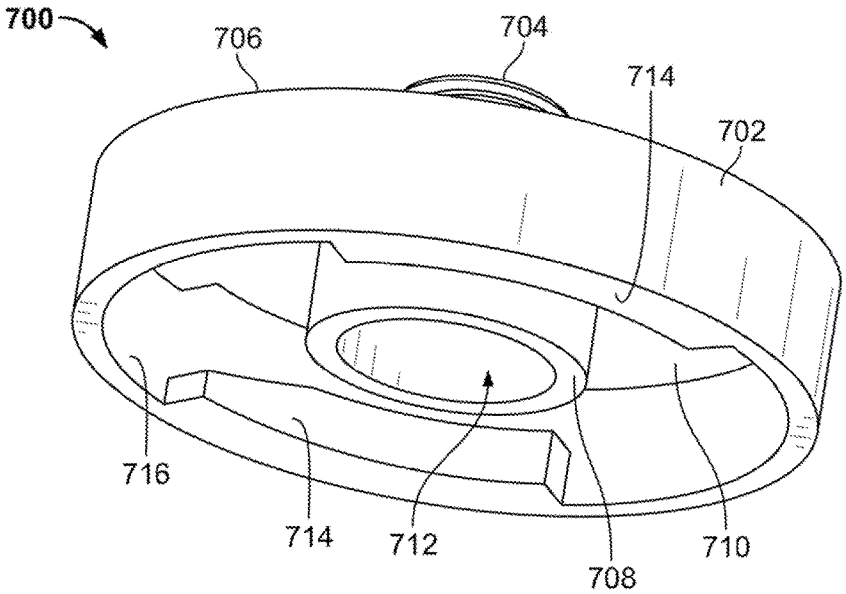
FIG. 29 is bottom isometric view of a refill adapter.
Figure 30:
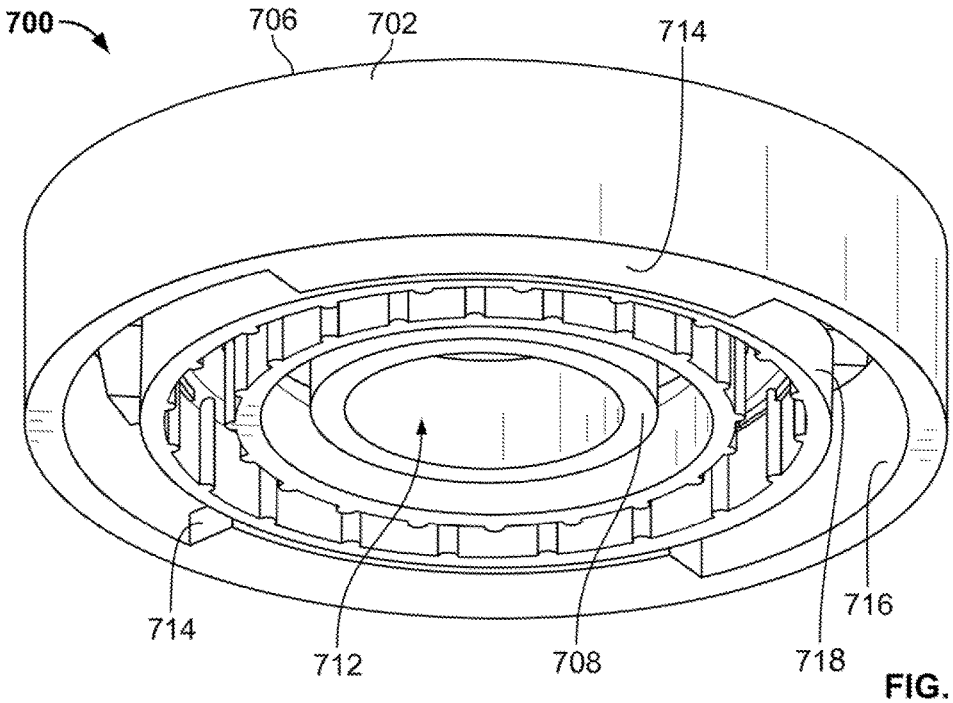
FIG. 30 is a bottom isometric view of the refill adapter of FIG. 29 with the annular ring of FIG. 22 disposed therein.

Although numerous bases are shown with particularity herein, it is intended that modifications and/or additions may be made to any of the embodiments. For example, any of the embodiments may utilize an extension member between the base (or lock) of an overcap and the annular ring (or key) of a container. For example, FIGS. 29 and 30 depict a refill adapter that may be used with a variety of known containers and overcaps. The presently depicted embodiment includes an extension member 700 that is specifically adapted for use with the annular ring 602 (see FIGS. 22-28).

The extension member 700 includes a circular body 702 with a threaded portion 704 extending from an outer surface 706 therefrom. A cylindrical wall 708 extends downwardly from an internal upper surface 710 and includes an orifice 712 therein, which is adapted to receive a portion of a valve assembly and container (not shown). A plurality of ramps 714 circumscribe an interior surface 716 of the body 702 and are disposed on opposing sides of the surface 716. The ramps 714 have the same function as the support walls 654, 656, shown in FIGS. 24 and 25.

The extension member 700 may be provided to secure an overcap to a container having the annular ring 602 already attached thereto. For example, a user may have a product dispensing system that includes a container and an overcap that do not utilize the appropriate attachment mechanism. In this instance, the user may attach the extension member to the existing overcap, which interacts with the annular ring 602 of the refill in a manner as previously described to provide a fluid tight seal. The extension member 700 may extend from any portion of the overcap (not shown) and may be connected thereto in any manner known to one of ordinary skill. The present embodiment contemplates a mating threaded portion for effective connection to the threaded portion 704 of the extension member 700.

It is also contemplated that any of the bases described herein in connection with a specific embodiment may be utilized with any other embodiment. The bases may comprise any type of structure adapted to support at least one portion of the attachment mechanism. For example, in one embodiment the base extends across the entirety of a lower end of the overcap. In a different embodiment, the base extends across only a portion of the lower end of the overcap. In this embodiment, it is contemplated that an opening through the base will provide access to interior portions of the base. For example, a battery chamber may be accessible through the opening. In a different embodiment, a base is not utilized at all, but rather the overcap includes other structure that is adapted to support a portion of the attachment mechanism. The bases contemplated herein also may be provided in a variety of shapes, sizes, and thicknesses that impart desired functional or aesthetic characteristics.

Now turning to FIGS. 31-34, a fourth embodiment of an attachment mechanism 800 is shown that includes a bracket or adapter. The present bracket is shown to be an annular ring 802 similar to those previously described. The annular ring 802 comprises a substantially U-shaped body 804, which includes an outer wall 806 and an inner wall 808 that are connected via a curved transverse upper wall 810. Two walls 812, 814 extend upwardly from an external surface 816 of the body 804. The walls 812, 814 are imparted with an identical or substantially similar radius of curvature as the outer wall 806. Vertical riser portions 818, 820 extend upwardly from the walls 812, 814, respectively. Further, flanges 822, 824 extend radially outward from top edges 826, 828 of the riser portions 818, 820, respectively.

Figure 31:
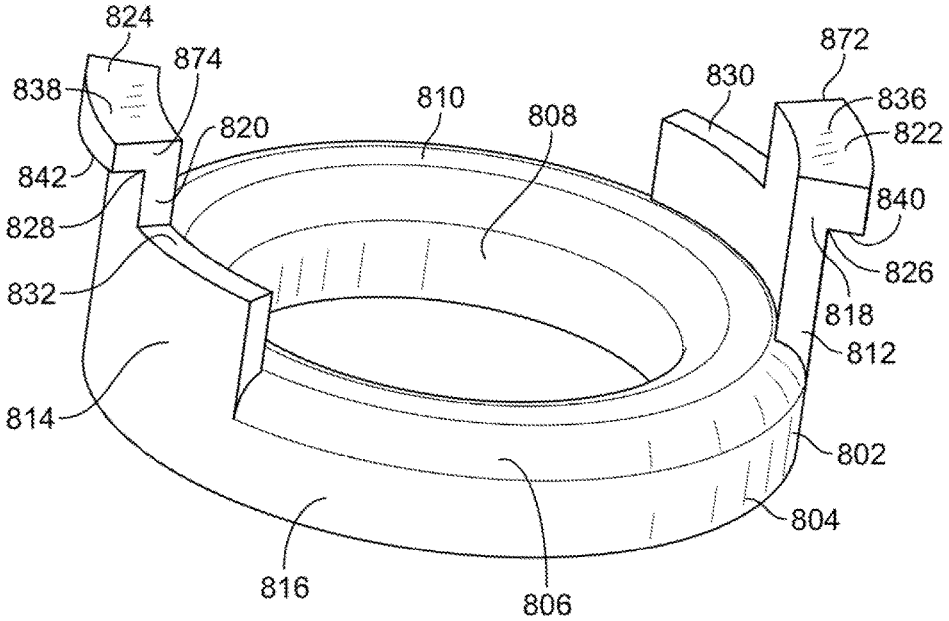
FIG. 31 is an isometric view of a fourth embodiment of an annular ring adapted for use in an attachment mechanism.
Figure 32:
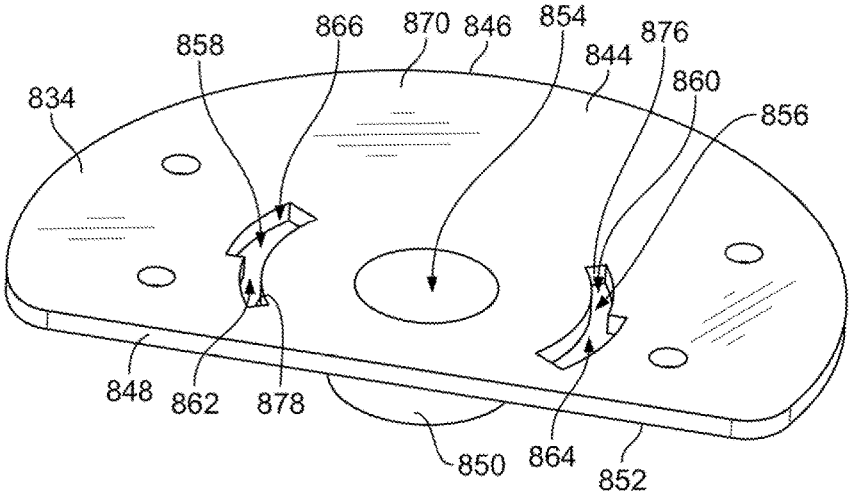
FIG. 32 is a top isometric view of a fourth embodiment of a base adapted to interact with the annular ring of FIG. 31.

As best seen in FIG. 31, the walls 812, 814 include upper surfaces 830, 832, respectively, that are adapted to interact with a base portion 834 (see FIG. 32). Turning again to FIG. 31, the flanges 822, 824 include upper surfaces 836, 838 and lower surfaces 840, 842 on opposing sides thereof. The upper surfaces 836, 838 and lower surfaces 840, 842 form rails that are adapted to extend through and slide along a section of the base portion 834.

Figure 33:
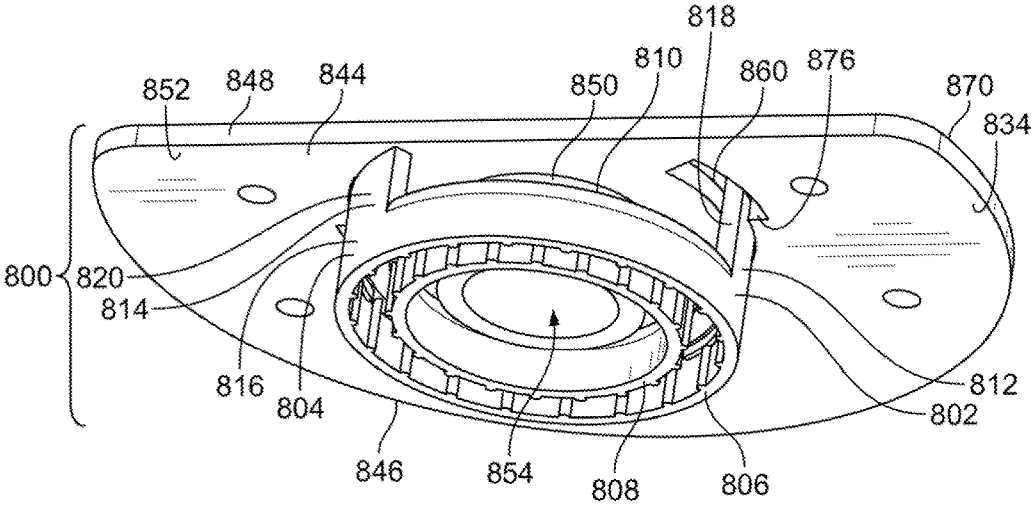
FIG. 33 is a bottom isometric view of the annular ring of FIG. 31 disposed within the base of FIG. 32.
Figure 34:
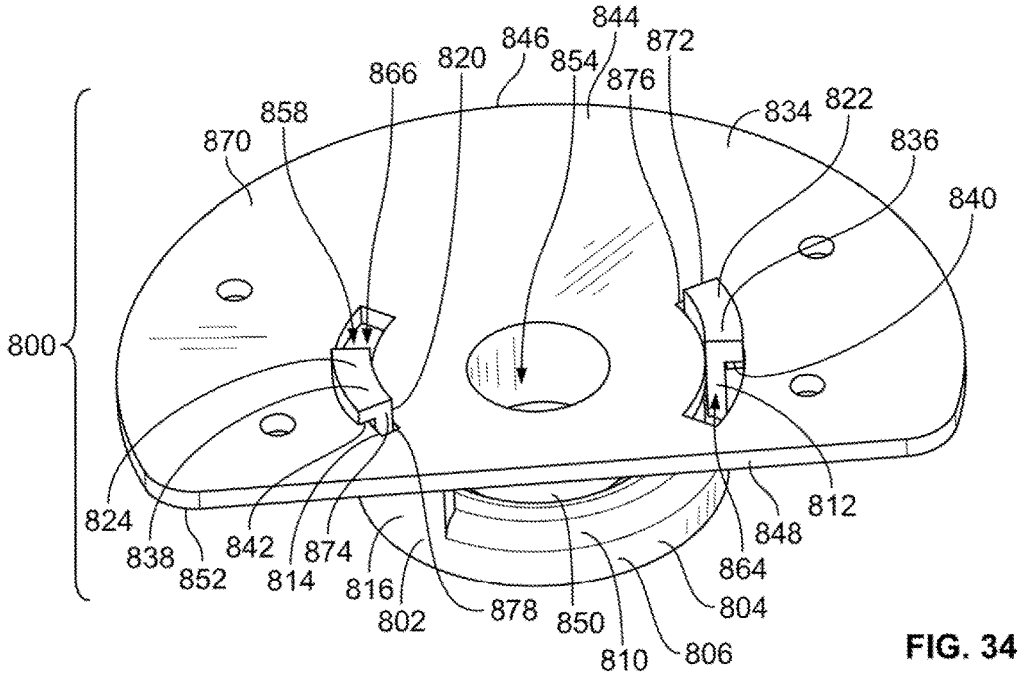
FIG. 34 is a top isometric view of the annular ring of FIG. 31 disposed within the base of FIG. 32.

As best seen in FIGS. 32-34, the base portion 834 includes a substantially flat wall 844 attached to the overcap (not shown). The wall 844 includes a semi-circular edge 846 and a flat edge 848 that truncates the semi-circular edge 846. An annular locking member or ring 850 extends downwardly from a bottom surface 852 of the wall 844. The locking member 850 includes a central opening 854. As shown in FIG. 32, first and second curved apertures 856, 858 are disposed on opposing sides of the central opening 854. The curved apertures 856, 858 are segmented into a narrow tail portion 860, 862 and a wide head portion 864, 866. In a preferred embodiment, the curved apertures have a radius of curvature between about 4 mm to about 40 mm. Further, a width of the curved apertures 856, 858, which is defined as the radial distance between opposing surfaces of the tail portions 860, 862 and the head portions 864, 866, is between about 1 mm to about 10 mm. The length of the curved apertures comprises at least two differing sized sections due to the segmented nature of the apertures 856, 858. In a preferred embodiment, the tail portions 860, 862 have a length of between about 1 mm to about 10 mm and the head portions 864, 866 have a length of between about 1 mm to about 10 mm. The dimensions of the apertures 856, 858 preferably provides a large enough opening to allow the flanges 822, 824 to extend therethrough, while at the same time providing a small enough aperture that will adequately support the annular ring 802 and container attached thereto. The segmented nature of the apertures further provides a simple, yet stable mechanism for securing the container to the overcap while creating a substantially fluid tight connection therebetween.

To attach the overcap to the container, the riser walls 818, 820 and corresponding flanges 822, 824 of the annular ring 802 are inserted through the wide head portions 864, 866 of the curved apertures 856, 858, respectively. Thereafter, one or more of the overcap and the container are rotated such that the lower surfaces 840, 842 of the flanges 822, 824 slide along a top surface 870 of the wall 844 until distal ends 872, 874 of the flanges 822, 824 (see FIG. 34) abut end walls 876, 878 of the narrowed tail portions 860, 862, respectively. In this position, the lower surfaces 840, 842 of the flanges 822, 824 impinge against the top surface 870 of the wall 844 and the upper surfaces 830, 832 of the walls 812, 814 impinge against the bottom surface 852 of the wall 844 to provide a stable platform for the emission of fluid from the device. The sizing of the flanges 822, 824 and/or the thickness of the wall 844 is appropriately dimensioned to provide a tight-fit engagement therebetween. After the overcap is attached to the container, the container is lowered into the housing and the overcap and housing releasably attached as described previously hereinabove.

Now turning to FIGS. 35-45, a fifth embodiment of an attachment mechanism 900 is shown that includes a bracket or adapter. Presently, the adapter comprises an annular ring 902 similar to those previously described. The annular ring 902 includes a U-shaped member 904 and a pedestal 906 provided interiorly of the U-shaped member 904. The pedestal 906 is shaped to fittingly receive a pedestal of a container, such as the pedestal 316 of the container 106 or 106' (see FIGS. 8 and 8A), within a generally circular opening 908. Further, a valve stem such as the valve stem 320 depicted in FIG. 8, or the opening 326 for access to the valve assembly 460 depicted in FIG. 15A, are accessible through the opening 908 and may fully or partially extend therethrough.

Figure 35:
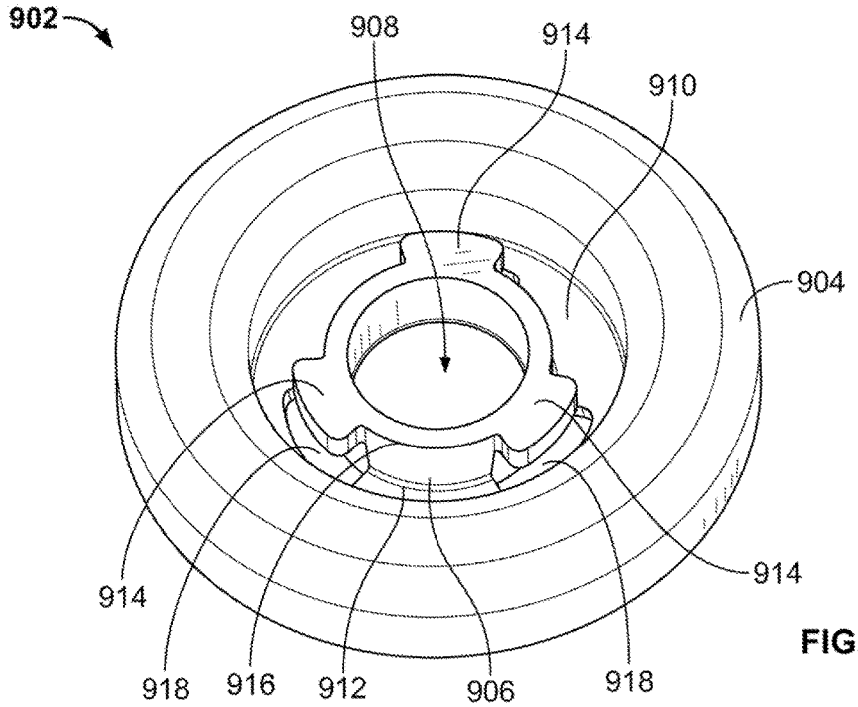
FIG. 35 is a top isometric view of a fifth embodiment of an annular ring adapted for use in an attachment mechanism.
Figure 36:
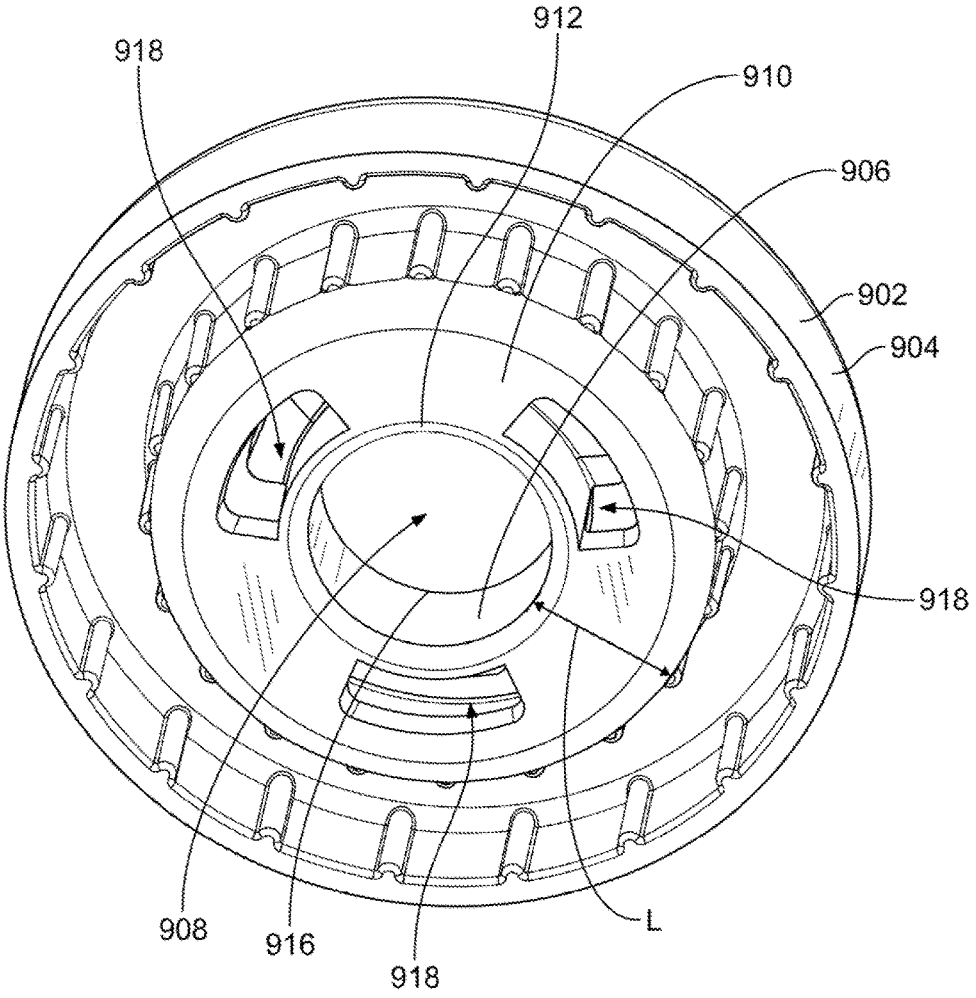
FIG. 36 is a bottom isometric view of the annular ring of FIG. 35.

As best seen in FIGS. 35 and 36, the U-shaped member 904 is connected to the pedestal 906 by a medial wall portion 910. The pedestal 906 extends upwardly from a central portion 912 of the medial wall portion 910 and further includes at least one exteriorly extending flange 914 adjacent a distal end 916 thereof, which extends radially outwardly toward the annular U-shaped member 904. In the present embodiment, three flanges 914 are provided. The three flanges 914 are equidistantly spaced and circumscribe the opening 908. The flanges 914 extend outwardly approximately half the length of the medial wall portion 910 toward the annular U-shaped member 904. In a preferred embodiment, the flanges 914 have a length of between about 0.5 mm to about 10 mm and the medial wall portion 910 has a length of between about 0.5 mm to about 10 mm, as depicted by distance "L" shown in FIG. 36. A plurality of openings 918, which are provided to assist in the manufacture of the annular ring 902, extend through the medial wall portion 910 and are disposed directly below the three exteriorly extending flanges 914.

It is contemplated that fewer or more flanges could be provided that radially extend from the pedestal that may or may not be equidistantly spaced from one another. For example, in a different embodiment shown in FIG. 37, the annular ring 920 is identical to the annular ring 902 shown in FIG. 35, except for the inclusion of only two exteriorly extending flanges 922, which are adapted to perform the same function as the extending flanges 914. In yet a different embodiment shown in FIG. 38, an attachment mechanism is shown that comprises only a cylindrical pedestal 940. The pedestal 940 includes a plurality of outwardly extending flanges 942 disposed around a top edge 944 thereof. The outwardly extending flanges 942 circumscribe a central orifice 946, which is adapted to receive a portion of a pedestal and corresponding valve assembly of a container (not shown). For example, the pedestal 940 could surround a portion of the pedestal 316 shown in FIG. 8. In the embodiments shown in FIGS. 35-38, the annular ring and/or pedestal may include any number of flanges extending outwardly therefrom. The flanges may be shaped and sized in any manner known in the art.

Now turning to FIGS. 39-45, a base 1000 is shown that is similar to the bases described with respect to the previous embodiments except for the differences noted herein. The base 1000 includes a substantially flat wall 1002 attached to the overcap (not shown). The wall 1000 includes a cylindrical locking member 1004 that extends downwardly from a lower surface 1006 thereof. The locking member 1004 defines a circular opening 1008, which is adapted to receive portions of the valve stem/valve assembly (not shown) when the attachment mechanism is in use. The locking member 1004 includes a plurality of L-shaped tracks 1010 circumscribing and extending inwardly from an interior surface 1012 defining the circular opening 1008.

Figure 39:
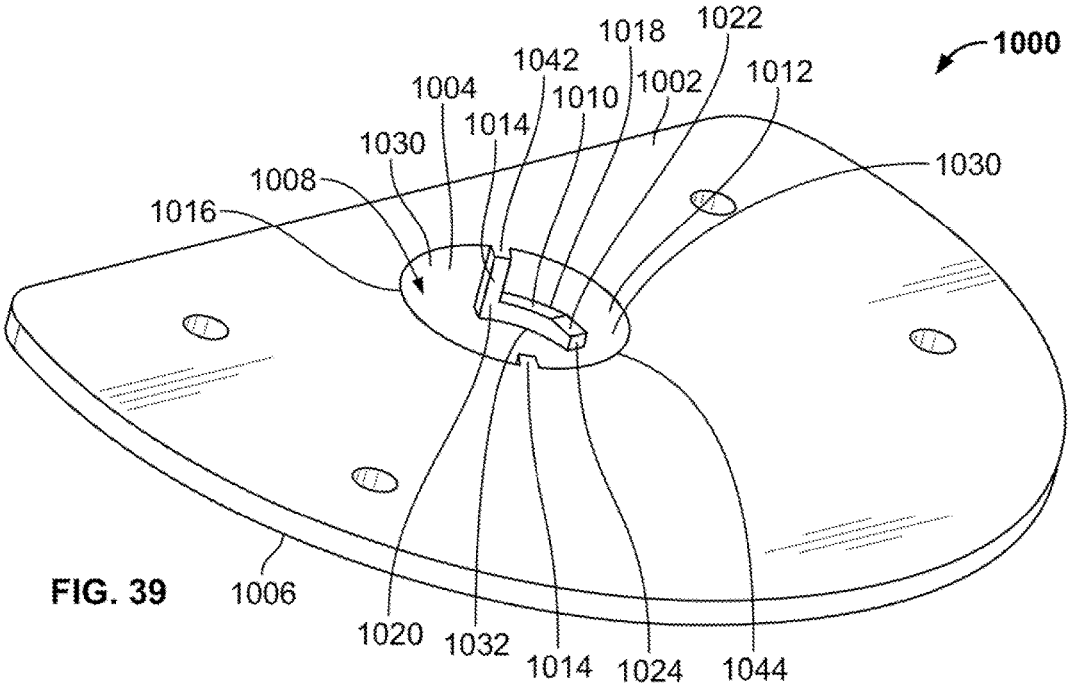
FIG. 39 is an isometric view of a fifth embodiment of a base adapted to interact with one of the annular rings of FIG. 35, 37, or 38.

As best seen in FIG. 39, the tracks 1010 include a vertical wall 1014 that extends downwardly from a top surface 1016 of the base 1000 about half the total length of the circular member 1004. A wall 1018 extends outwardly from a distal end 1020 of each vertical wall 1014 and circumscribes a portion of the interior surface 1012 of the circular opening. Each wall 1018 includes a downwardly sloped portion 1022 at ends 1024 opposite the vertical walls 1014. The tracks 1010 are adapted to interact with the projections 914, 922, or 942 previously described such that the annular rings 902, 920 or cylindrical pedestal 940, respectively, can be slidingly received thereon. It is preferred that the number of tracks 1010 provided on the base 1000 be equivalent to the number of projections on the annular ring/pedestal, e.g., in the present embodiment, it is contemplated that three equidistantly spaced tracks 1010 would be provided in conjunction with the use of the ring 902, which includes three flanges 914.

The attachment of the overcap to the container occurs in substantially the same way with respect to the annular rings 902, 920 or the cylindrical pedestal 940. For purposes of illustrating the attachment process, the structure of the annular ring 920 will be discussed with particularity. To attach the overcap to the container, the exteriorly extending flanges 922 are positioned within the circular opening 1008 of the locking member 1004. The flanges 922 must be positioned in spaces 1030 between the L-shaped tracks 1010. If the flanges 922 are misaligned during positioning, the flanges 922 will abut bottom surfaces 1032 of the tracks 1010 (see FIG. 39) when the base 1000 and the annular ring 920 are moved toward one another. Once the flanges 922 are appropriately positioned, the overcap and container are turned in opposite directions (or one is turned while the other is held steady). In the present embodiment, the overcap is turned in a clockwise manner and/or the container in a counter-clockwise manner.

The attachment mechanism 900 once again prevents misalignment and assists in the appropriate guiding of the locking and keying structure by causing the flanges 922 to abut against the vertical walls 1014 if inappropriately rotated. If rotated appropriately, the flanges 922 impinge against the sloped portions 1022 of the L-shaped tracks 1010 (see FIG. 41). In some embodiments, the flanges 922 may be provided with tapered or ramped ends for contact with the corresponding sloped portions 1022 of the L-shaped tracks 1010. Continued rotational movement of one or more of the cap and the container causes lower surfaces 1034 of the flanges 922 to override and maintain contact with the walls 1018 of the L-shaped tracks 1010. Concurrently, a curved upper surface 1036 of the annular ring 920 contacts and is pressed against the lower surface 1006 of the base 1000. The L-shaped tracks 1010 and flanges 922, in conjunction with the positioning of the base 1000, are appropriately sized to allow for a tight-fit engagement therebetween. The dimensions of the flanges 914 as compared to the dimensions of the medial wall portion 910 are preferably selected to extend outwardly an appropriate distance from the pedestal 906 to create enough surface area to contact the L-shaped tracks 1010 and provide adequate support for the attachment mechanism 900. Indeed, the various force components being exerted substantially about a longitudinal axis 1038 assist in preventing instability within the attachment mechanism 900. After the overcap is attached to a container, the container may be positioned within a housing for use by a consumer.

Figure 38:
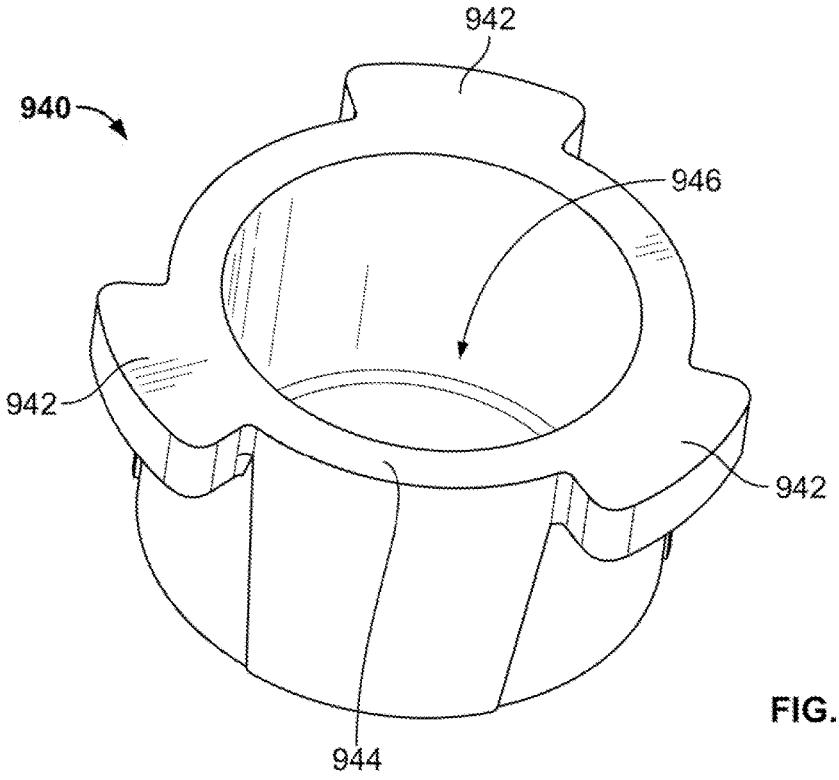
FIG. 38 is a top isometric view of yet a different embodiment of the annular ring of FIG. 35.

The present embodiment may be modified so that upper surfaces 1040 of the flanges 922 impinge against structure internal to the overcap, which is coextensive with an upper portion 1042 of the vertical walls 1014 and the top surface 1016 of the base 1000. For example, an annular portion (not shown) may extend over peripheral edges 1044 of the circular opening 1008 of the base 1000 so that the flanges 922 that impinge against the annular portion, in conjunction with the force components exerted by the flanges against the walls 1018 of the L-shaped tracks 1010, can retain the locking member 1004 and the annular ring 902 together. In a different embodiment, portions of the flanges 922 could extend above one or more of the vertical walls 1014 and the top surface 1016 and impinge against structure within the overcap (not shown). Such structure would be particularly useful in attachment mechanisms that do not include a pedestal in combination with an outer annular portion, such as depicted in FIG. 38.

Figure 37:
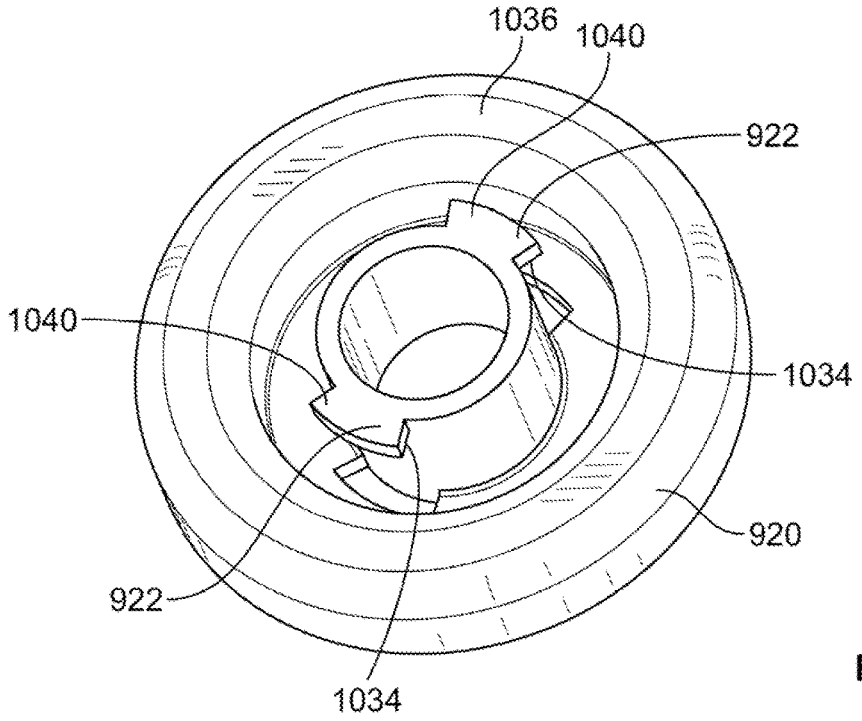
FIG. 37 is a top isometric view of an alternative embodiment of the annular ring of FIG. 35.
Figure 37A:
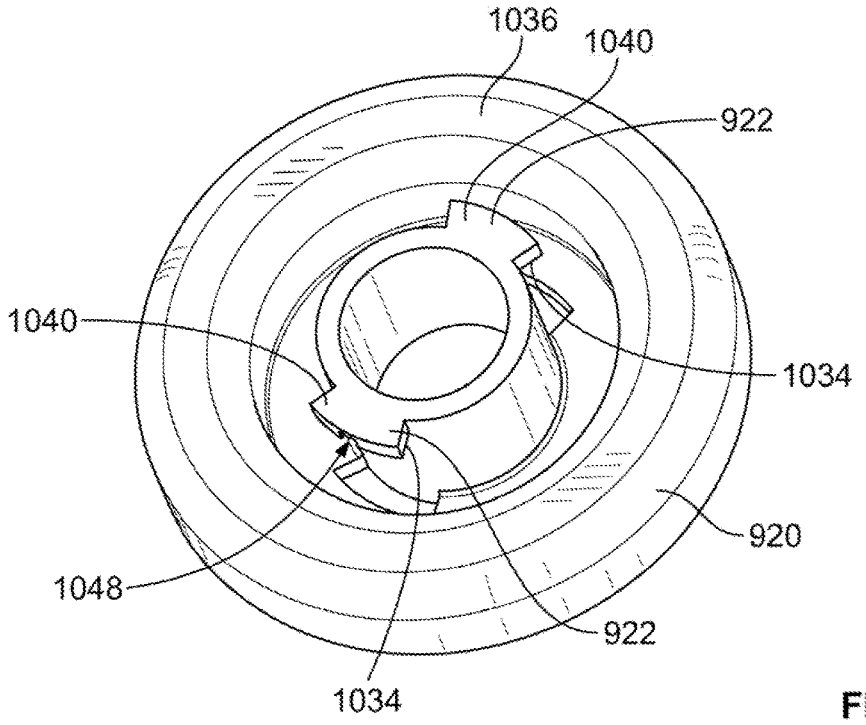
FIG. 37A is an alternative embodiment of the annular ring of FIG. 37.
Figure 39A:
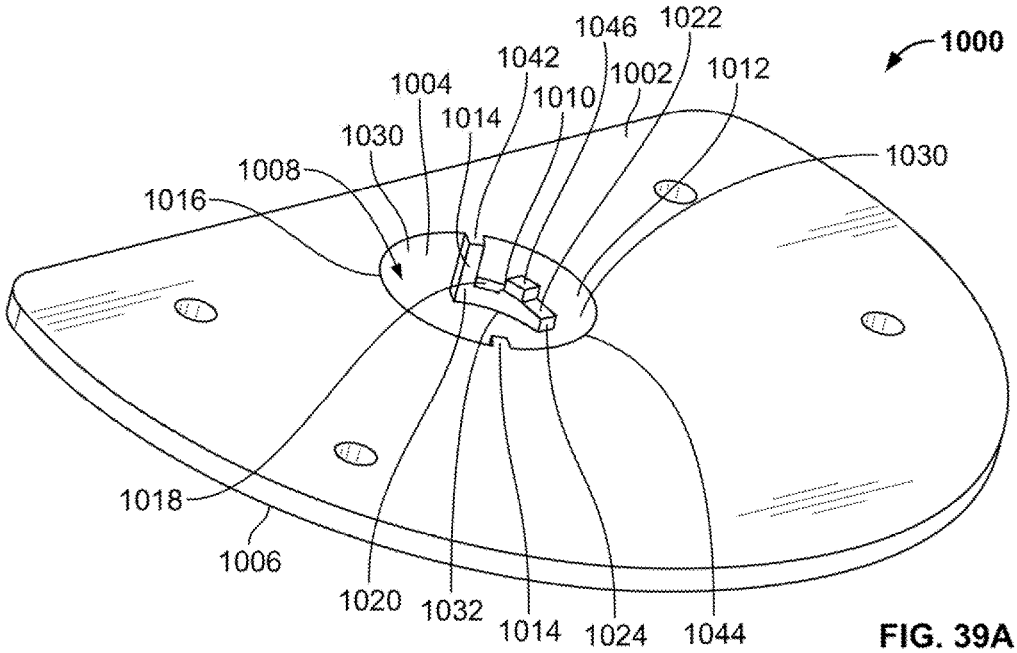
FIG. 39A is an isometric view of an alternative embodiment of the base of FIG. 39.
Figure 40:
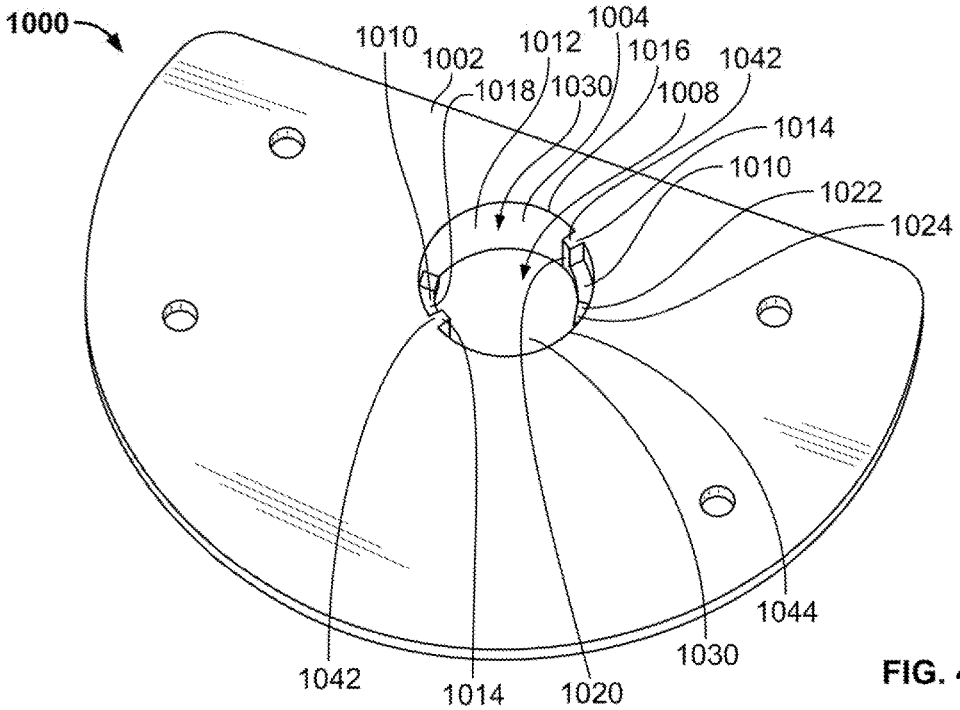
FIG. 40 is a top isometric view of the base of FIG. 39.
Figure 41:
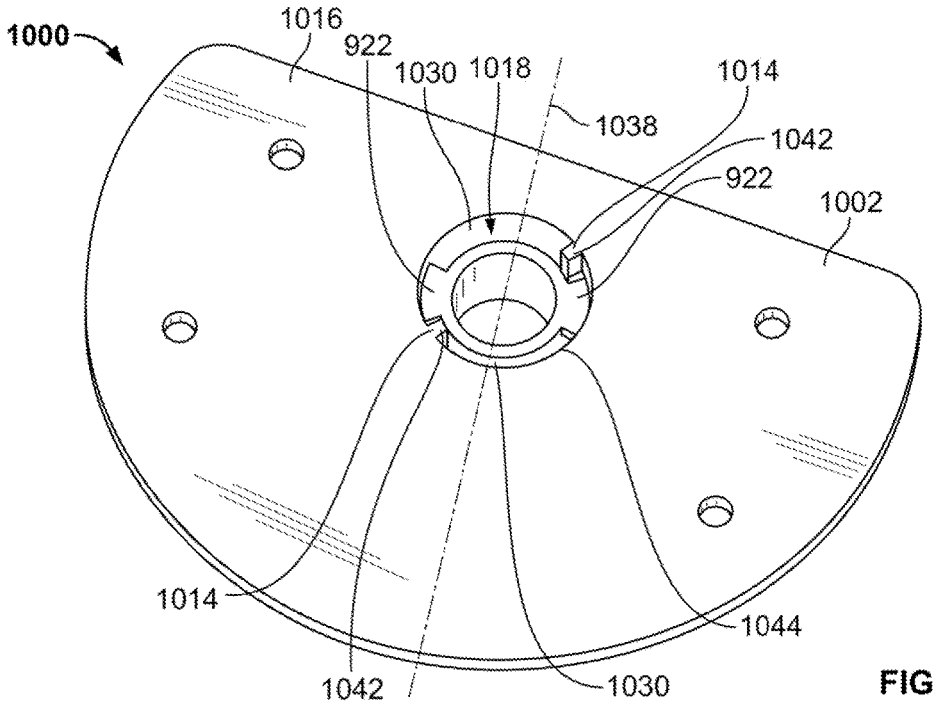
FIG. 41 is a top isometric view of the base of FIG. 39 with the annular ring of FIG. 37 disposed therein.
Figure 42:
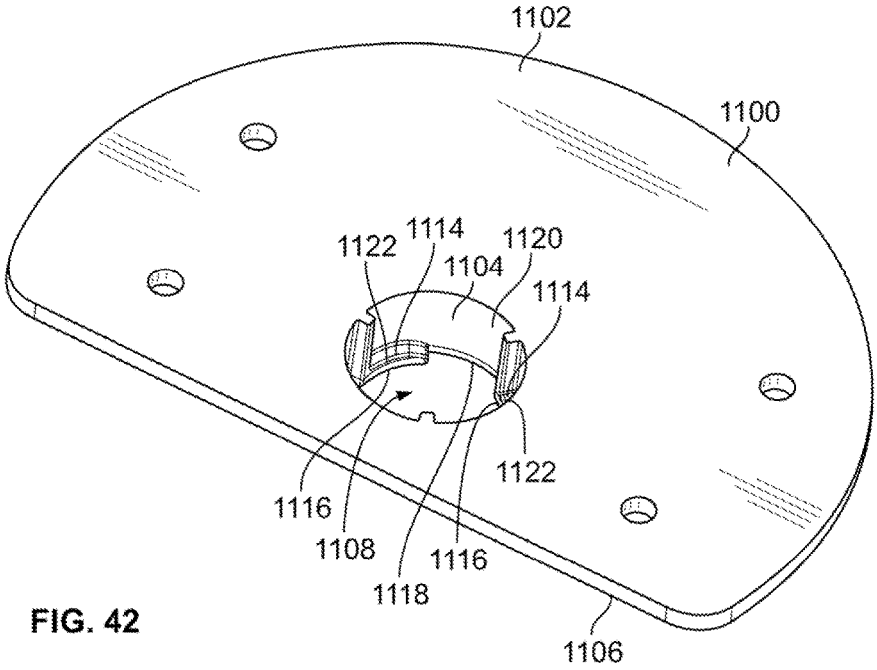
FIG. 42 is a top isometric view of an alternative embodiment of the base of FIG. 39.

Turning again to FIG. 41, the overcap is turned until a portion of the flanges 922 abut against the vertical wall 1014 (FIG. 41 shows the attachment mechanism 900 in a position substantially fully rotated). Various locking mechanisms (not shown) may be provided that assist in releasably locking the flanges 922 into the tracks to prevent the overcap and the container from rotating or otherwise moving out of engagement, e.g., with respect to the present embodiment, the flanges could be rotated in a clock-wise direction, which could cause the disengagement of the locking member 1004 from the annular ring 920. One such locking mechanism may include a stop member (see FIG. 39A) in the form of a rib 1046 disposed on a non-ramped portion of the wall 1018 of the L-shaped track 1010. A corresponding groove 1048 (see FIG. 37A) may be provided within the lower surface 1034 of the flange 922. The ribs 1046 and grooves 1048 are sized to mate with one another and do not substantially interfere with the impingement of the flanges 922 and/or the top curved surface 1036 of the annular ring 920 with the locking member 1004 as described above. To remove the annular ring 920 from the locking member 1004, a user would have to exert substantially greater rotational forces against one or more of the container and/or overcap and/or would have to apply upward pressure to one or more of the container or overcap to remove the rib from the groove and rotate the container and overcap into an uncoupled state. In a different embodiment, the rib 1046 may be disposed on the flange 922 and the groove 1048 on the L-shaped track 1010.

In other embodiments, ribs and grooves may be alternatingly placed on flanges and tracks. Further, it is also contemplated that at least one rib and grove combination will be provided on at least one L-shaped track and flange arrangement in conjunction with at least one L-shaped track and flange arrangement without a rib and a groove. In this particular embodiment, the at least one L-shaped track and flange arrangement with a rib and groove could be modified to change the dimensions of the L-shaped track and/or the flange so as not to substantially interfere with the force components exerted by the remaining L-shaped track and flange arrangements without a rib. Finally, it is contemplated that any of the above noted retention structures could be modified and used with respect to any of the embodiments herein as would be readily apparent by one of ordinary skill in the art.

Alternatively, a different embodiment of a base 1100 is shown in FIGS. 42-45. The base 1100 is substantially similar to the base 1000 described with respect to the embodiments shown in FIGS. 39-41. The base 1100 includes a substantially flat wall 1102 attached to the overcap (not shown). The wall 1102 includes a cylindrical locking member 1104 extending downwardly from a lower surface 1106 thereof. The locking member 1104 defines a circular opening 1108 adapted to receive portions of a valve stem/valve assembly (not shown) when the attachment mechanism is in use.

Figure 43:
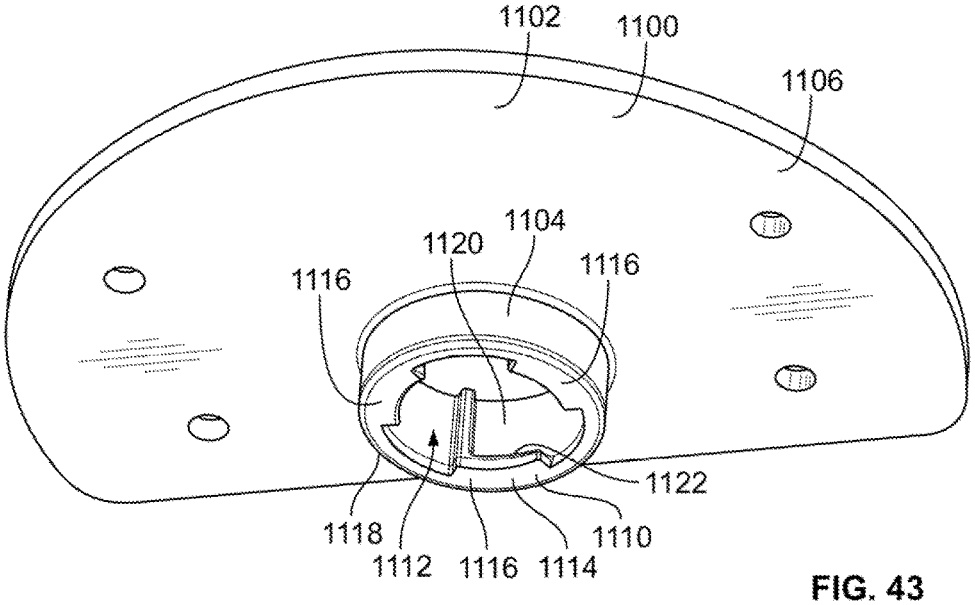
FIG. 43 is a bottom isometric view of the base of FIG. 42.
Figure 44:
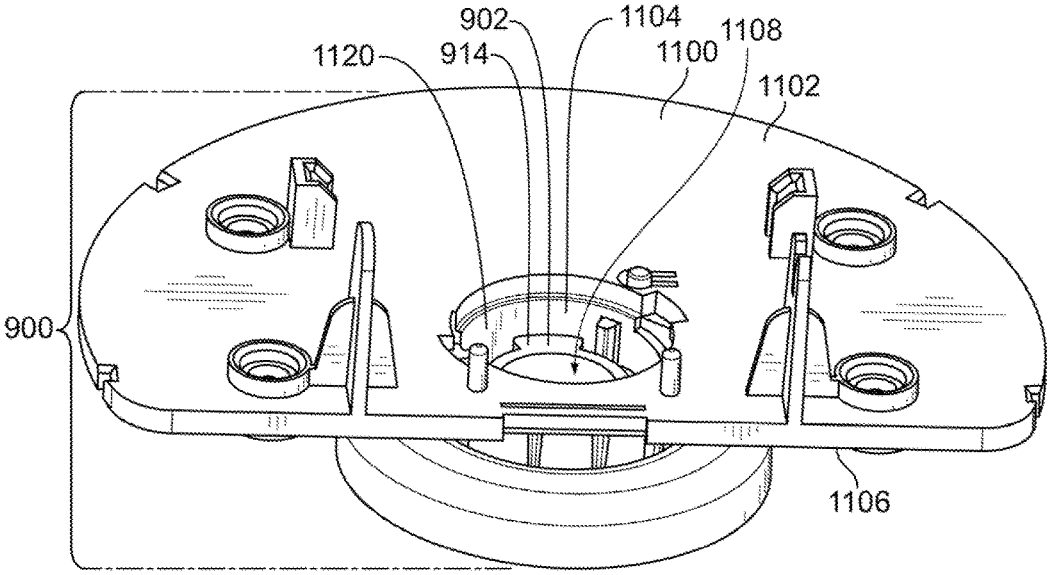
FIG. 44 is a top isometric view of a base similar to the base of FIG. 42 with the annular ring of FIG. 35 disposed therein.
Figure 45:
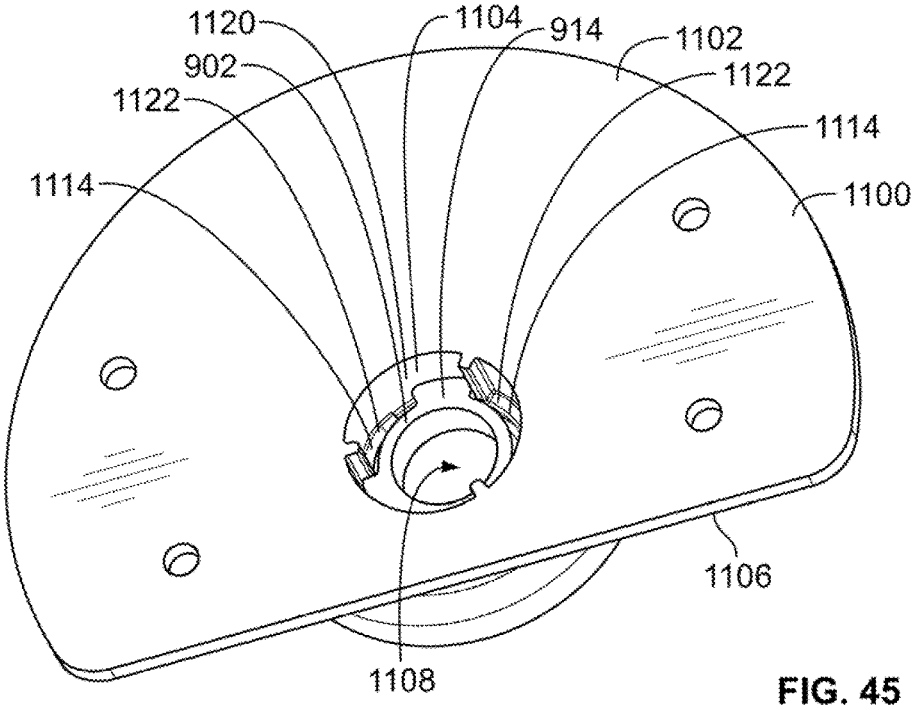
FIG. 45 is a different top isometric view of the base of FIG. 42 with the annular ring of FIG. 35 disposed therein.

As best seen in FIG. 43, the locking member 1104 further includes a lower surface 1110 with an opening 1112 having an outline that is complementary to the pedestal 906 and the associated flanges 914 of the annular ring 902. In other embodiments, the shape of the opening 1112 is adapted to correspond to any of the annular rings having a plurality of flanges and/or a pedestal having flanges, as described herein. The opening 1112 is defined by a plurality of inwardly extending ledges 1114. Bottom surfaces 1116 of the ledges 1114 are coextensive with a bottom edge 1118 of the locking member 1104. The ledges 1114 circumscribe an interior wall 1120 of the locking member 1004 and define lower portions of L-shaped tracks 1122, which are adapted to interact with the flanges 914 on the annular ring 902 in a substantially similar manner as previously described (see FIGS. 44 and 45).

Now turning to FIGS. 46-56, a sixth embodiment of an attachment mechanism 1200 is shown similar to those previously described. The attachment mechanism 1200 includes a bracket or adapter, presently in the form of an annular ring 1202 comprising a U-shaped member 1204. The U-shaped member 1204 includes an outer wall 1206 and an inner wall 1208 that are connected via a curved transverse upper wall 1210. An annular riser 1212 extends upwardly from an exterior surface 1214 of the U-shaped member 1204. The annular riser 1212 has a smaller diameter as measured from longitudinal axis 1216 than the U-shaped member 1204. A plurality of elongate slots 1218 are equidistantly disposed through the annular riser 1212 adjacent portions of the upper wall 1210 of the U-shaped member 1204. In the present embodiment, two elongate slots 1218 are provided. However, it is anticipated that one or more elongate slots may be utilized in connection with the present embodiment. In a different embodiment, the slots 1218 may extend partially through the annular riser 1212 as opposed to extending through the entirety thereof.

Figure 46:
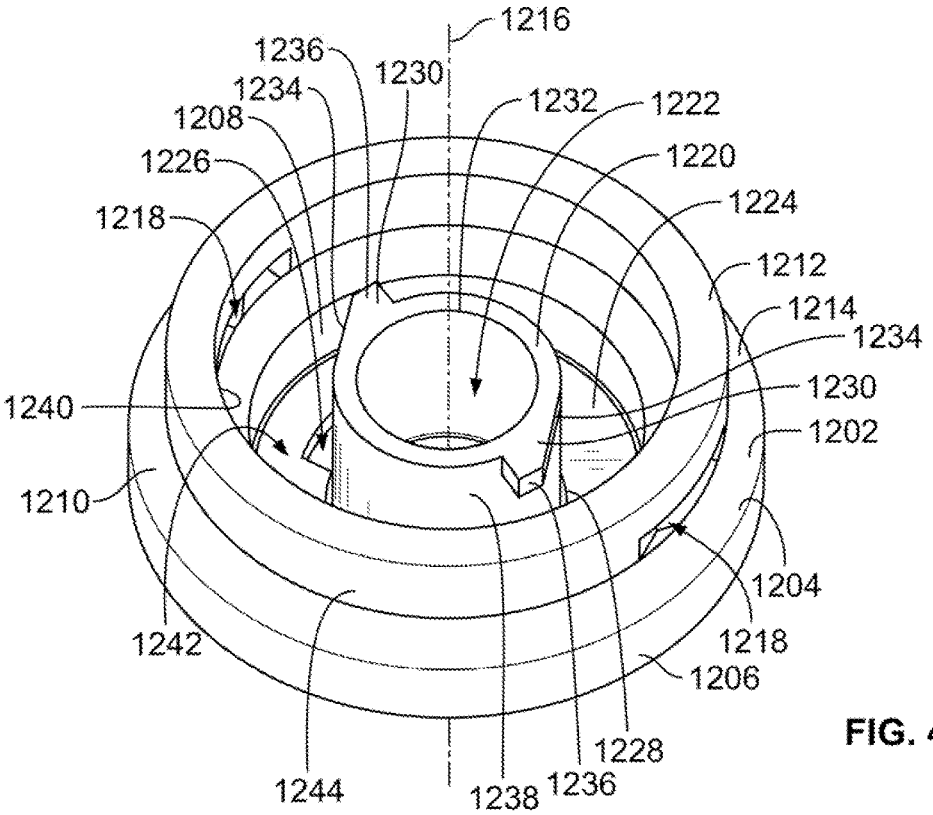
FIG. 46 is a top isometric view of a sixth embodiment of an annular ring adapted for use in an attachment mechanism.
Figure 47:
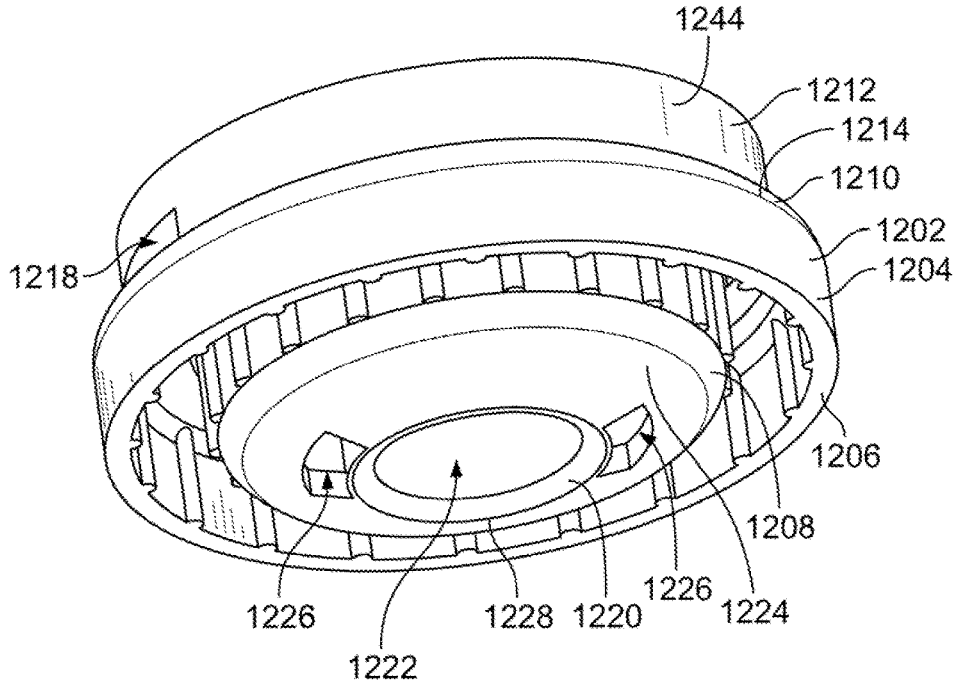
FIG. 47 is a bottom isometric view of the annular ring of FIG. 46.

As best seen in FIG. 46, a pedestal 1220 is provided interiorly of the annular U-shaped member 1204, which is shaped to fittingly receive the pedestal and/or valve stem/valve assembly of a container (not shown) within a circular opening 1222 extending therethrough. The U-shaped member 1204 is connected to the pedestal 1220 by a medial wall portion 1224. The medial wall portion 1224 further includes a plurality of openings 1226 disposed therein. The openings 1226 are disposed on opposing sides of the pedestal 1220 and are provided to facilitate the manufacture of the annular ring.

The pedestal 1220 extends upwardly from a central portion 1228 of the medial wall portion 1224. At least one flange 1230 extends radially outwardly from a top edge 1232 of the pedestal 1220. In the present embodiment two oppositely disposed flanges 1230 are provided that are disposed adjacent the top edge 1232 of the pedestal 1220. In other embodiments, the flanges 1230 may be disposed beneath the top edge 1232. The flanges 1230 extend radially toward the annular riser 1212. The flanges 1230 include an angled edge 1234 extending outwardly to a distal edge 1236. In the present embodiment, portions of the angled edges 1234 are in radial alignment with portions of the elongate slots 1218 of the annular riser 1212. Similar to previously disclosed embodiments, the annular ring 1202 is adapted to be secured to a portion of the mounting cup 308 of a container.

In a preferred embodiment, the flanges 1230 have a greatest length dimension of between about 0.5 mm to about 5 mm measured from an exterior surface 1238 of the pedestal 1220. The flanges 1230 extend from the exterior surface 1238 of the pedestal 1220 toward an inner side wall 1240 of the annular riser 1212 over the medial wall portion 1224. The flanges 1230 preferably extend between about 5% to about 75% of the distance between the exterior surface 1238 of the pedestal 1220 and the inner side wall 1240 of the annular riser 1212. The void between the pedestal 1220 and the annular riser 1212 defines a space 1242.

In a preferred embodiment, the elongate slots 1218 have a width dimension as measured between left and right sides of between about 1 mm to about 10 mm. Further, the elongate slots 1218 have a height dimension between top and bottom sides of between about 0.5 mm to about 5 mm. Preferably, the elongate slots 1218 extend through the annular riser 1212 from the inner wall 1240 to an outer wall 1244. In other embodiments, the elongate slots 1218 extend partially through the annular riser 1212.

Turning to FIGS. 48-53, a base 1250 is shown, which is similar to the bases previously described except for the differences noted herein. The base 1250 includes a substantially flat wall 1260 attached to the overcap (not shown). The wall 1260 includes a locking member 1262 that protrudes from a lower surface 1264 of the wall 1260. The locking member 1262 is substantially cylindrical and includes a circular opening 1266 extending therethrough, which is adapted to receive portions of the pedestal and/or valve stem/valve assembly of the container (not shown) when the attachment mechanism 1200 is in use. The locking member 1262 is appropriately dimensioned to fit within the space 1242 of the annular ring 1202.

Figure 48:
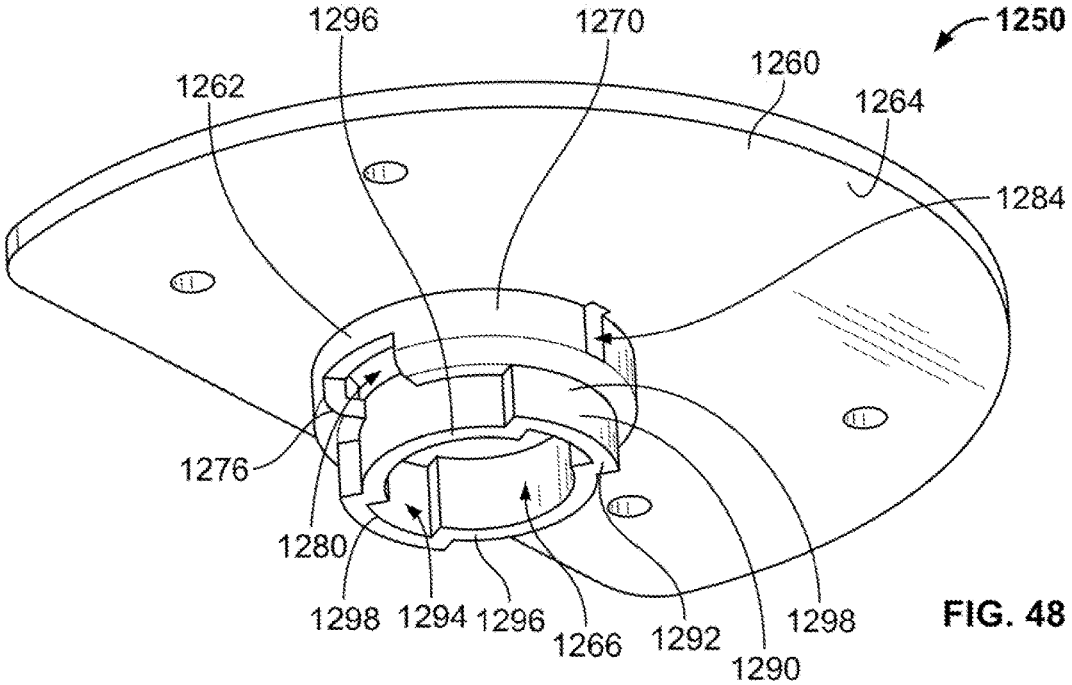
FIG. 48 is a bottom isometric view of a sixth embodiment of a base adapted for use with the annular ring of FIG. 46.

As best seen in FIG. 48, the locking member 1262 is defined by a circular wall 1270. The circular wall 1270 includes a lower curved edge 1276. The circular wall 1270 and lower curved edge 1276 are dimensioned to fit within the space 1242 such that the lower curved edge 1276 will be disposed adjacent portions of the curved transverse wall 1210 of the U-shaped member 1204 when the annular ring 1202 is engaged with the base 1250. Still referring to FIG. 48, a pair of oppositely disposed elongate openings 1280 truncate portions of the circular wall 1270 and lower curved edge 1276. Further, a pair of oppositely disposed notches 1284 extend through the circular wall 1270 and are spaced equidistantly from the elongate openings 1280.

Figure 49:
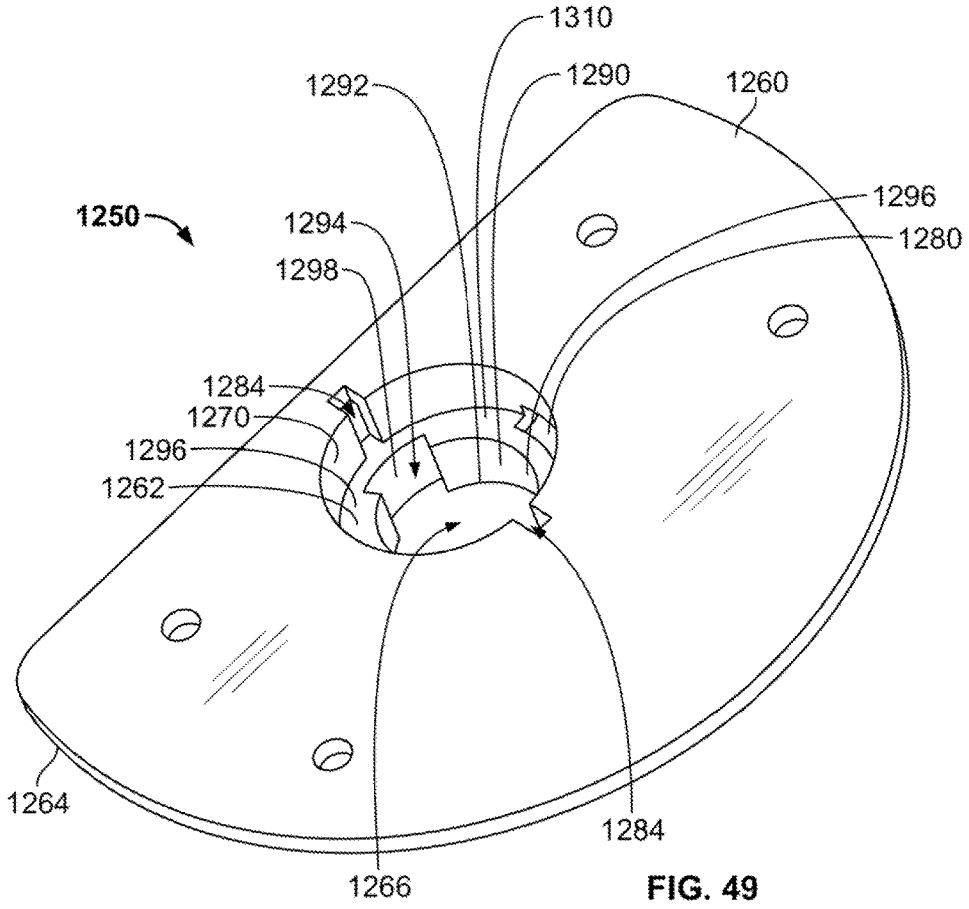
FIG. 49 is a top isometric view of the base of FIG. 48.
Figure 50:
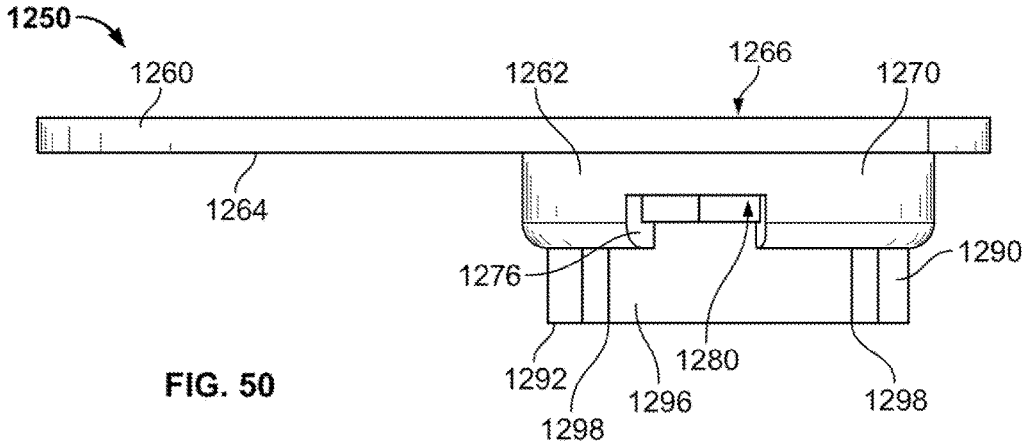
FIG. 50 is a side elevational view of the base of FIG. 48.
Figure 51:
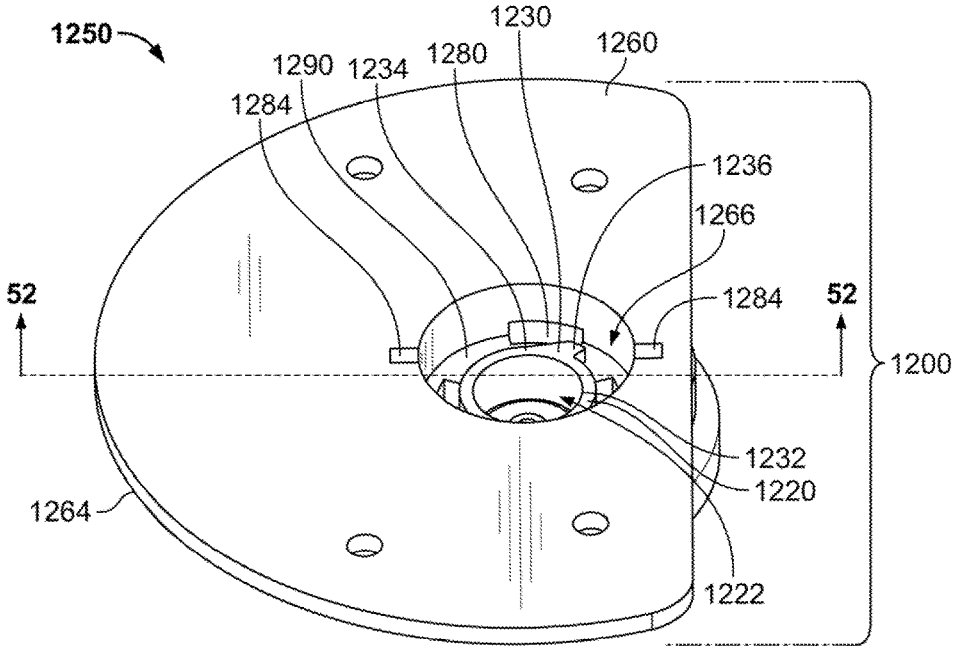
FIG. 51 is a top isometric view of the base of FIG. 48 with the annular ring of FIG. 46 disposed therein.
Figure 52:
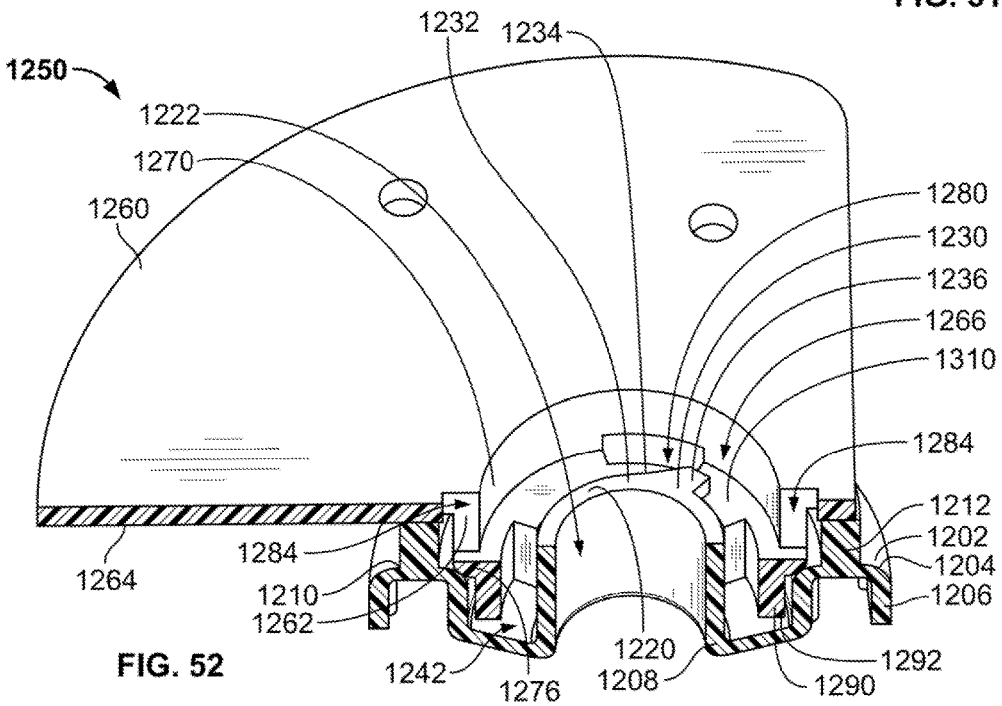
FIG. 52 is a cross-sectional view of the base of FIG. 48 with the annular ring of FIG. 46 disposed therein taken along the line 52-52 of FIG. 51.
Figure 53:
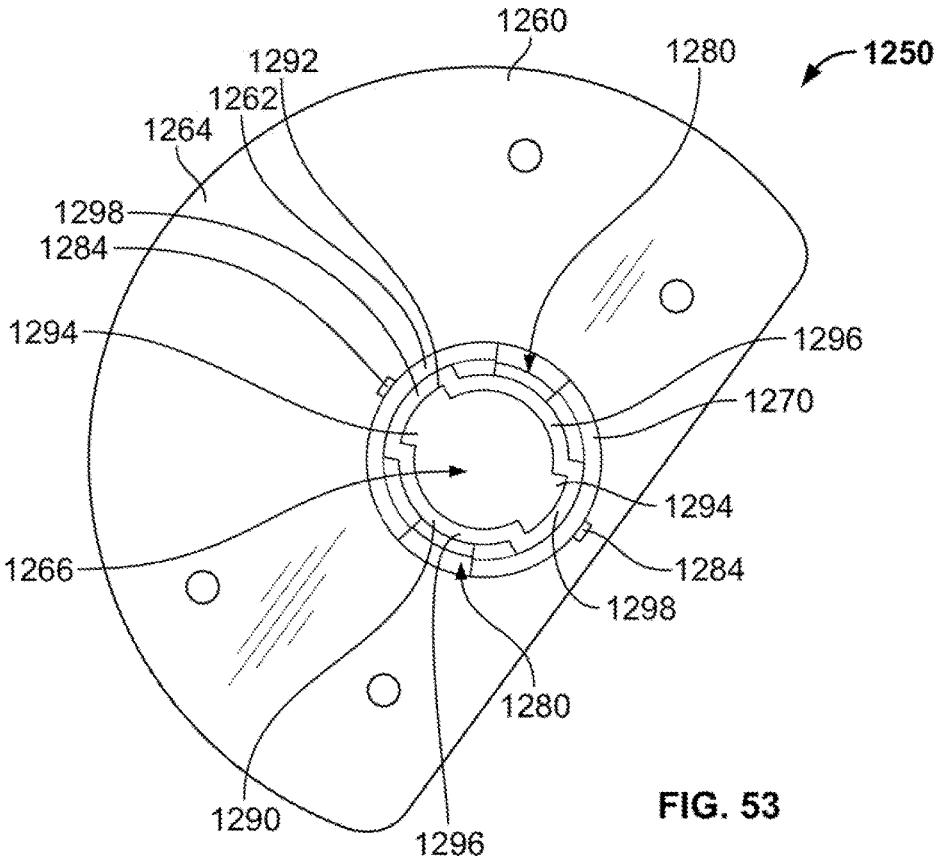
FIG. 53 is a bottom plan view of the base of FIG. 48.

With reference to FIGS. 48-50, a second circular wall 1290 is stepped inwardly from the circular wall 1270 and extends downwardly from the lower curved edge 1276 toward a bottom end 1292. The circular opening 1266 similarly extends through the second circular wall 1290. The second wall 1292 is truncated by two opposing grooves 1294 defined by sidewalls 1296 and end walls 1298. As best seen in FIGS. 49 and 52, the stepped second wall 1290 forms an annular ledge 1310, which extends inwardly toward the circular opening 1266. The ledge 1310 is truncated by the two opposing grooves 1294. Further, the two elongate openings 1280 partially extend through the annular ledge 1310.

Figure 54:
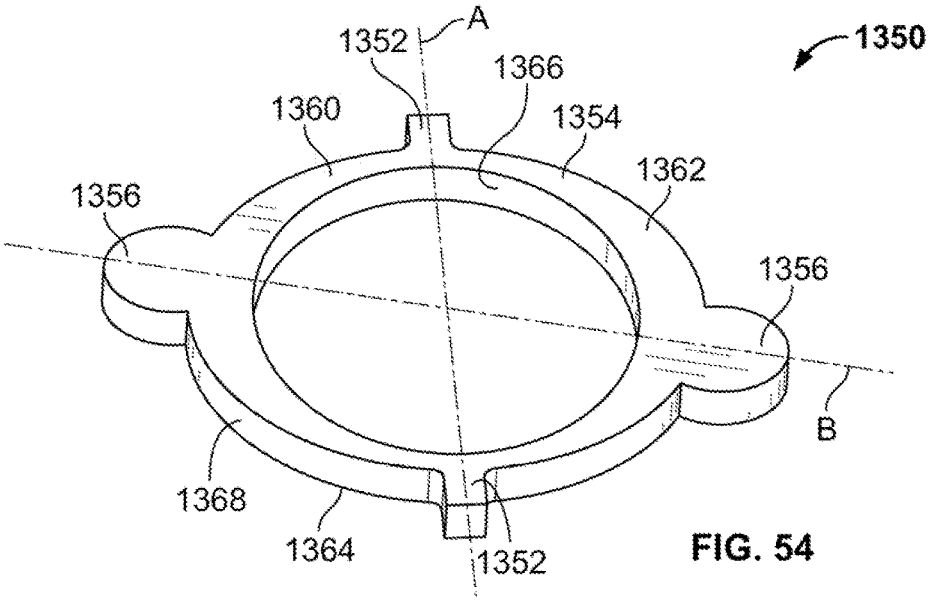
FIG. 54 is an isometric view of a resilient member adapted for use with the base of FIG. 48 and the annular ring of FIG. 46.

Now turning to FIG. 54, a resilient member 1350 is shown. The resilient member 1350 includes two rectangular-shaped projections 1352 extending outwardly from opposing sides of a generally oval-shaped ring 1354. Two oppositely disposed bulbous protrusions 1356 also extend outwardly from the ring 1354. The bulbous protrusions 1356 are equidistantly spaced from the rectangular-shaped projections 1352. The ring 1354 is defined by a sidewall 1360 having a top surface 1362, a bottom surface 1364, an interior wall 1366, and an exterior wall 1368.

The sidewall 1360 varies in thickness. The sidewall 1360 is at the thickest point in an area adjacent the bulbous protrusions 1356. Preferably, the sidewall has a greatest thickness between about 1 mm and about 10 mm. The sidewall 13601 has its narrowest point in an area adjacent the rectangular-shaped projections 1352. Preferably, the sidewall has a narrowest thickness between about 0.5 mm and about 5 mm. The sidewall is also provided with a major axis A between opposing sides of the interior wall 1366 of between about 2 mm to about 10 mm and a minor axis B of between about 1 mm to about 10 mm. Preferably, the major axis A extends between the rectangular-shaped projections 1352 and the minor axis B extends between the bulbous protrusions 1356.

The resilient member 1350 is dimensioned so as to be capable of disposition on the ledge 1310 of the locking member 1262. Particularly, the rectangular-shaped projections 1352 are nested, wholly or partially, within the notches 1284 of the circular wall 1270 and portions of the bottom surface 1364 of the resilient member 1350 rest on the ledge 1310. In this position, the bulbous protrusions 1356 are disposed in substantial alignment with the elongate openings 1280 within the circular wall 1270. In the present embodiment, the nesting of the rectangular-shaped projections 1352 within the notches 1284 is accomplished by an interference fit therebetween. In other embodiments, the resilient member 1350 is attached by an adhesive or other securing means known to one of ordinary skill. In yet another embodiment, the resilient member 1350 is integrally molded to the locking member 1262. In still another embodiment, structure internal to the overcap holds the rectangular-shaped projections 1352 in place. It is also envisioned that any of the above-noted retention means could be used alone or in combination.

The resilient member 1350 preferably comprises an elastically deformable material. For example, an elastomeric compound such as rubber, a polymer, and/or combinations thereof could be used to form the resilient member 1350. In a preferred embodiment, the materials comprising the resilient member have an elastic modulus of between about 1600 MPa to about 205000 MPa, and more preferably, between about 70000 MPa to about 205000 MPa, and most preferably, about 200000 MPa.

Further, the resilient member 1350 may be made from a combination of materials. For example, in one embodiment, the resilient member may be made from Nylon and Polyoxymethylene. It is also contemplated that an inelastically deformable material could be used that becomes locked in place after use to prevent removal of the container from the overcap.

Figure 55:
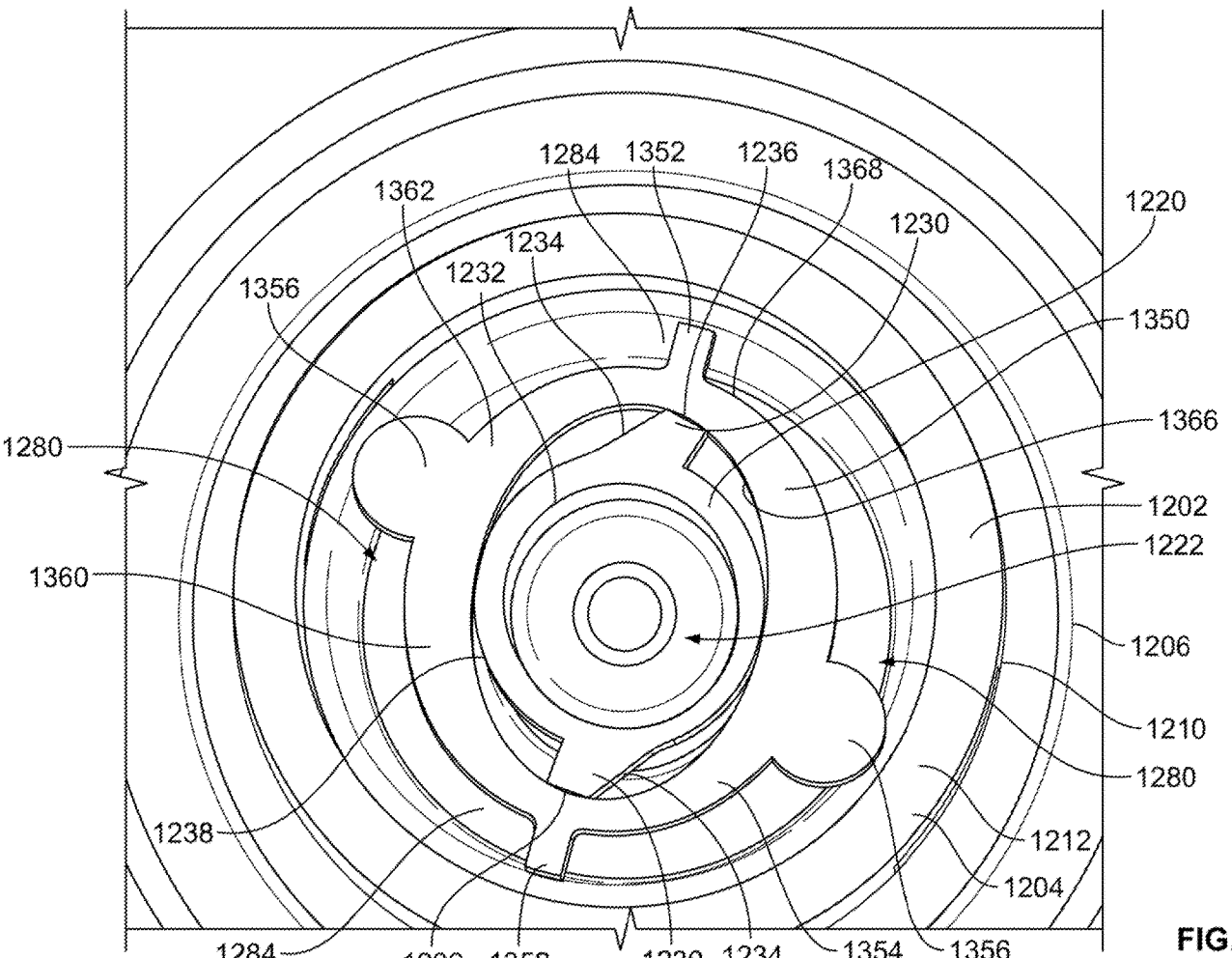
FIG. 55 is a top plan view of the annular ring of FIG. 46 in a first, unlocked position, wherein the annular ring is not touching the resilient member.
Figure 56:
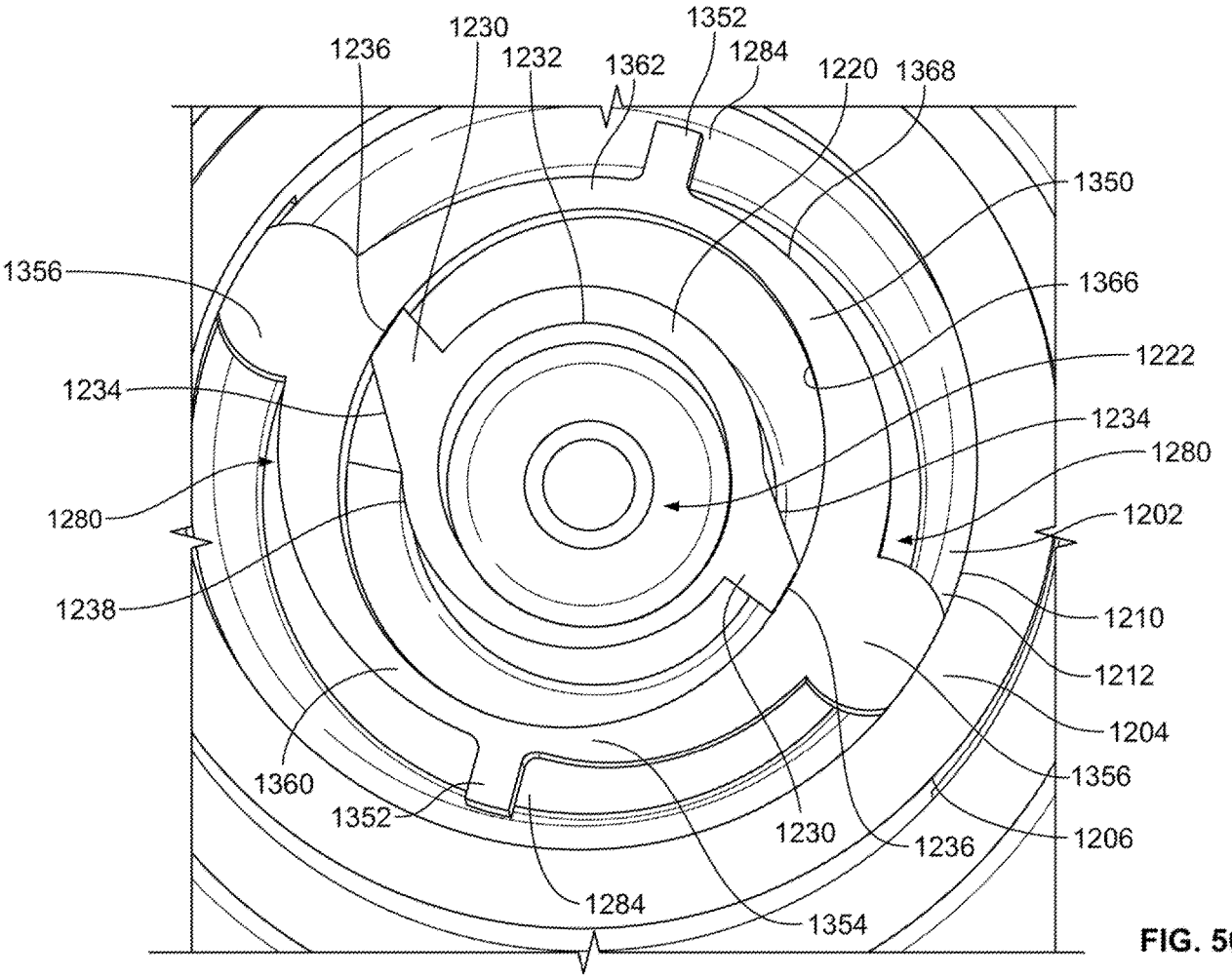
FIG. 56 is a top plan view of the annular ring of FIG. 46 in a second, locked position, wherein the annular ring is pressing outwardly on the resilient member.

Turning to FIGS. 55 and 56, the operation of the attachment mechanism 1200 will be described. To attach the overcap to the container, the opposing flanges 1230 of the annular ring 1202 are positioned adjacent the opposing grooves 1294 of the locking member 1262. The opposing flanges 1222 are inserted within the grooves 1294 so that the flanges 1230 are adjacent the interior wall 1366 of the resilient member 1350. Preferably, the various components of the attachment mechanism 1200 are dimensioned with respect to one another to create a stable mechanism that allows for various advantages to be realized. For example, the flanges 1230 are preferably sized to extend outwardly enough to impinge the resilient member 1350 to create a stable locking connection. At the same time, the flanges 1230 must be small enough to fit through the grooves 1294 such that the annular ring 1202 may be positioned within the locking member 1262. The sizing of the flanges 1230 is dependent on a number of factors including the type of resilient member used in the attachment mechanism, the size of the locking member, the type of container being supported by the attachment mechanism, and the like. In a preferred embodiment, the flanges 1230 are disposed in substantial alignment with the major axis A. Proper positioning of the flanges 1230 within the locking member 1262 is aided by the grooves 1294, which are preferably dimensioned to be the sole access point for the flanges 1230 when entering the opening 1266. The grooves 1294 also act as a channel to guide the flanges 1230 to their first or pre-operational position within the locking member 1262 as shown in FIG. 55. In this position, the elongate openings 1280 of the locking member 1262 are in substantial alignment with the elongate slots 1218 of the annular riser 1212 of the annular ring 1202. Thereafter, the overcap and container are turned in opposite directions (or one is turned while the other is held steady).

In the present embodiment, the overcap is turned in a counter-clockwise manner and/or the container in a clockwise manner. During rotation, the angled edges 1234 of the flanges 1230 impinge against the interior wall 1366 (see FIG. 56) of the resilient member 1350 adjacent the areas of greater thickness. Continued rotation causes the resilient member 1350 to elastically deform. Substantial deformation occurs about the minor axis B of the resilient member 1350. Deformation of the resilient member 1350 about the minor axis B causes the resilient member 1350 to flex radially outwardly, thereby forcing the bulbous protrusions 1356 through the elongate openings 1280 of the locking member 1262 and through the elongate slots 1218 of the annular ring 1202. Once the protrusions 1356 are through the slots 1218, the attachment mechanism 1200 is in a second or operational position.

Figure 58:
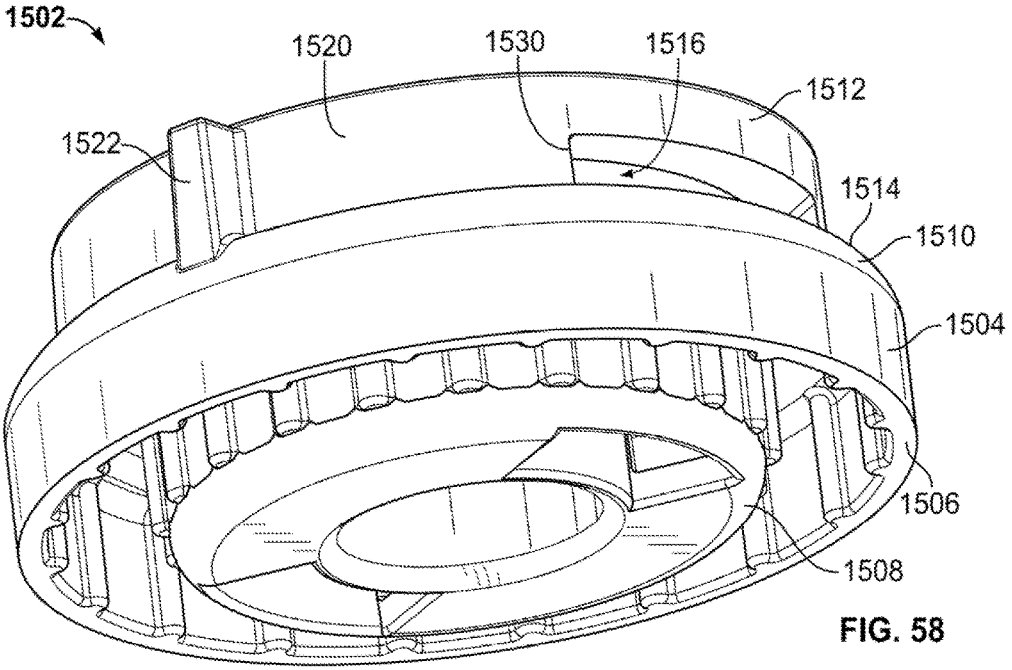
FIG. 58 is a bottom isometric view of the annular ring of FIG. 57.

Now turning to FIGS. 57-74, an alternative embodiment of an attachment mechanism 1500 is shown that is similar to the attachment mechanism 1200, including the intended variations, except for the differences noted hereinbelow. FIGS. 57 and 58 depict the attachment mechanism 1500 as including an annular ring 1502 comprising a U-shaped member 1504. The U-shaped member 1504 includes an outer wall 1506 and an inner wall 1508 that are connected by a curved transverse upper wall 1510. An annular riser 1512 extends upwardly from an exterior surface 1514 of the U-shaped member 1504. A plurality of elongate slots 1516 are equidistantly disposed through the annular riser 1512 adjacent portions of the upper wall 1510 of the U-shaped member 1504. In the present embodiment, two elongate slots 1516 are provided. The elongate slots 1516 of the present embodiment extend circumferentially about the annular riser 1512 to a greater extent than the elongate slots 1218 of the attachment mechanism 1200.

In a preferred embodiment, the elongate slots 1516 have a width dimension as measured between left and right sides of between about 1 mm to about 10 mm. Further, the elongate slots 1516 have a height dimension between top and bottom sides of between about 0.5 mm to about 5 mm. Preferably, the elongate slots 1516 extend through the annular riser 1512 from an inner wall 1518 thereof to an outer wall 1520 thereof. In other embodiments, the elongate slots 1516 extend partially through the annular riser 1512.

FIGS. 57 and 58 depict the annular ring 1502 as including a plurality of rectangular stabilizing ribs 1522. The ribs 1522 extend upwardly from the upper wall 1510 of the U-shaped member 1504 and outwardly from the outer wall 1520 of the annular riser 1512. In the present embodiment there are two oppositely disposed stabilizing ribs 1522, which are provided equidistantly between the elongate slots 1516.

As best seen in FIG. 57, the annular ring 1502 further includes at least one flange 1524 that extends radially outwardly from a pedestal 1526. In the present embodiment, two opposing flanges 1524 are provided that extend outwardly from a top 1528 of the pedestal 1526 in contrast to the previous embodiment. The flanges 1524 radially extend toward a corner 1530 of the corresponding slot 1516 disposed within the annular riser 1512. The flanges 1524 are generally triangular in shape and include a rounded tip 1532. The flanges 1524 also include a first side 1534 that is longer than a second side 1536, which makes the triangular shape irregular and non-symmetrical about a central axis.

In a preferred embodiment, the flanges 1524 have a greatest length dimension of between about 0.5 mm to about 5 mm measured from an exterior surface 1538 of the pedestal 1526. The flanges 1524 extend from the top 1528 of the pedestal 1526 toward the inner side wall 1518 of the annular riser 1512 in a similar manner as described in connection with the attachment mechanism 1200. In the present embodiment, inner edges 1540 of the flanges 1524 are substantially coextensive with an inner wall 1542 defining a central opening 1544 of the pedestal 1526. In other embodiments, the flanges 1524 may be disposed exteriorly of the inner wall 1542 or on an outer wall 1546 defining the pedestal 1526.

Figure 59:
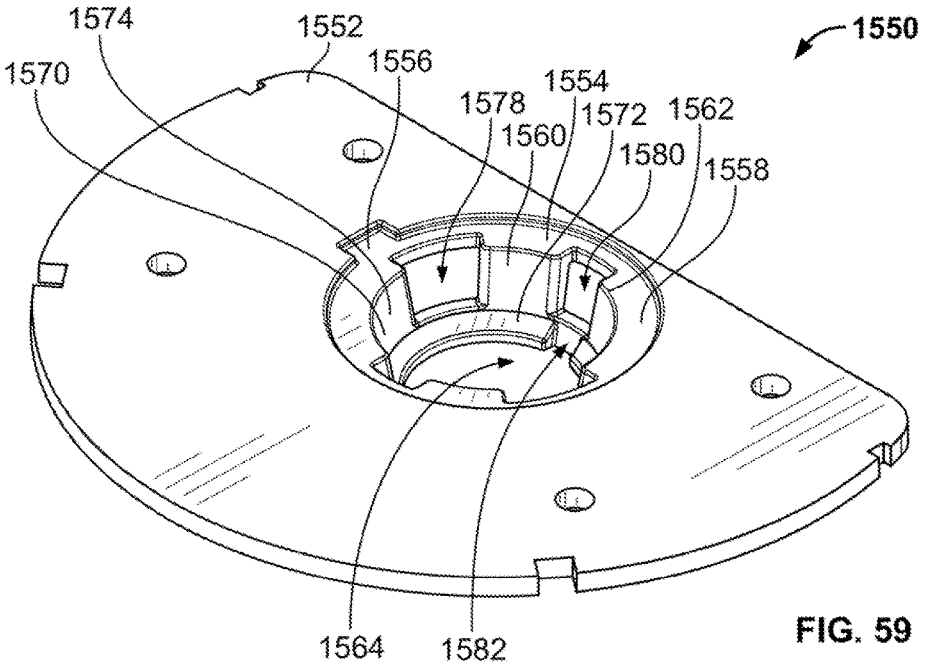
FIG. 59 is a top isometric view of a seventh embodiment of a base adapted for use with the annular ring of FIG. 57.

As best seen in FIGS. 59-62, a different embodiment of a base 1550, which is similar to base 1242 except for the differences noted herein, is shown for use with the annular ring 1502. The base 1550 includes a substantially flat wall 1552 attached to the overcap (not shown). The wall 1552 includes a circular depression 1554, which is truncated by a rectangular depression 1556. The depressions 1554, 1556 define a substantially annular ledge 1558. Turning to FIG. 59, a substantially cylindrical locking member 1560 extends downwardly from an inner edge 1562 of the ledge 1558. A circular opening 1564 extends through the locking member 1560, which is adapted to receive portions of the pedestal and/or valve stem/valve assembly of the container (not shown) when the attachment mechanism 1500 is in use. The locking member 1560 is appropriately dimensioned to fit within a space 1566 of the annular ring 1502.

Figure 60:
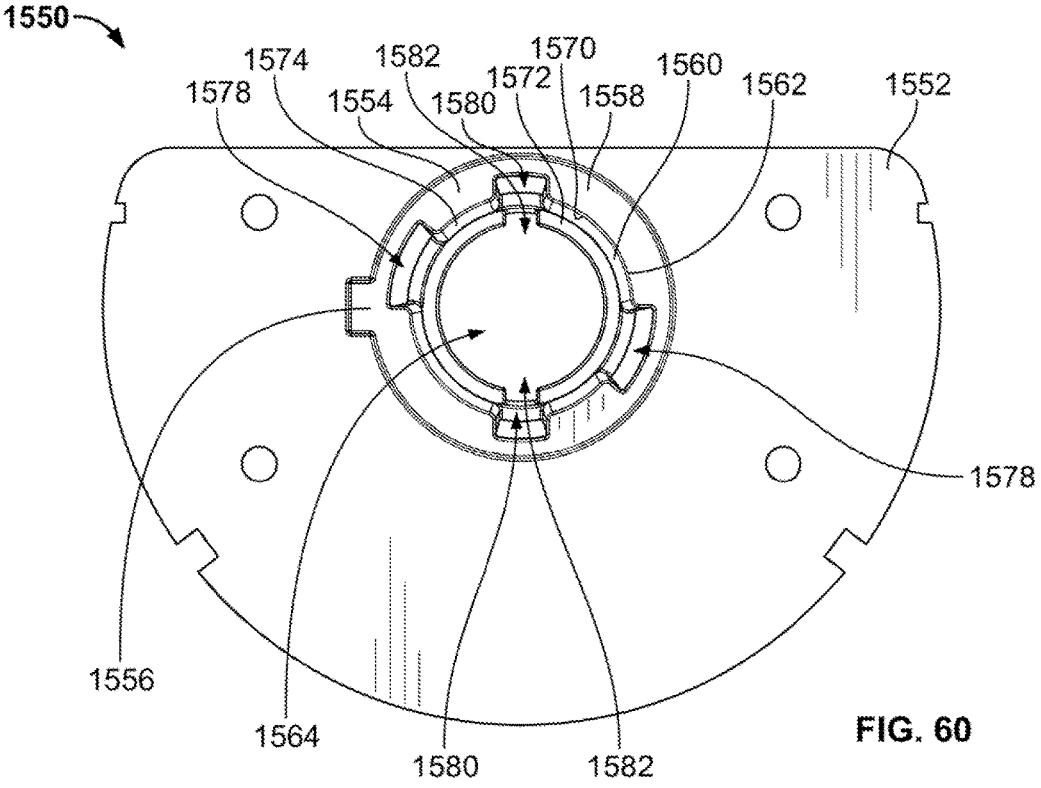
FIG. 60 is a top plan view of the base of FIG. 59.
Figure 61:
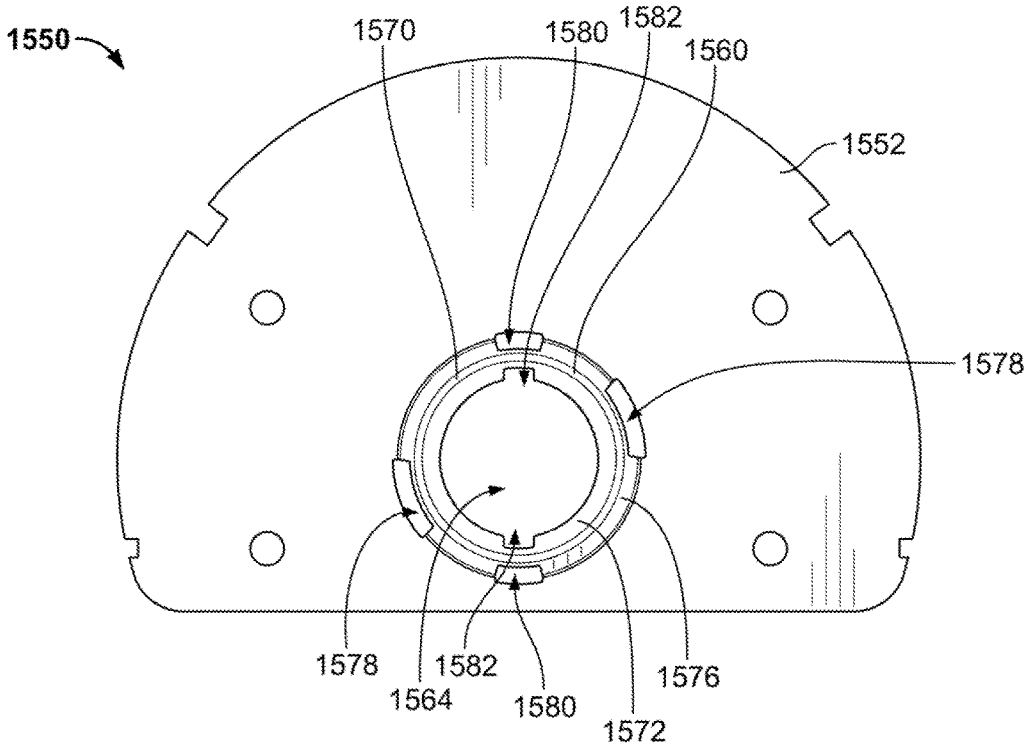
FIG. 61 is bottom plan view of the base of FIG. 59.
Figure 62:
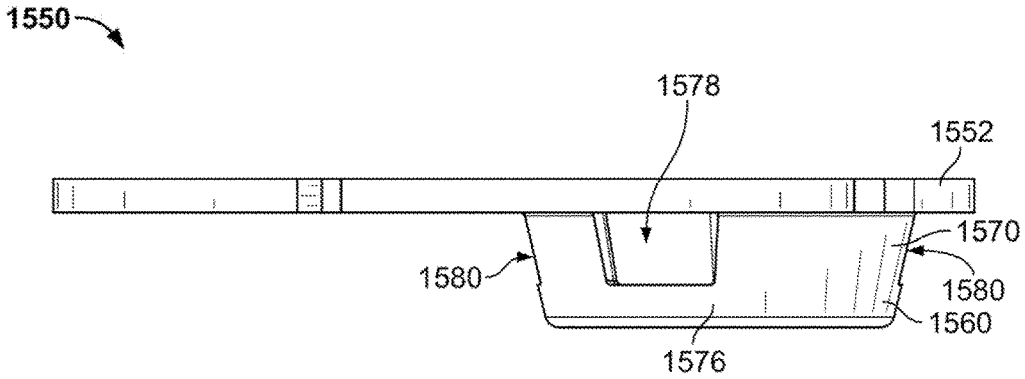
FIG. 62 is side elevational view of the base of FIG. 59.
Figure 63:
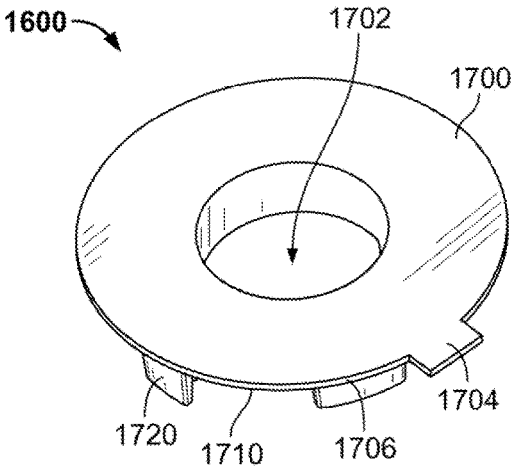
FIG. 63 is a top isometric view of a locking element adapted for use in an attachment system.

With reference to FIGS. 59-62, the locking member 1560 includes a circular wall 1570 that extends between the ledge 1558 and a lower annular ledge 1572. The circular wall 1570 includes an interior surface 1574 and an exterior surface 1576. The circular wall 1570 is dimensioned to fit within the space 1566 (see FIG. 57). Referring to FIGS. 59 and 60, first and second opposing rectilinear openings 1578 extend through the circular wall 1570 and a portion of the ledge 1558. Further, third and fourth opposing rectilinear openings 1580 also extend through the circular wall 1570 and portions of the ledge 1558. In the present embodiment, the openings 1578 are larger than the openings 1580 and are equidistantly disposed therebetween.

Still referring to FIG. 59, the openings 1578, 1580 extend downwardly toward the lower annular ledge 1572. The lower ledge 1572 is interrupted by two cutout portions 1582 disposed adjacent and beneath the openings 1580 in the circular wall 1570. The lower ledge 1572 is angled downwardly as it extends interiorly.

Figure 64:
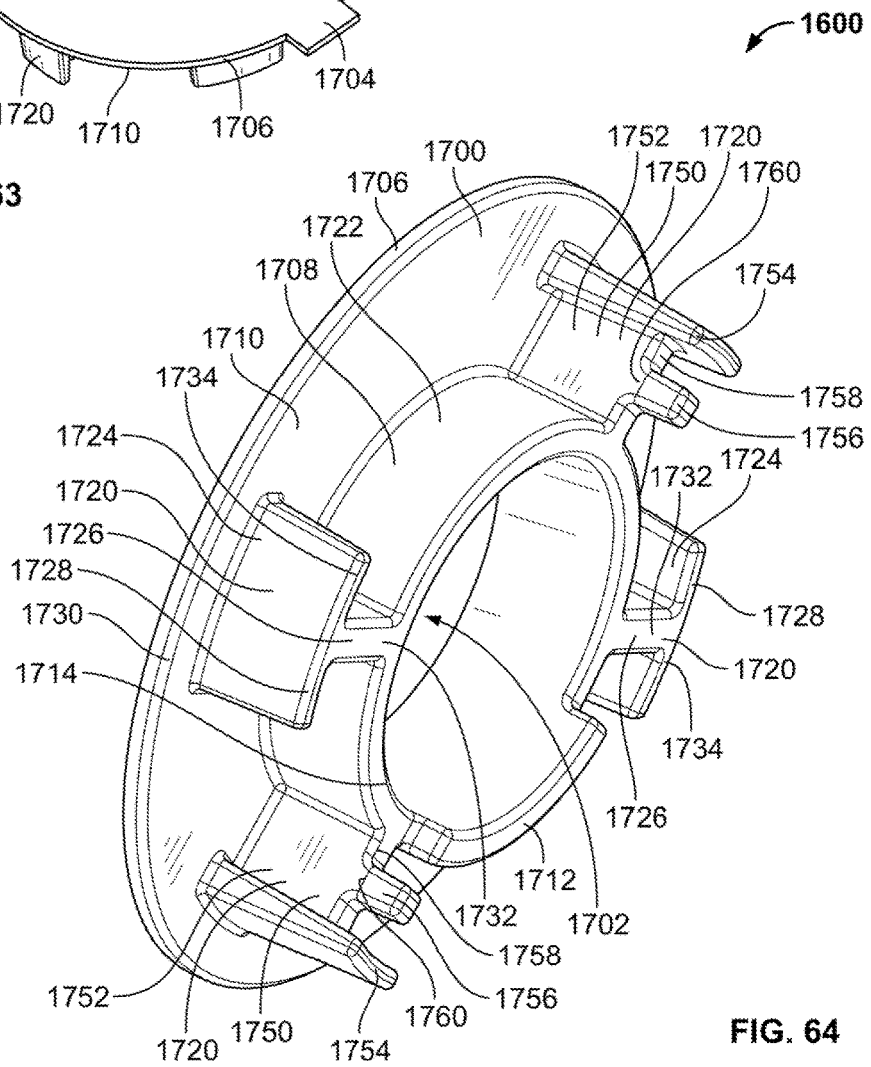
FIG. 64 is a bottom isometric view of the locking element of FIG. 63.
Figure 65:
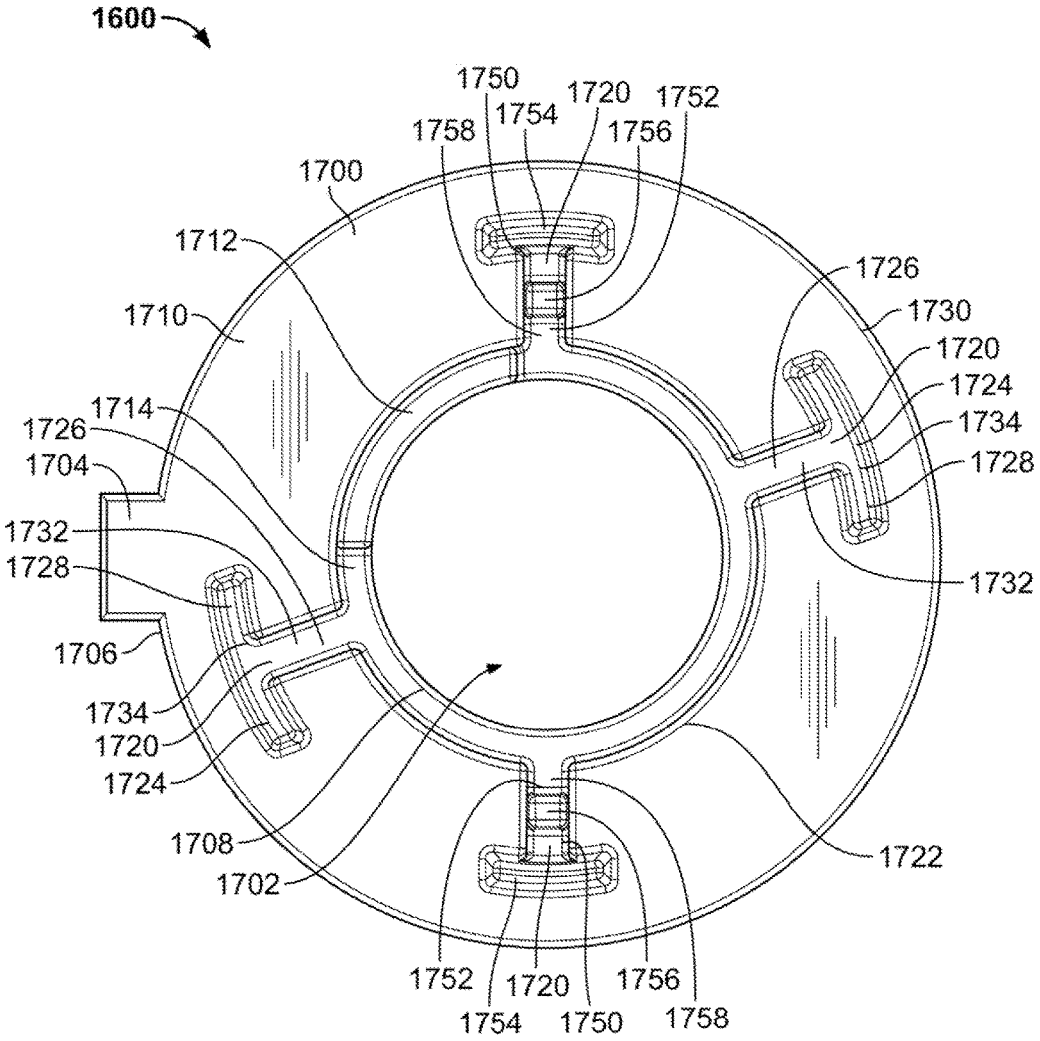
FIG. 65 is a bottom plan view of the locking element of FIG. 63.
Figure 66:
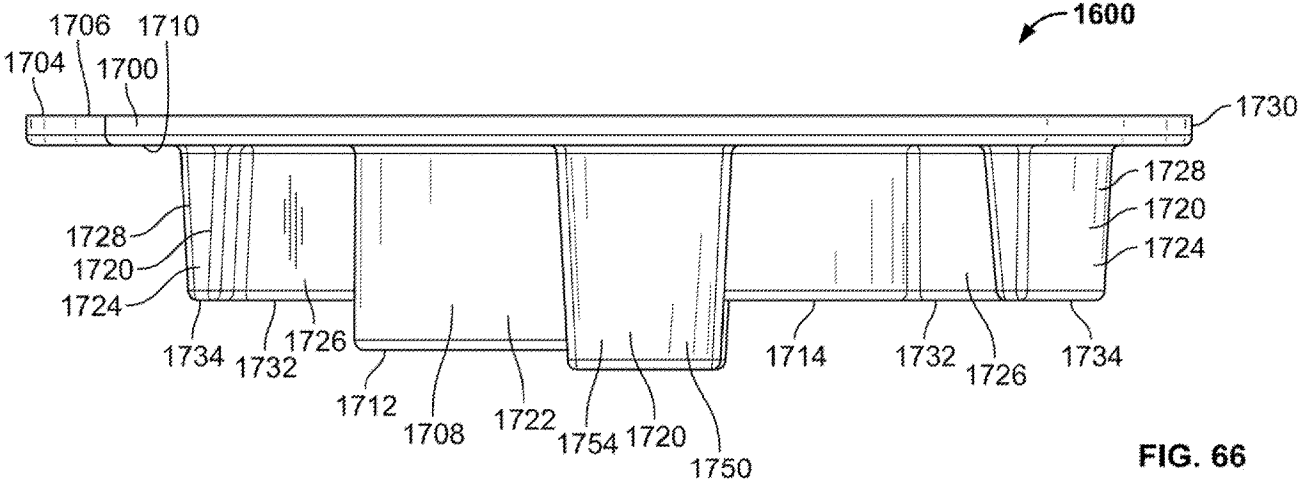
FIG. 66 is a side elevational view of the locking element of FIG. 63.
Figure 67:
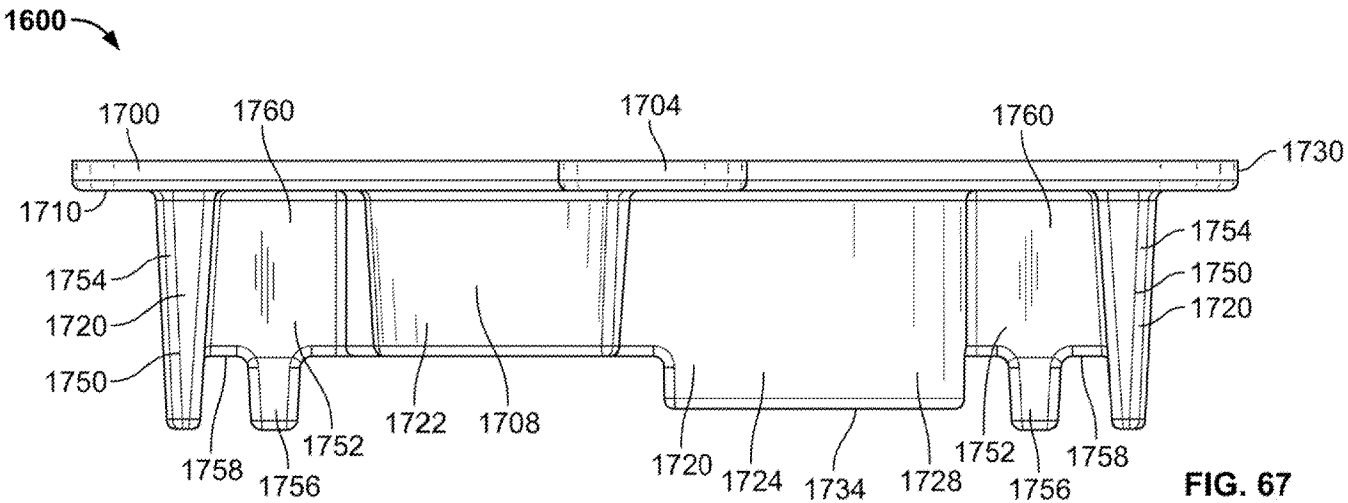
FIG. 67 is another side elevational view of the locking element of FIG. 63.

Now turning to FIGS. 63-67, a locking element 1600 includes a flat circular ring 1700 with a central orifice 1702 disposed therethrough. The locking element 1600 further includes a rectangular tab portion 1704 extending outwardly from a peripheral edge 1706 of the ring 1700. An annular sidewall 1708 extends downwardly from a bottom surface 1710 of the ring 1700 and circumscribes the orifice 1702. As best seen in FIGS. 64 and 66, the sidewall 1708 includes a curved extension member 1712 that extends downwardly from a distal end 1714 of the sidewall 1708 in an area adjacent the tab portion 1704 (see FIGS. 65 and 66).

FIGS. 64 and 65 depict a plurality of T-shaped members 1720 comprising a first pair of T-shaped members 1724 and a second pair of T-shaped member 1750. All of the T-shaped members 1720 extend radially outwardly from an exterior surface 1722 of the sidewall 1708 and downwardly from the bottom surface 1710 of the locking element 1600. In the present embodiment, there are four spaced T-shaped members 1720. The first pair of oppositely disposed T-shaped members 1724 include an elongate wall 1726 that extends from the sidewall 1708. A curved end wall 1728 extends from a distal end of the elongate wall 1726 and is spaced from an outer edge 1730 of the ring 1700 and the exterior surface 1722 of the sidewall 1708. A bottom surface 1732 of the elongate wall 1726 is the same height as a bottom surface 1734 of the end wall 1728.

Still referring to FIGS. 64 and 65, the second pair of oppositely disposed T-shaped members 1750 are provided, which include an elongate wall 1752 that extends from the exterior surface 1722 of the sidewall 1708. A curved end wall 1754 extends from a distal end of the elongate wall 1752 and is spaced from the outer edge 1730 of the rings 1700 and the exterior surface 1722 of the sidewall 1708. A protuberance 1756 extends downwardly from a bottom surface 1758 of each elongate wall 1752 at approximately a midpoint 1760 thereof between the sidewall 1708 and the end wall 1754. A bottom surface of the end wall 1754 extends downwardly to a greater extent than the bottom surface 1758 of the elongate wall 1752 to give the end wall 1754 a greater height.

Figure 68:
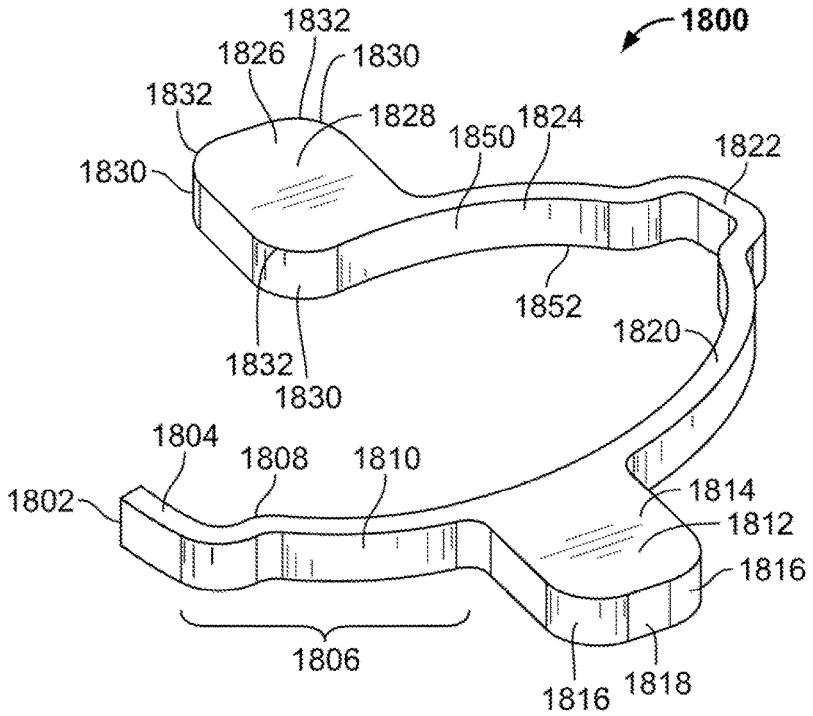
FIG. 68 is a top isometric view of a resilient member adapted for use with the locking element of FIG. 63 and the annular ring of FIG. 57.
Figure 69:
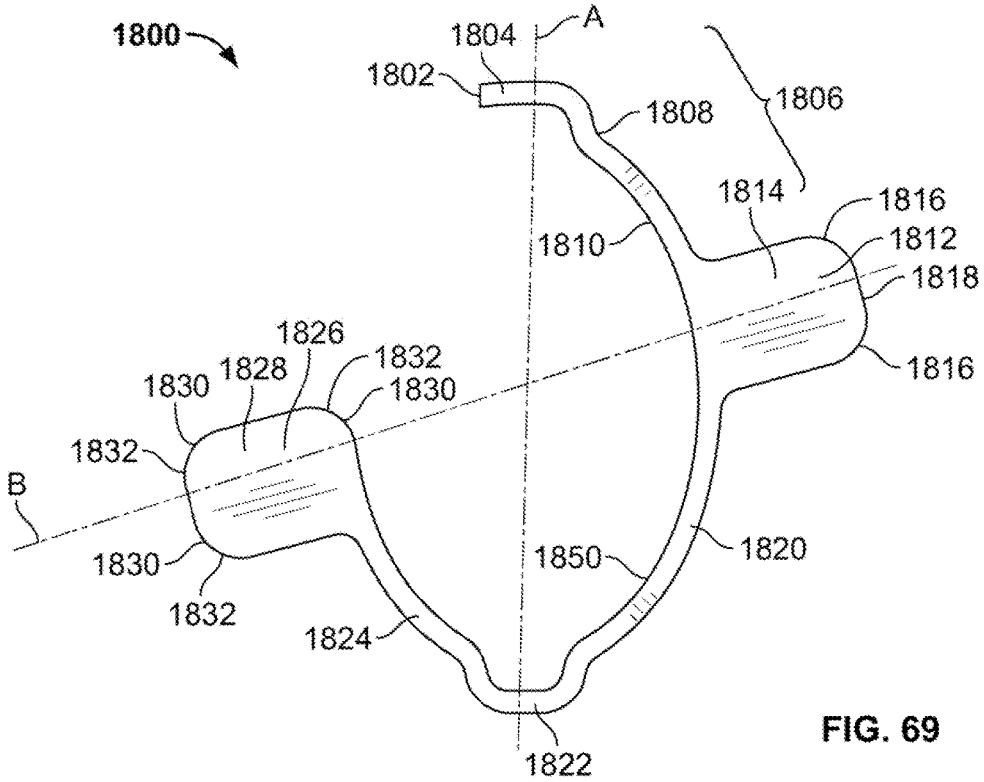
FIG. 69 is a top plan view of the resilient member of FIG. 68.

Now turning to FIGS. 68 and 69, a resilient member 1800 is depicted that is similar to the resilient member 1350 except for the differences noted hereinbelow. The resilient member 1800 is adapted to be partially attached to the locking element 1600. The resilient member 1800 comprises a generally elliptical shape, which is imparted with various curved interruptions and a cutout portion. Particularly, the present embodiment includes a connection end 1802 having a straight portion 1804 and a curved portion 1806 extending therefrom. The curved portion 1806 includes a bent section 1808 and an elongate first bowed portion 1810 extending therefrom. A first wing 1812 extends outwardly from the first bowed portion 1810. The first wing 1812 includes a substantially rectangular body 1814 with curved edges 1816 at an end 1818 thereof. A second bowed portion 1820 extends outwardly from the body 1814 of the first wing 1812 and terminates at a U-shaped curved section 1822. A third bowed portion 1824 similar to the first and second bowed portions 1810, 1820, respectively, extends outwardly from the U-shaped curved section 1822. The third bowed portion 1824 terminates at a second wing 1826 that is similar to the first wing 1812. The second wing 1826 includes a substantially rectangular body 1828 with curved edges 1830 on three corners 1832 thereof. The first and second wings 1812, 1826 are adapted to interact with and extend through portions of the annular ring 1502 shown in FIGS. 57 and 58 as described in more detail hereinbelow.

The resilient member 1800 is preferably made from one or more elastic materials such as those previously discussed above. Indeed, any of the combinations or variations previously discussed in connection with the resilient member 1350 may be used in connection with the resilient member 1800. While a specific shape is discussed with respect to the resilient member 1800, including specific bowed portions, it is contemplated that the resilient member may comprise other shapes and sizes that are adapted to be retained in the locking element 1600.

Figure 70:
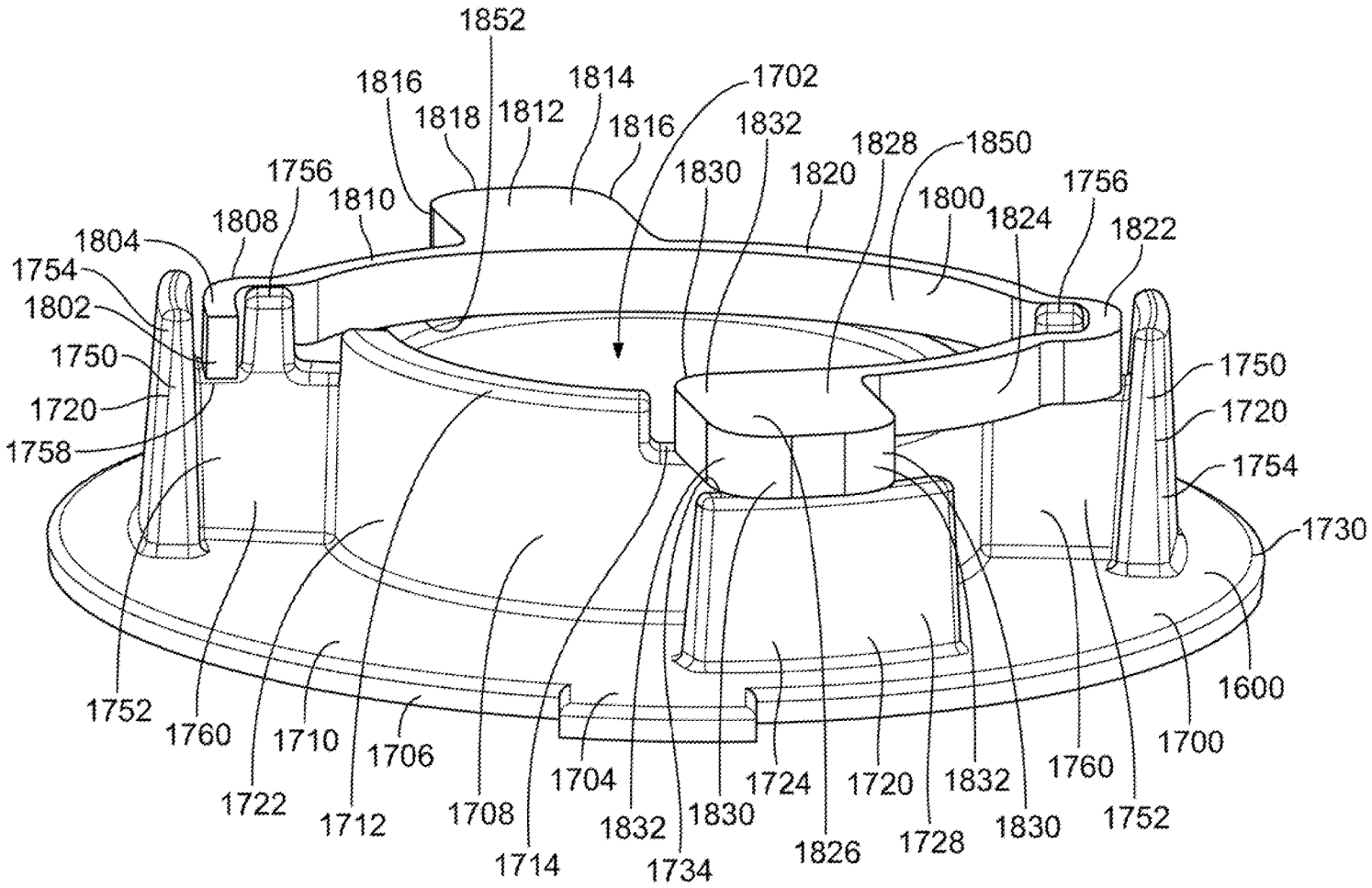
FIG. 70 is an isometric view of the resilient member of FIG. 68 disposed on the locking element of FIG. 63.
Figure 71:
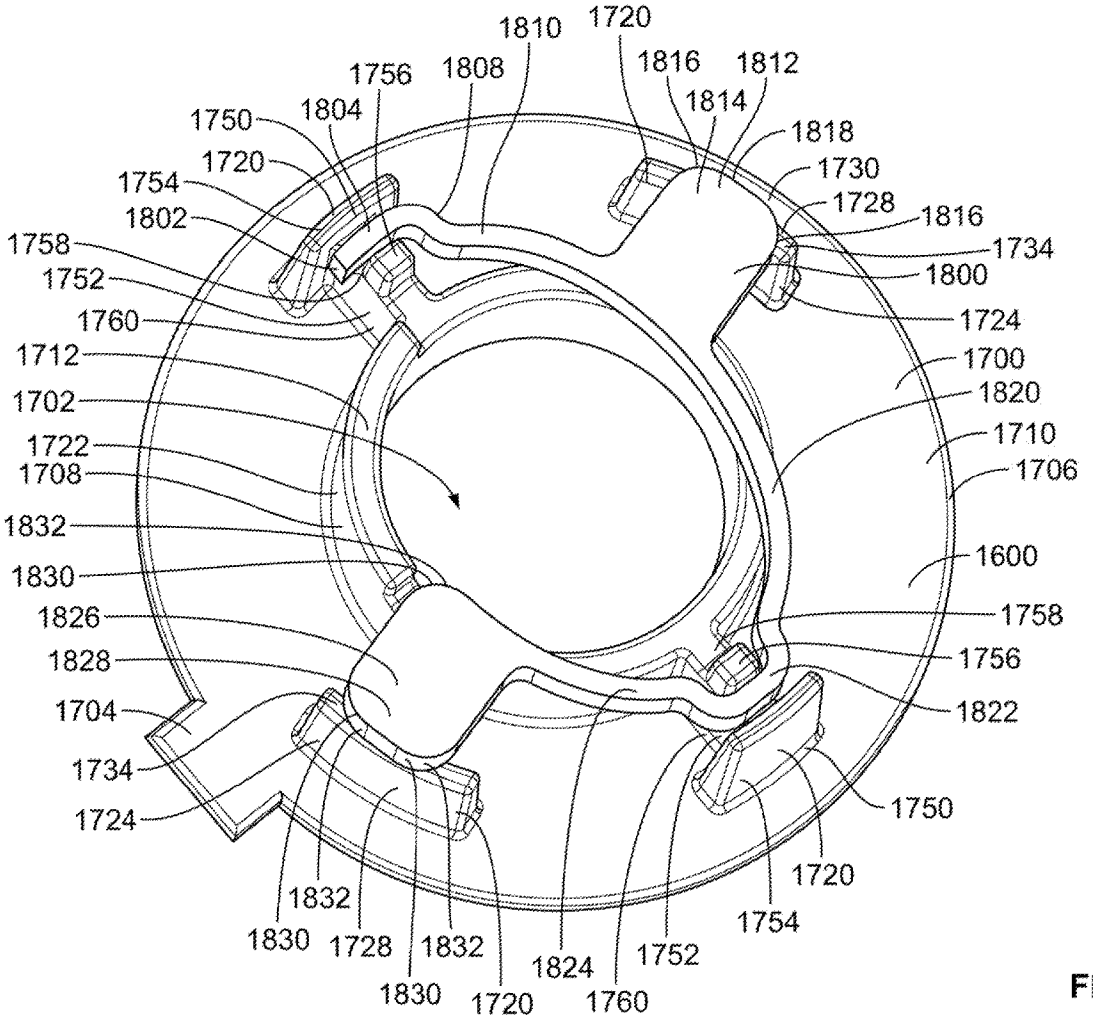
FIG. 71 is a top isometric view of the resilient member of FIG. 68 disposed on the locking element of FIG. 63.

Now turning to FIGS. 70 and 71, the resilient member 1800 is depicted attached to portions of the locking element 1600. The connection end 1802 of the resilient member 1800 is disposed between the end wall 1754 and the protuberance 1756 of one of the T-shaped members 1750. The connection end 1802 rests on the bottom surface 1758 of the elongate wall 1752. The connection end 1802 is retained on the T-shaped member 1750 by one or more of an interference fit between surfaces defining the end wall 1754, protuberance 1756, and the bottom surface 1758, an adhesive, being integrally molded thereto, or any other connection means known to one of ordinary skill.

As best seen in FIG. 71, the bent section 1808 and a part of the first bowed portion 1810 extend outwardly away from the annular sidewall 1708 before the first bowed portion 1810 extends inwardly back toward the annular sidewall 1708 in an area adjacent the elongate wall 1726 of one of the T-shaped members 1724. In this pre-operational state, the body 1814 of the first wing 1812 extends outwardly and is supported, in part, by the elongate wall 1726 and/or the end wall 1728. The end 1818 of the first wing 1812 extends past the end wall 1728, as best seen in FIG. 71. In other embodiments, the first wing 1812 could extend to a greater or lesser degree along the length of the T-shaped member 1724. One of ordinary skill will realize that the radius of curvature of the resilient member 1800 adjacent the T-shaped member 1724 could be modified and/or the size of the first wing 1812 could be modified. Similar modifications could be made to the second wing 1826 or any portion of the resilient member 1800 insofar as the same, or substantially the same, operational functionalities are realized as described hereinbelow. Further, while the present embodiment provides for the placement of portions of a lower surface 1852 of the resilient member 1800 on corresponding surfaces of the sidewall 1708 and T-shaped members 1724, 1750, it is also contemplated that the resilient member 1800 could be held suspended wholly, or in part, above such surfaces.

Turning again to FIGS. 70 and 71, the second bowed portion 1820 of the resilient member 1800 extends away from the T-shaped member 1724 and contacts a portion of the annular sidewall 1708 until extending toward the end wall 1754 of the T-shaped member 1750. The U-shaped section 1822 of the resilient member 1800 extends into and through an area between the end wall 1754 and the protuberance 1756. The U-shaped section may be loosely captured by such portions of the locking element 1600, or may be more positively retained in a manner as discussed in relation to the connection end 1802. The third bowed portion 1824 of the resilient member 1800 extends away from the T-shaped member 1750 toward the other T-shaped member 1724. The body 1828 of the second wing 1826 extends outwardly and is supported, in part, by the elongate wall 1726 and/or the end wall 1728 of the other T-shaped member 1724.

Figure 72:
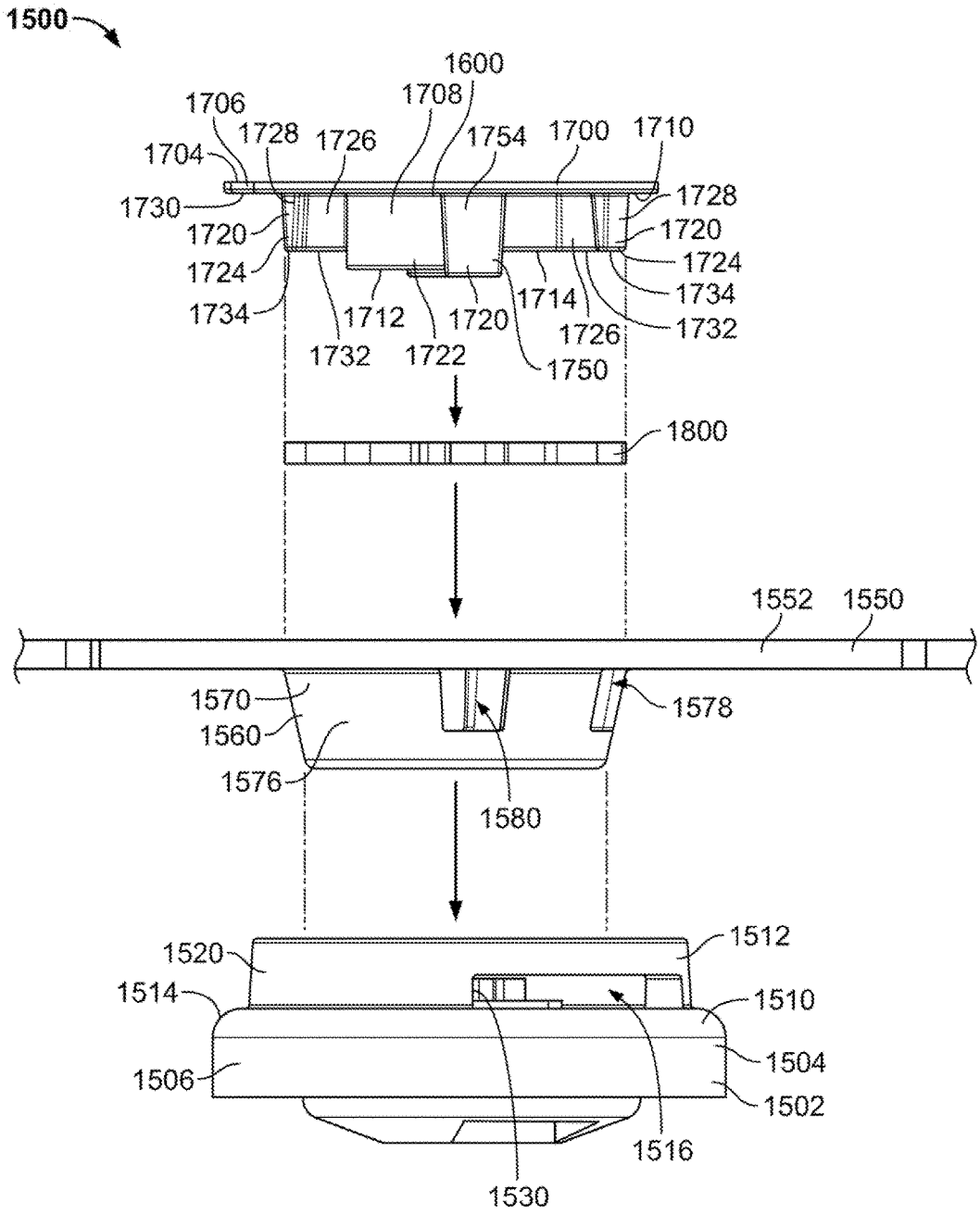
FIG. 72 is an exploded view of the resilient member of FIG. 68, the locking element of FIG. 63, the base of FIG. 59, and the annular ring of FIG. 57.

In use, the annular ring 1502, the base 1550, the locking element 1600, and the resilient member 1800 of the attachment mechanism 1500 must be utilized in conjunction with one another to lock the overcap 104 onto the container 106, 106'. Similar to previous embodiments, the annular ring 1502 attaches to a portion of the mounting cup of a container. As best seen in FIG. 72, the locking element 1600 with the resilient member 1800 attached thereto is disposed within the opening 1564 of the base 1550. More specifically, when the locking element 1600 is seated within the locking member 1560 of the base 1550, the curved end walls 1728 of the T-shaped members 1724 (see FIG. 71) are disposed within the rectilinear openings 1578 of the circular wall 1570 (see FIG. 59). Similarly, the curved end walls 1754 of the T-shaped members 1750 (see FIG. 71) are disposed within the rectilinear openings 1580 of the circular wall 1570 (see FIG. 59).

Referring again to FIG. 72, the annular ring 1502 is inserted into the base 1550 by aligning the two flanges 1524 of the annular ring 1502 adjacent the two cutout portions 1582 of the lower ledge 1572. Proper alignment allows for the movement of one or more of the container and overcap toward one another and the insertion of the flanges 1524 through the cutout portions 1582 and into the opening 1564 of the locking member 1560. Improper alignment will preclude the insertion of the annular ring 1502 into the locking member 1560 and locking element 1600.

Figure 73:
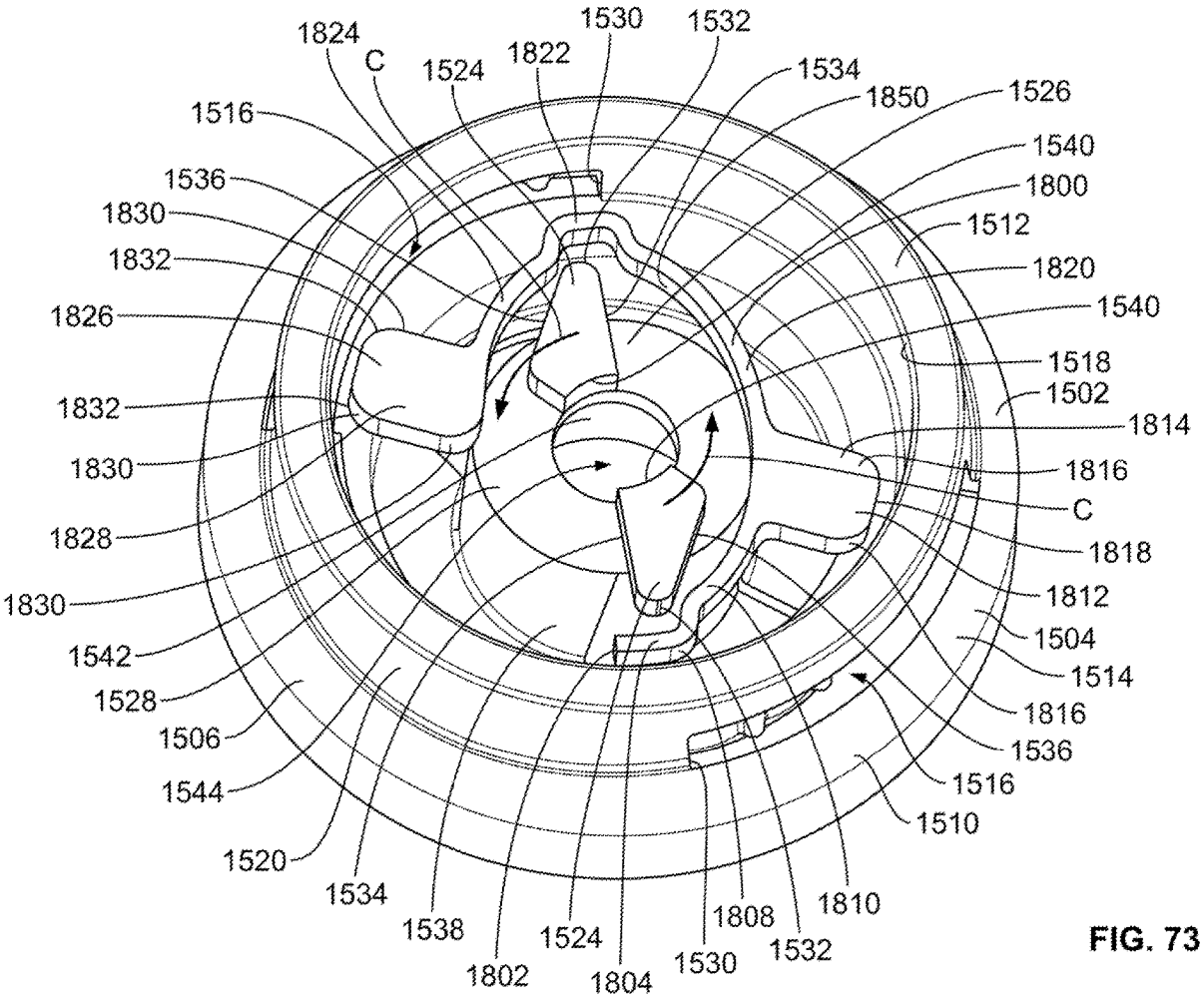
FIG. 73 is a top isometric view of the annular ring of FIG. 57 in a first, or unlocked position.

In a first or unlocked position, such as shown in FIG. 73, wherein the locking element 1600 has been moved for purposes of clarity, the flanges 1524 extend toward the connection end 1802 and the end section 1822 of the resilient member 1800. In this position, the flanges 1524 are in substantial alignment with a major axis A of the resilient member 1800 (see FIG. 69). FIG. 73 also illustrates how the flanges 1524 do not touch portions of the resilient member 1800. However, it is anticipated that in other embodiments that one or more of the flanges 1524 could incidentally touch or, alternatively, exert pressure upon portions of the resilient member 1800 in this position.

Figure 74:
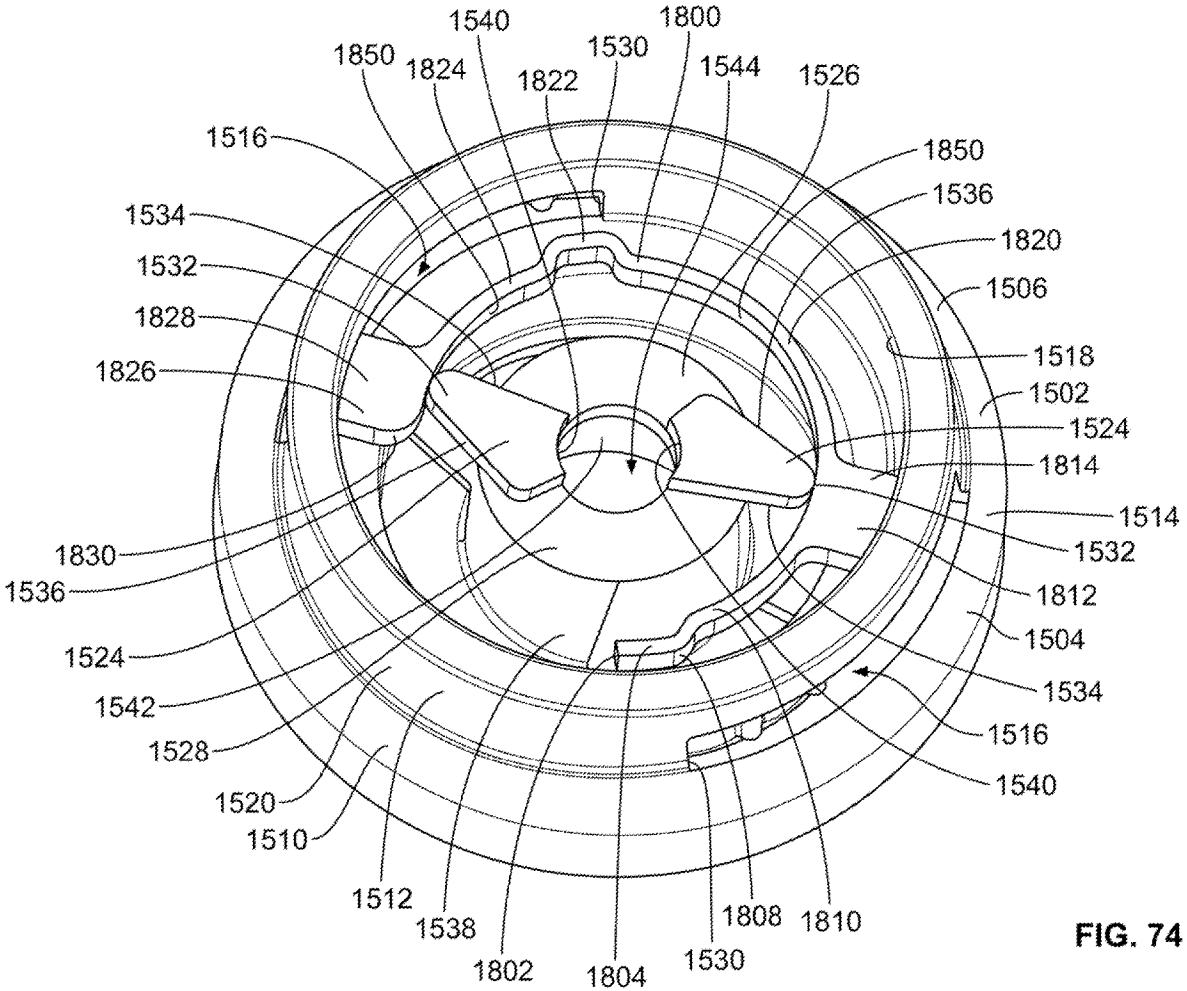
FIG. 74 is top isometric view of the annular ring of FIG. 57 in a second, or locked position flexing the resilient member of FIG. 68 outwardly.

In the present embodiment, the overcap is turned in a clockwise direction and/or the container 106 is turned in a counterclockwise direction as depicted by the arrows C in FIG. 73. Upon rotating the container, the rounded tips 1532 and/or the first sides 1534 of the flanges 1524 contact an inner surface 1850 of the resilient member 1800 (see FIG. 74). Continued movement causes the deformation of the first and second wings 1812, 1826. In the present embodiment, the wings 1812, 1826 flex outwardly toward the annular riser 1512 of the annular ring 1502. Movement of the wings 1812, 1826 is facilitated by the bottom surface 1732 of the elongate wall 1726 and the bottom surface 1734 of the end wall 1728, which provide a lower bounded limit to the resilient member 1800 and facilitate substantial flexing thereof. The flexing of the first and second wings 1812, 1826 causes at least distal ends thereof to extend toward and through the elongate slots 1516 disposed within the annular riser 1512, such as shown in FIG. 74. Such radially outward movement is also facilitated by the curved extension member 1712, which further acts as a boundary to movement of the second wing 1826. Whether the first and second wings 1812, 1826 wholly or partially extend through the elongate slots 1516, the wings 1812, 1826 should extend a distance far enough to securely engage the overcap to the container.

It should be noted that while the base 1550, the locking element 1600, and the resilient member 1800 are shown as separate components, each is preferably attached to one another during the manufacturing process. Particularly, it is intended that the assembly of the aforementioned components be accomplished prior to use by an end user. More particularly, it is intended that the above-noted structure be provided in an overcap or other dispensing mechanism prior to use by a consumer. In one embodiment, a consumer need only attach a container with a corresponding annular ring 1502 to the overcap or dispensing mechanism.

Now turning to FIGS. 75-83, an eighth embodiment of an attachment mechanism 1890 is shown. The attachment mechanism 1890 is adapted to be used with the annular ring 1502 depicted in FIGS. 57 and 58. The remainder of the attachment mechanism 1890 is substantially similar to the attachment mechanism 1500, wherein differences between the two attachment mechanisms are described in further detail below.

Figure 76:
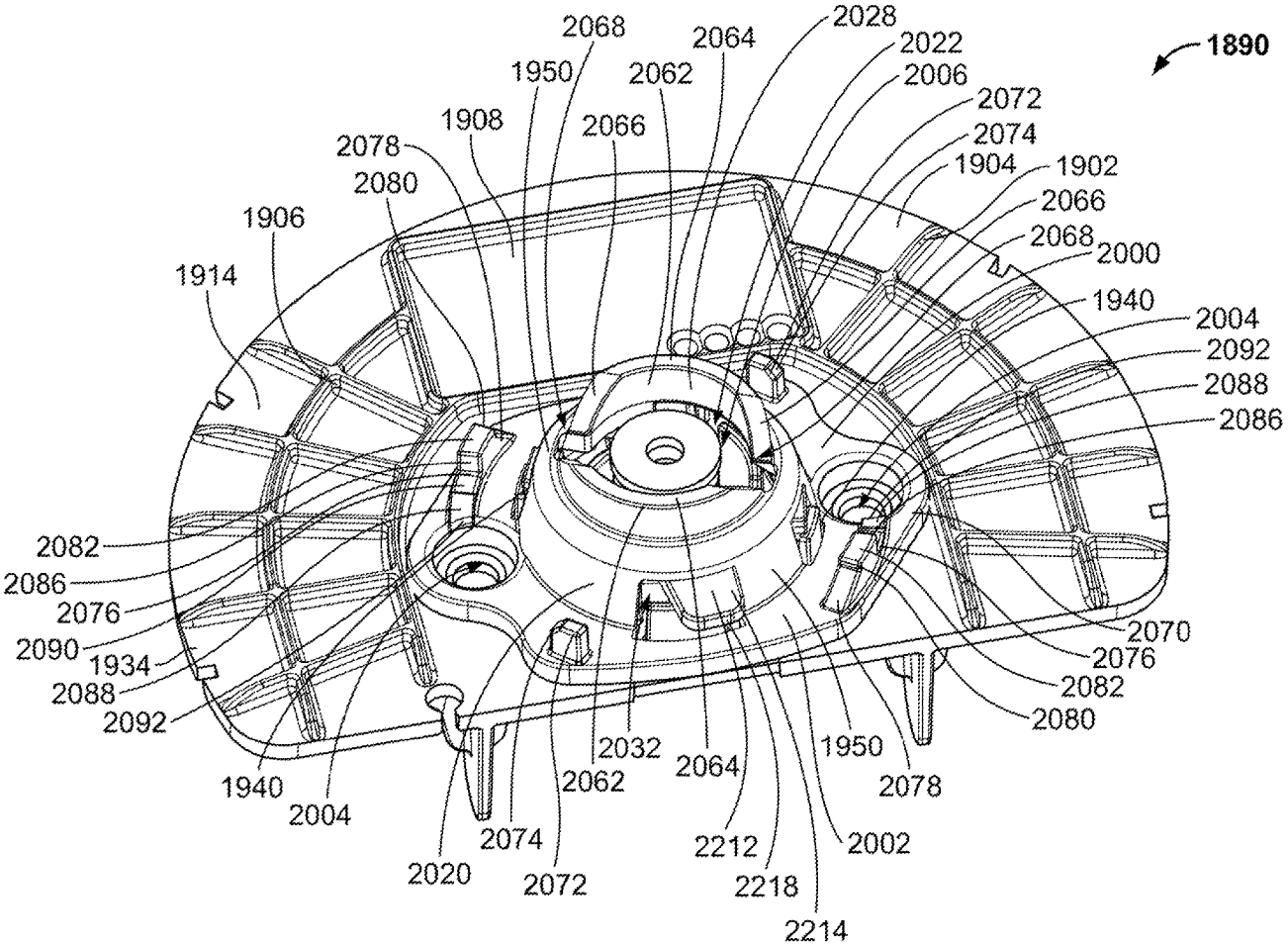
FIG. 76 is a bottom isometric view of the base of FIG. 75 further including a locking element extending therefrom.

As best seen in FIG. 76, a base 1902 includes a substantially flat wall 1904 attached to the overcap (not shown), which is interrupted with ribbing 1906 and a rectangular portion 1908 adjacent a periphery of the base 1902. A locking member 1910 is also provided, which is similar to the locking element 1600 of FIGS. 63-67. The locking member 1910 includes an annular sidewall 1912 that extends downwardly from a bottom surface 1914 of the base 1902. A central orifice 1916 extends through the annular sidewall 1912. Opposing curved extension members 1918 extend downwardly from a distal end 1920 of the sidewall 1912. Further, two-rectilinear walls 1922 protrude outwardly from an exterior surface 1924 of the sidewall 1912 adjacent the curved extension members 1918.

Figure 75:
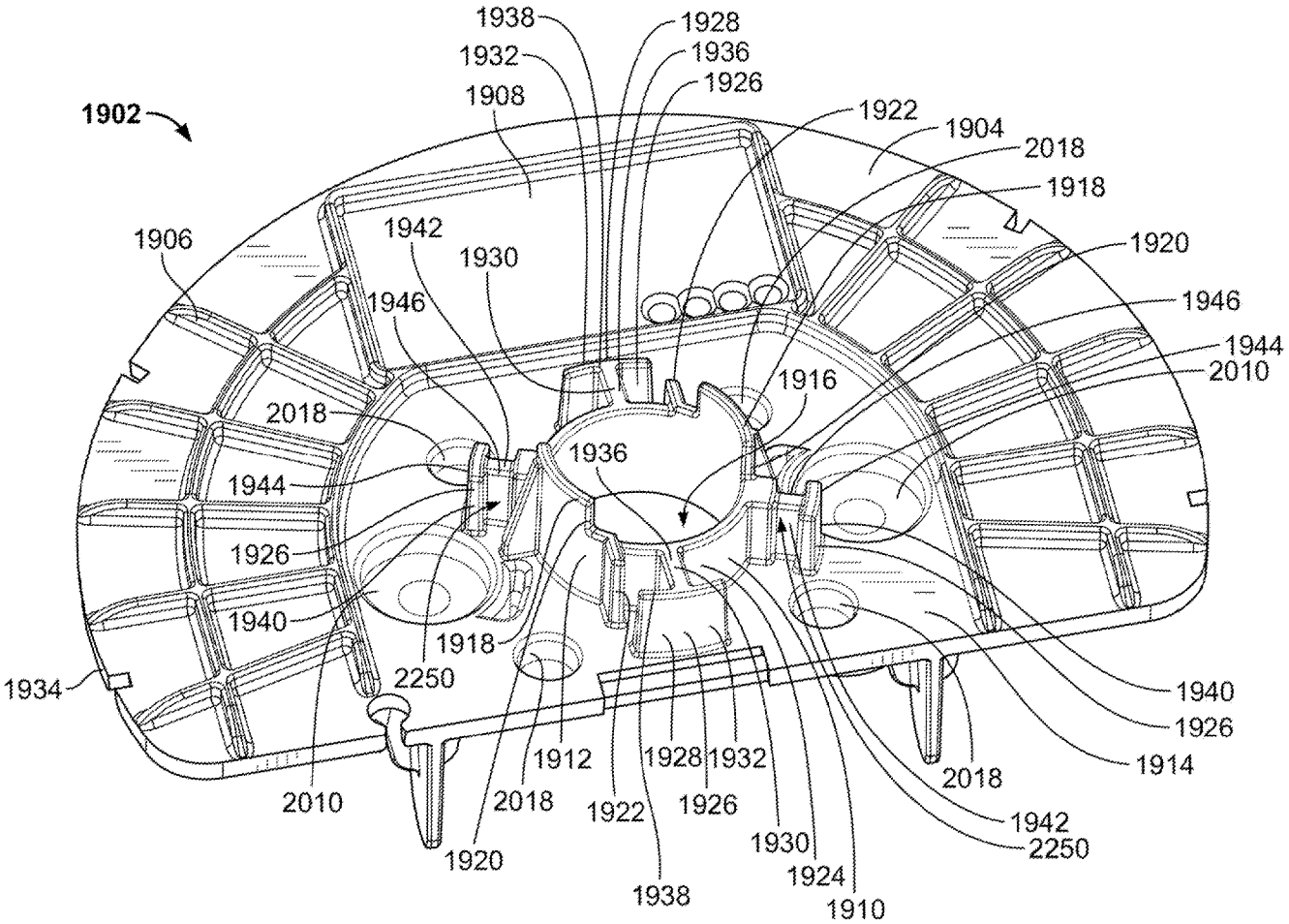
FIG. 75 is a bottom isometric view of an eighth embodiment of a base adapted for use with the annular ring of FIG. 57.

Still referring to FIG. 75, a plurality of T-shaped members 1926 extend radially outwardly from the exterior surface 1924 of the sidewall 1912 and downwardly from the bottom surface 1914 of the base 1902. In the present embodiment, there are four spaced T-shaped members 1926, wherein the T-shaped members 1926 are defined by a first pair of oppositely disposed-shaped members 1928 and a second pair of T-shaped members 1940. The first pair of T-shaped members 1928 includes an elongate wall 1930 that extends from the sidewall 1912. A curved end wall 1932 extends from a distal end of the elongate wall 1930 and is spaced from an outer edge 1934 of the base 1902 and the exterior surface 1924 of the sidewall 1912. A bottom surface 1936 of the elongate wall 1930 is the same height as a bottom surface 1938 of the end wall 1932.

The second pair of oppositely disposed T-shaped members 1940 includes an elongate wall 1942 that extends from the exterior surface 1924 of the sidewall 1912. A curved end wall 1944 extends from a distal end of the elongate wall 1942 and is similarly spaced from the outer edge 1934 of the base 1902 and the exterior surface 1924 of the sidewall 1912. A medial portion 1946 of the elongate wall 1942 is provided with a smaller cross-section than a portion of the elongate wall 1942 adjacent the exterior surface 1924 of the sidewall 1912.

As best seen in FIG. 76, a locking element 1950 is releasably attached to the base 1902 via screws (not shown). The present locking element 1950 is substantially similar to the locking member 1560 of the previously described embodiment. In another embodiment, the locking element 1950 is integrally formed with and extends downwardly from the base 1902. In still another embodiment, an adhesive or other connection means known to one of ordinary skill is used to connect the locking element 1950 and the base 1902.

Figure 78:
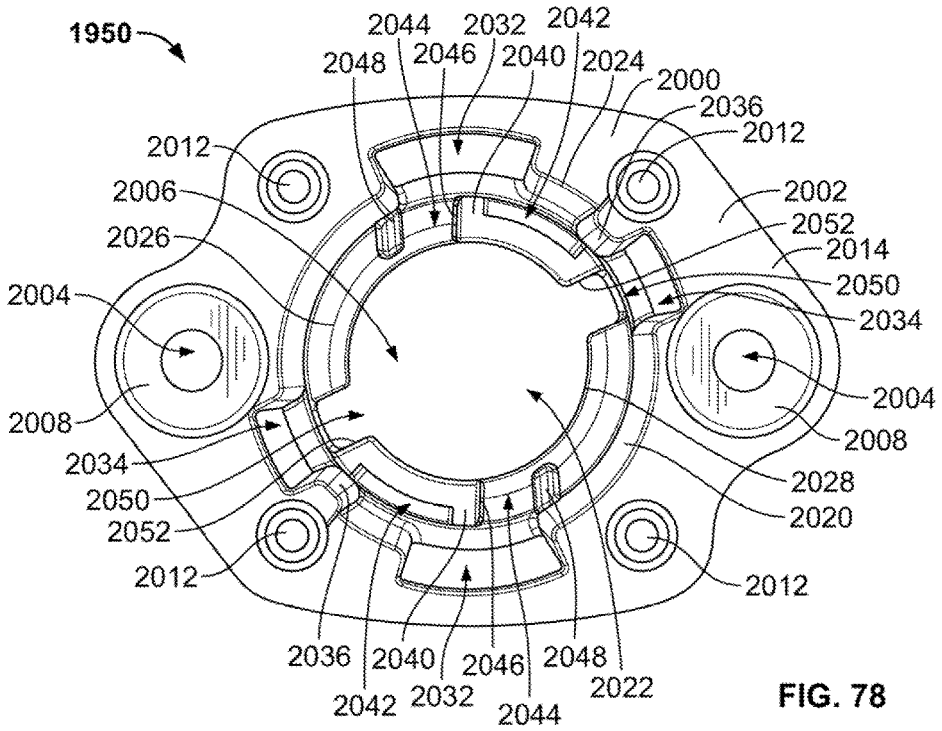
FIG. 78 is a top plan view of the locking element of FIG. 76.
Figure 79:
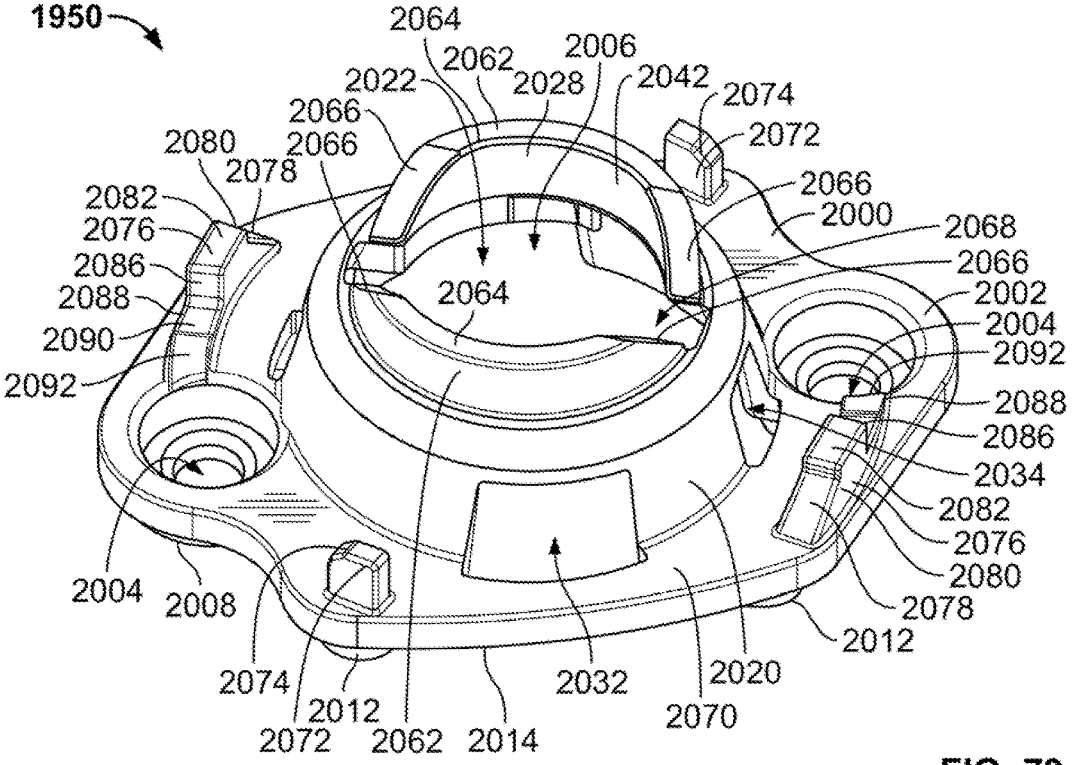
FIG. 79 is a bottom isometric view of the locking element of FIG. 76.

Now turning to FIGS. 77-79, the locking element 1950 is shown with greater particularity. Turning to FIGS. 77 and 78, the locking element 1950 includes a body 2000 having a substantially flat wall 2002. A plurality of apertures 2004 extend through the wall 2002 and are disposed on opposing sides of an orifice 2006. In the present embodiment, there are two apertures 2004 for receiving screws (not shown) to mount the locking element 1950 to the base 1902, as noted above. The apertures 2004 extend through opposing raised cylindrical pedestals 2008, which are sized to fit within corresponding circular recesses 2010 of the base 1902 (see FIG. 76). Turning again to FIGS. 77-79, a plurality of raised circular locating projections 2012 are shown extending upwardly from a top surface 2014 of the wall 2002 and are disposed adjacent the apertures 2004. In the present embodiment, four projections 2012 are provided for receipt within corresponding circular apertures 2018 in the base 1902 (see FIG. 76).

Referring to FIG. 77, the body 200 includes a circular sidewall 2020 that extends downwardly therefrom and defines an orifice 2022. The sidewall 2020 extends from an edge 2024 and terminates at a lower ledge 2026. The lower ledge 2026 extends interiorly and away from the sidewall 2020. A lower sidewall 2028 extends downwardly from the lower ledge 2026 (see FIG. 79). The circular sidewall 2020 and structure associated therewith are sized to be received within the space 1566 of the annular ring 1502.

Referring again to FIGS. 77 and 78, first and second opposing rectilinear openings 2032 extend through the sidewall 2020. Further, third and fourth opposing rectilinear openings 2034 also extend through the sidewall 2020. In the present embodiment, the first and second openings 2032 are larger than the third and fourth openings 2034. The sidewall 2020 is also interrupted by two curved walls 2036 that extend outwardly therefrom in areas directly below the two locating projections 2038.

As best seen in FIG. 77, the lower ledge 2026 includes two flat portions 2040. The flat portions 2040 include a curved rectilinear recess 2042 formed therein. A gap 2044 is formed between a first end 2046 of each of the flat portions 2040 and a triangular-shaped ridge 2048 extending outwardly from a truncated portion of the lower ledge 2026. A notch 2050 is formed adjacent a second end 2052 of each of the flat portions 2040 directly below the smaller openings 2034. The truncated portions of the lower ledge 2026 comprise a tapered portion 2054 that tapers downwardly from the first end 2046 to a distal end 2056 and from an edge 2058 adjacent the sidewall 2020 toward an interior edge 2060.

As best seen in FIG. 79, the lower sidewall 2028 comprises two curved walls 2062. The curved walls 2062 have a substantially flat edge 2064 and two sloped end portions 2066. A V-shaped opening 2068 is formed between the end portions 2066 of the curved walls 2062. Still referring to FIG. 79, an underside 2070 of the wall 20012 includes two opposing guide posts 2072 extending outwardly therefrom. The guide posts 2072 include a sloped edge 2074. The guide posts 2072 provide a guiding function and prevent the overcap 104 from being rotated in the incorrect direction. Two opposing stop members 2076 are also disposed on the underside 2070 of the wall 2002. The stop members 2076 include a sloped end 2078 that extends away from the underside 2070 and that terminates at a vertical wall 2080. The vertical wall 2080 extends upwardly and ends at a flat apex 2082, which extends away from the sloped end 2078 toward an end wall 2086. The end wall 2086 extends downwardly from the apex 2082 and terminates at a raised claw member 2088. The claw member 2088 forms an anti-rotation segment defined by a small horizontal wall 2090 and an angled end wall 2092.

Figure 80:
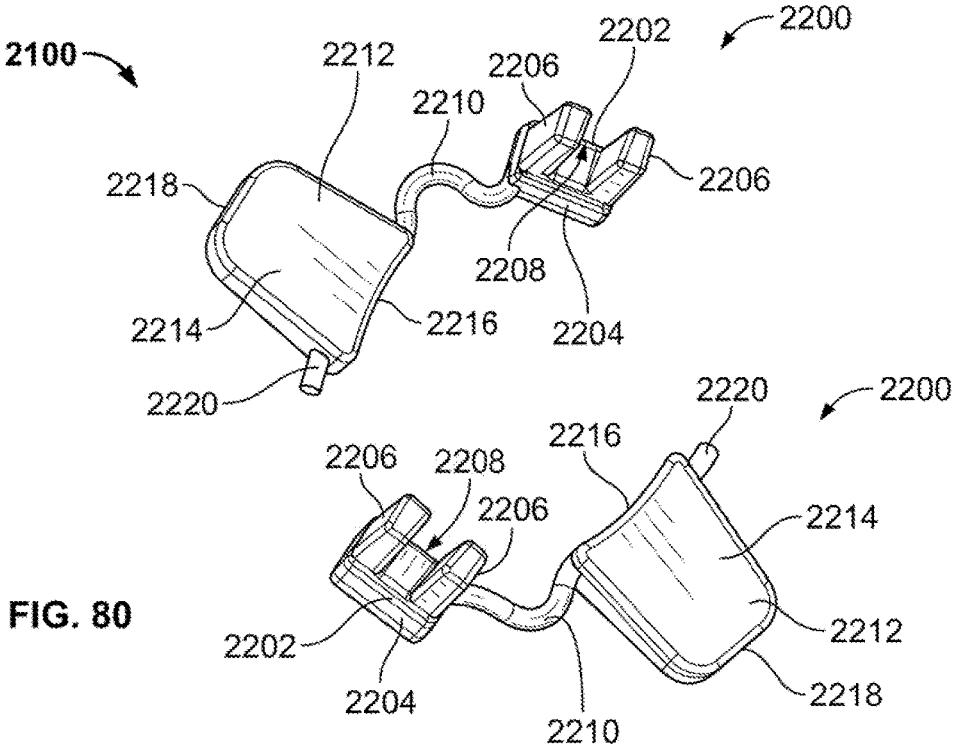
FIG. 80 is an isometric view of a resilient member.

Now turning to FIG. 80, a resilient member 2100 is depicted, which is adapted for use with the presently disclosed locking member and element 1910, 1950, respectively, and the annular ring 1502 depicted in FIGS. 57 and 58. The resilient member 2100 is similar to the resilient members of previous embodiments and may be formed from any of the previously noted materials or modified in any manner previously described. The resilient member 2100 includes two locking spring components 2200 comprising a rigid connector end 2202. Each connector end 2202 includes a flat base portion 2204 with two upstanding vertical walls 2206, which create a gap 2208 therebetween. A flexible member 2210 in the form of a wire extends outwardly from each connector end 2202. The flexible member 2210 preferably provides a pivot point or area of flexure for the resilient member 2100. A wing member 2212 is attached to the flexible member 2210. The wing member 2212 includes a substantially rectangular body 2214 having a slightly curved bottom wall 2216 and top wall 2218. An end segment 2220 extends outwardly from the rectangular body 2214 and comprises a portion of the flexible member 2210. Preferably, the flexible member 2210 is embedded into and extends through the wing member 2212.

While various materials were previously noted as being capable of use in connection with any of the disclosed embodiments, the present embodiment preferably uses a resilient metallic material for the flexible member 2210 and a thermoplastic material for the connector ends 2202 and the wing members 2212. Types of metallic materials contemplated for use include, for example, music wire, spring steel, and the like. In other embodiments, the entire resilient member 2100 may comprise the metallic material or, conversely, a thermoplastic material.

Figure 81:
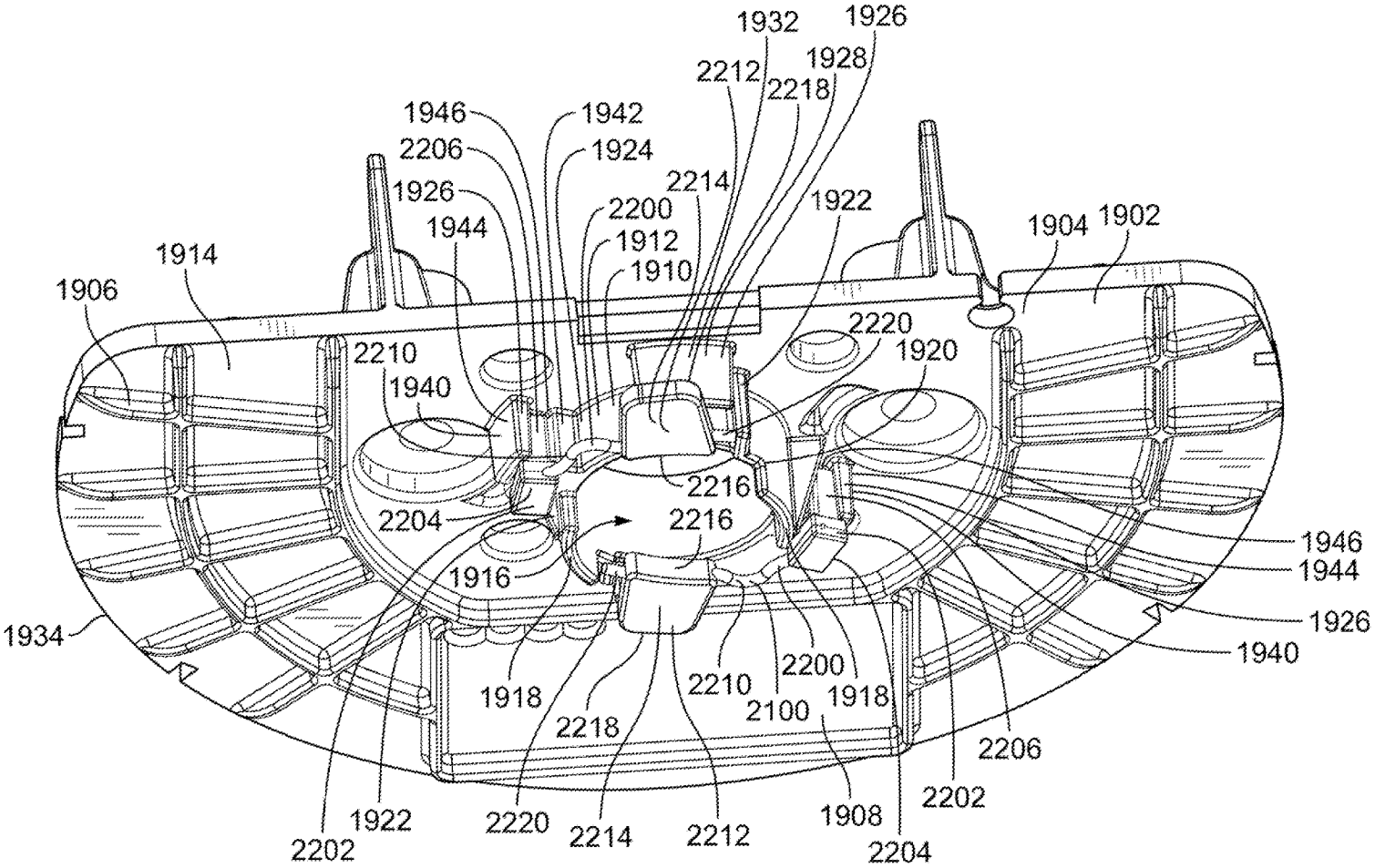
FIG. 81 is a bottom isometric view of the base of FIG. 75 with the resilient member of FIG. 80 attached thereto.

Now turning to FIGS. 76 and 81, the connector ends 2202 of the resilient member 2100 are shown captured between the locking member 1910 and the locking element 1950. Specifically, the connector ends 2202 of the resilient member 2100 are attached to the T-shaped members 1940 adjacent the medial portions 1946 (see FIG. 81). The medial portions 1946 have a narrowed cross-section, which form gaps 2250 (see FIG. 75) for receipt of the connector ends 2202. The connector ends 2202 are preferably press-fit into the gaps 2250. In other embodiments the connector ends 2202 are connected to the T-shaped members 1940 by integrally molding them thereto, adhering them, or in any other manner known to one of ordinary skill. Further, it is also contemplated that surfaces defining the locking member 1910 and locking element 1950 may capture the connector ends 2202 therebetween (see FIG. 76) alone or in combination with one or more of the above-noted connection means.

As previously noted, the locking element 1950 is received by the base 1902. Turning to FIG. 77, the cylindrical pedestals 2008 and the locating projections 2012 are depicted, which are adapted to be received within the circular recesses 2010 and the circular apertures 2018 of the base 1902 shown in FIG. 75. The assembly of the locking element 1950 and the base 1902 may best be seen in FIGS. 75, 76, 82, and 83. Assembly of the locking element 1950 and the base 1902 also causes the first and second pairs of T-shaped members 1928, 1940 (see FIG. 76) to be disposed within the first and second rectilinear openings 2032 and the third and fourth rectilinear openings 2034 of the sidewall 2020 of the locking element 1950 (see FIG. 77), respectively. Further, assembly of the locking element 1950 and the base 1902 causes the locking member 1910 to be seated within the locking element 1950. FIG. 76 provides an illustration of the assembly of the locking element 1950 to the base 1902 to better see the positioning of the T-shaped members 1928, 1940 within the openings 2032, 2034.

In this pre-operational state, the wing members 2212 are supported, in part, by the elongate walls 1930, 1942 and/or the end walls 1932, 1944. Distal portions 2252 of the wing members 2212 extend past the end walls 1932, 1944, as best seen in FIG. 81. In other embodiments, the wing members 2212 could extend to a greater or lesser degree along the length of the T-shaped members 1928. One of ordinary skill will realize that the radius of curvature of the locking spring components 2200 adjacent the T-shaped members 1928 could be modified and/or the size of the wing members 2212 could be modified. Further, while the present embodiments provide for the placement of portions of a lower surface 2253 of the resilient member 2100 on corresponding surfaces of the sidewall 2020 and T-shaped members 1928, it is also contemplated that the resilient member 2100 could be held suspended wholly, or in part, above such surfaces.

Figure 82:
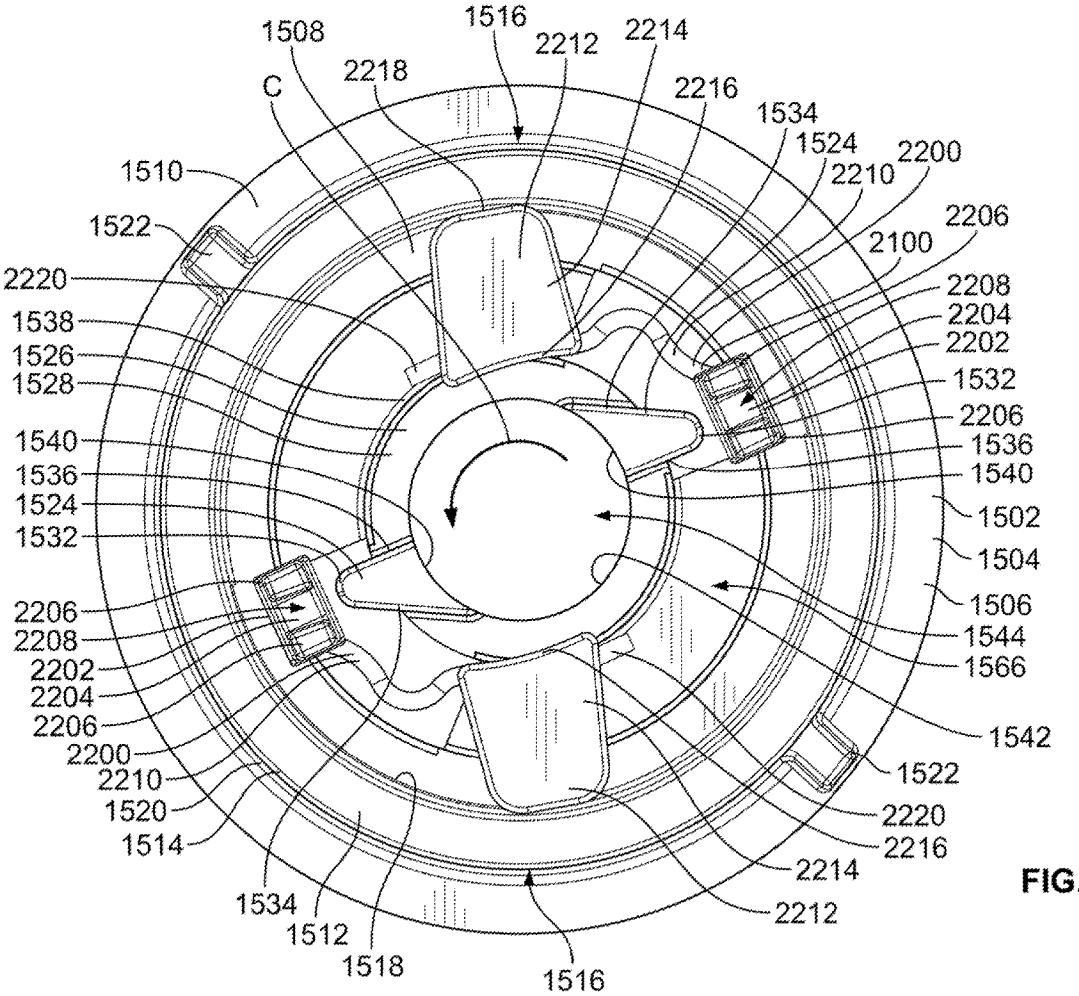
FIG. 82 is a top plan view of the annular ring of FIG. 57 disposed within the locking element of FIG. 76 in a first, or unlocked position, wherein the annular ring is not touching the resilient member.

Turning to FIG. 82, securement of the container 106 to the overcap 104 will be described. The container 106, which includes the annular ring 1502 mounted thereto, is positioned adjacent the circular opening 2006 of the locking element 1950, which is adapted to receive portions of the pedestal and/or valve stem/valve assembly of the container (not shown). The sidewall 2020 of the locking element 1950 is appropriately dimensioned to fit within the space 1566 of the annular ring 1502. Proper alignment allows for the movement of one or more of the container and overcap toward one another and the insertion of the flanges 1524 of the annular ring 1502 through the V-shaped openings 2068 of the lower sidewall 2028. The lower sidewall 2028 therefore provides a guiding function to appropriately align the flanges 1524 for proper insertion. Continued movement forces the flanges 1524 through the notches 2050 beneath the V-shaped openings 2068 and into position adjacent the resilient member 2100.

In a first or unlocked position, such as shown in FIG. 82, the flanges 1524 extend toward the connector ends 2202. FIG. 82 also illustrates how the flanges 1524 do not touch portions of the resilient member 2100. However, it is anticipated that in other embodiments that one or more of the flanges 1524 could incidentally touch or, alternatively, exert pressure upon portions of the resilient member 2100 in this position.

Figure 83:
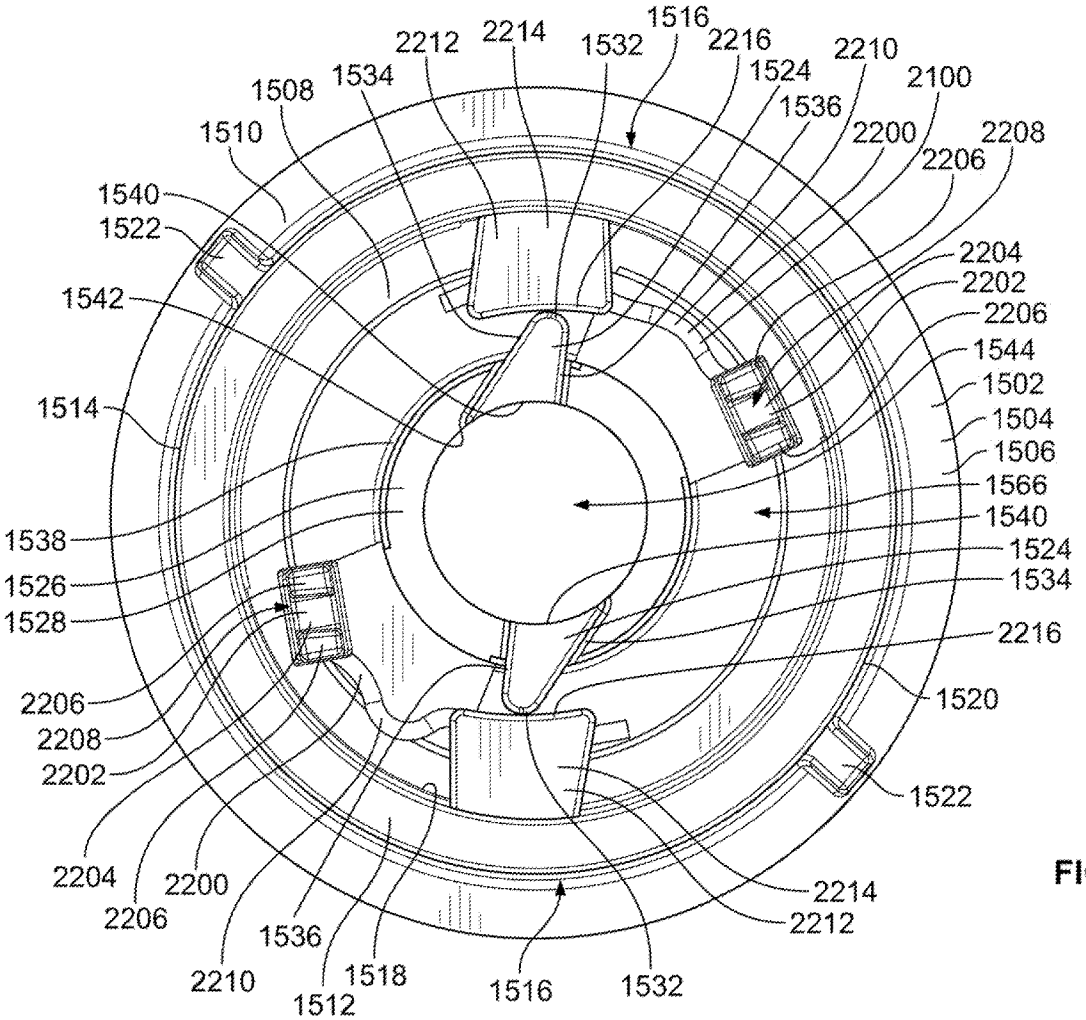
FIG. 83 is a top plan view of the annular ring of FIG. 57 disposed within the locking element of FIG. 76 in a second, or locked position, wherein the annular ring forces the resilient member outwardly.

In the present embodiment, the overcap is turned in a counter-clockwise direction and/or the container 106 is turned in a clockwise direction as depicted by the arrows C in FIG. 82. Upon rotating the container, the rounded tips 1532 and/or the first sides 1534 of the flanges 1524 contact the curved bottom walls 2216 of the wing members 2212. Continued movement causes the deformation of the flexible members 2210, which in turn causes radially outward movement of the wing members 2212. In the present embodiment, the wing members 2212 flex outwardly through the first and second rectilinear openings 2036 and toward the annular riser 1512 of the annular ring 1502. Further rotation causes the wing members 2212 to flex outwardly through the elongate slots 1516 of the annular riser 1512. Movement of the wing members 2212 is facilitated by the bottom surfaces 1936 of the elongate walls 1930 and the bottom surfaces 1938 of the end walls 1932, which provide a lower bounded limit to the wing members 2212 and facilitate substantial flexing thereof. The flexing of the wing members 2212 causes at least distal ends thereof to extend toward and through the elongate slots 1516 disposed within the annular riser 1512, such as shown in FIG. 83, which places the attachment mechanism 2000 in a second or operational state. Such radially outward movement is also facilitated by the curved extension members 1918, which further act as a boundary to movement of the flexible members 2210 and assist in constraining flexure substantially to the wing members 2212 toward the elongate slots 1516. Whether the wing members 2212 wholly or partially extend through the elongate slots 1516, the wing members 2212 should extend a distance far enough to securely engage the overcap to the container.

Similar to other embodiments herein, the dimensioning of the various components of the attachment mechanism are relevant to realizing some of the advantages presented herein. Specifically, the flange(s) are preferably sized to generate enough rotational force to press the resilient member outwardly into the slots formed in the annular ring. It should be apparent that the attachment mechanism connection is aided by slots that are appropriately sized to receive portions of the resilient member without allowing the resilient member to disengage therefrom. Further, the flanges must be small enough to fit into the locking member/locking elements as discussed herein. All of the dimensions are restrained by the space requirements of whatever element is being attached to the container, for example, such as an overcap. In other containers, the dimensions of the attachment mechanism must be adjusted to comport with space requirements. For example, if a nozzle assembly (see FIG. 8D) is attached to a container utilizing the attachment mechanism, it should be apparent that the dimensions of the individual components must be adjusted to fit within the nozzle assembly. The size, shape, and mechanical properties of the flanges, slots, locking member/locking element, and resilient member all contribute to the locking stability of the product dispensing system.

Over-rotation of the container and or overcap is prevented through various mechanisms. With reference to FIGS. 77 and 83, the triangular-shaped ridges 2048 extending outwardly from truncated portions of the lower ledge 2032 help constrain rotation of the wing members 2212 by impinging against the rounded tips 1532 and or the first sides 1534 of the flanges 1524. Further, when positioning the locking element 1950 within the annular ring 1502, the stabilizing ribs 1522 adjacent the annular riser 1512 (see FIGS. 57 and 58) are constrained by the guide posts 2072 and the stop members 2076 of the locking element 1950 (see FIG. 79). Specifically, upon sufficient rotation of the container and/or overcap, the stabilizing ribs 1522 ride up and over the claw members 2088 of the stop members 2076. The stop members 2076 prevent the container 106 from accidentally rotating backwards and/or coming loose during operation.

Now turning to FIGS. 84-90, a ninth embodiment of an attachment mechanism 2500 is shown that is similar to the attachment mechanism shown in FIGS. 75-83, except for the differences noted hereinbelow. The attachment mechanism 2500 is similarly adapted to be used with the annular ring 1502 depicted in FIGS. 57 and 58.

Figure 85:
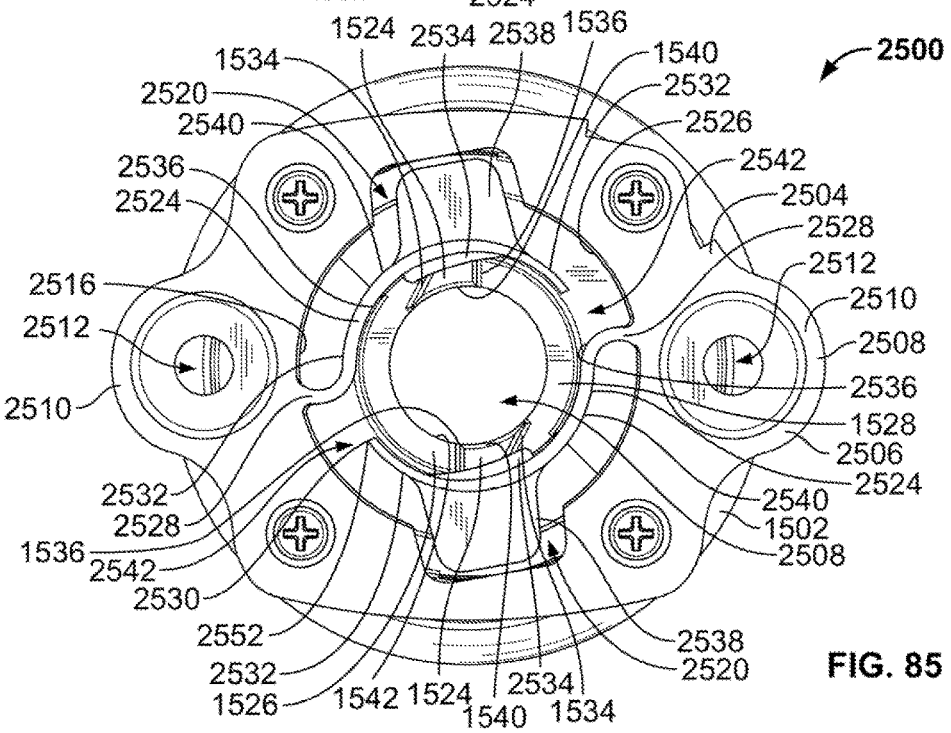
FIG. 85 is a top plan view of the locking element of FIG. 84.
Figure 86:
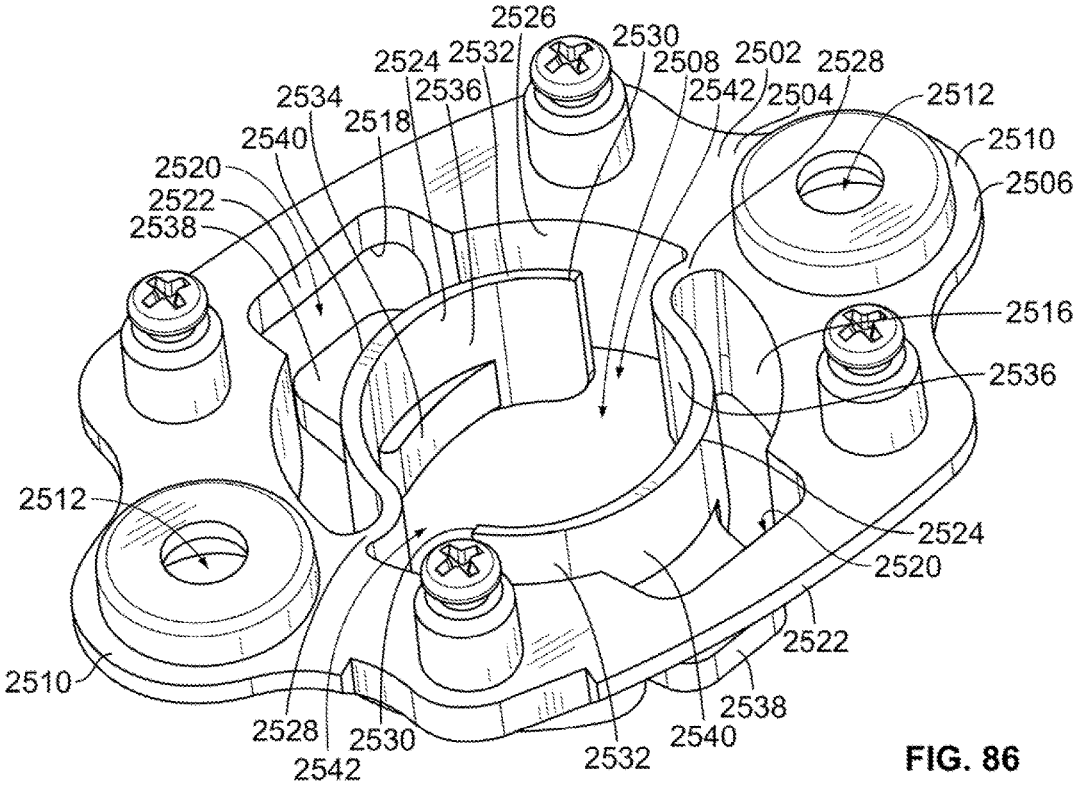
FIG. 86 is a top isometric view of the locking element of FIG. 84.
Figure 87:
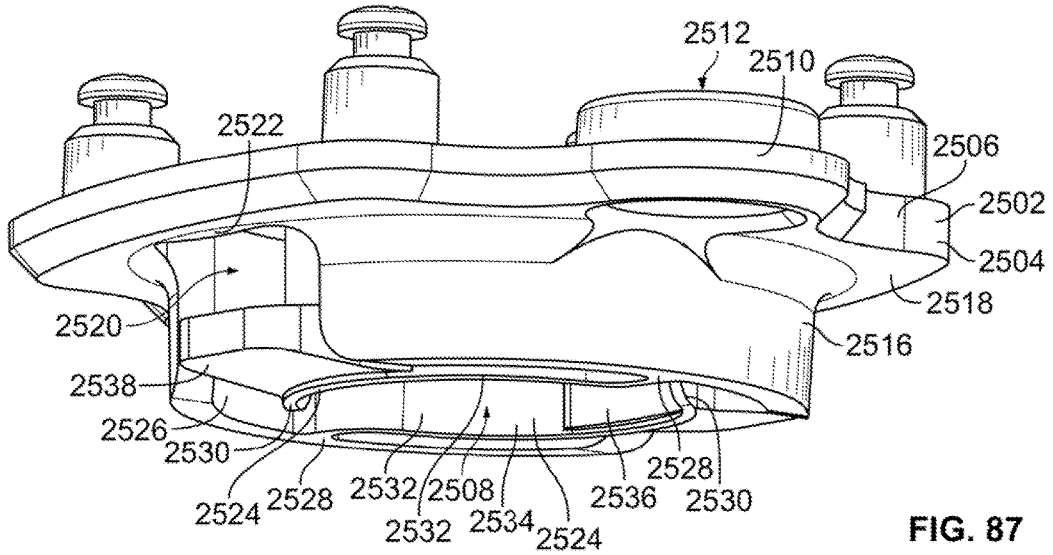
FIG. 87 is a bottom isometric view of the locking element of FIG. 84.

As best seen in FIGS. 85-87, a locking element 2502 is depicted. The locking element 2502 includes a body 2504 having a substantially flat wall 2506. A circular orifice 2508 extends through the wall 2506. The body 2504 includes two protruding ends 2510 with apertures 2512 extending therethrough, which are adapted to secure the locking element 2502 to a base 2550 (see FIG. 88). A circular sidewall 2516 extends downwardly from a lower surface 2518 of the wall 2506 and further bounds the circular orifice 2508 (see FIG. 87). Opposing cutouts 2520 are provided within the sidewall 2516, which further form substantially rectangular notches 2522 through the wall 2506.

Figure 84:
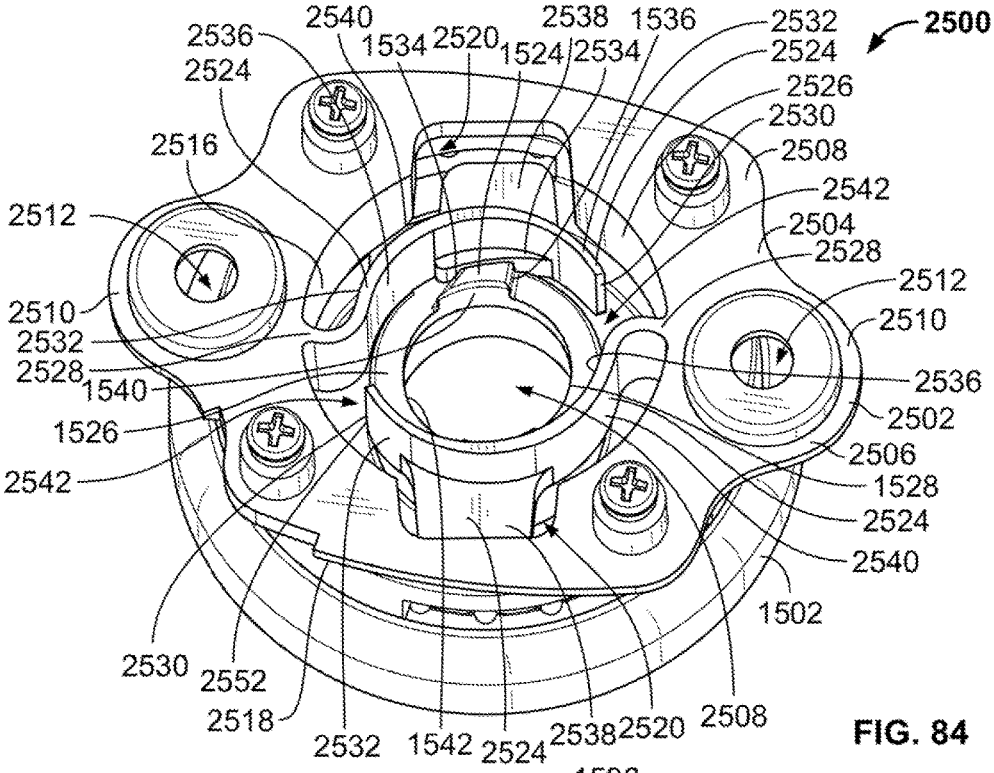
FIG. 84 is a top isometric view of a ninth embodiment of an attachment mechanism comprising a locking element and the annular ring of FIG. 57.

Flexible members 2524 are integrally formed with the body 2504 (see FIG. 84). The flexible members 2524 extend from an interior surface 2526 of the sidewall 2516 at an attachment point 2528 toward distal ends 2530. The flexible members 2524 extend interiorly within the orifice 2508. The flexible members 2524 each include an elongate curved body 2532 with a small ramp 2534 disposed on an internal surface 2536 thereof. A wing member 2538 is disposed on an opposing external surface 2540 of the curved body 2532.

With reference to FIGS. 85 and 86, each flexible member 2524 terminates in an area adjacent an opposing attachment point 2528. A gap 2542 is formed adjacent the distal ends 2530 of the flexible member 2524 and an opposing attachment point 2528 of the other flexible member 2524. When the annular ring 1502 is inserted into the locking element 2502 the flanges 1524 of the annular ring 1502 pass through the gaps 2542 and are placed in a first or pre-operational state (see FIG. 89). The ramps 2534 are adapted to interact with the flanges 1524 during activation of the attachment mechanism 2500. During this interaction, the flanges 1524 impinge against the ramps 2534 and/or other portions of the flexible members 2524 to cause the wing members 2538 to flex outwardly toward the cutouts 2520 and place the attachment mechanism in a second or operational state (see FIG. 90).

Figure 88:
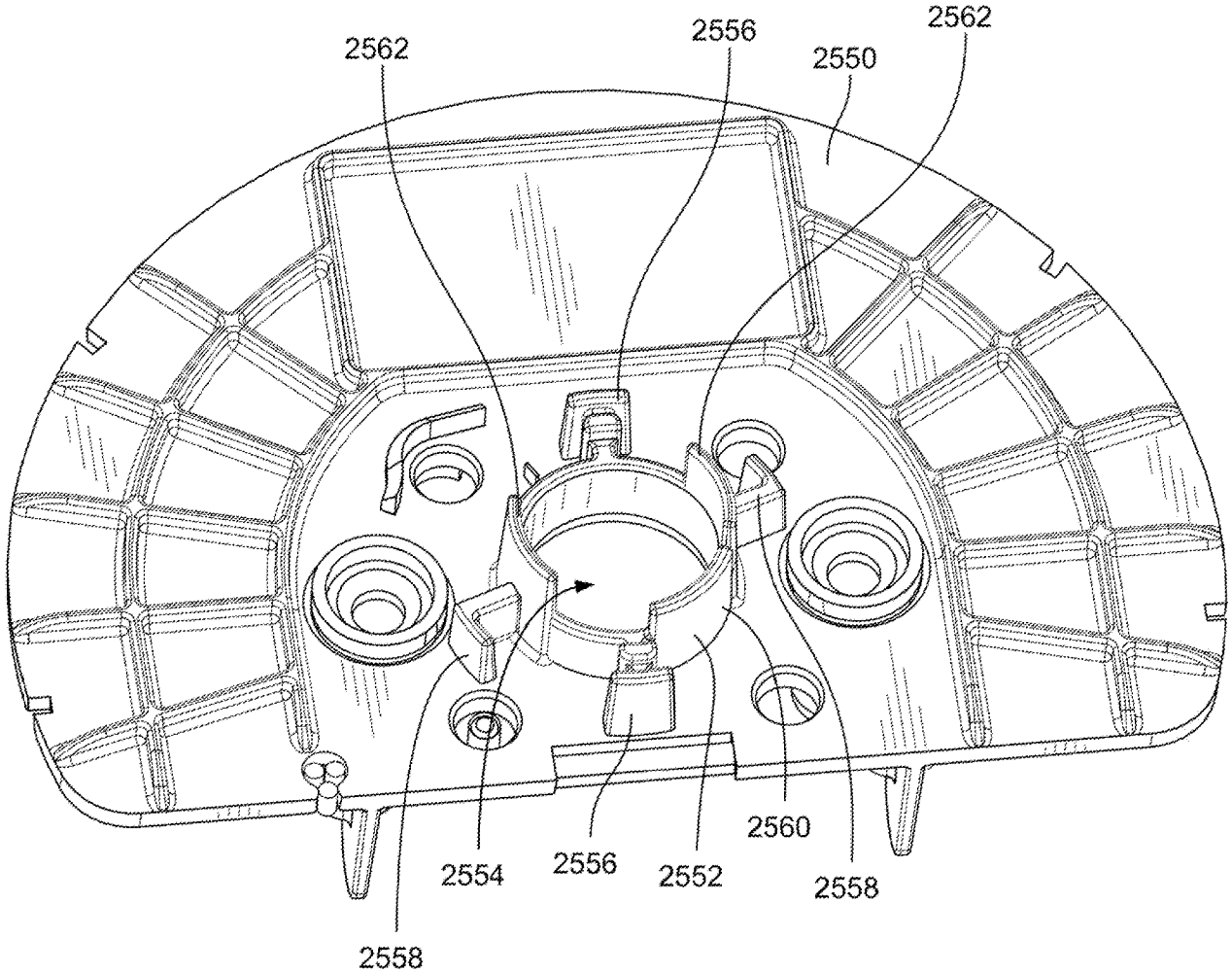
FIG. 88 is a ninth embodiment of a base adapted to support the locking element of FIG. 84.
Figure 89:
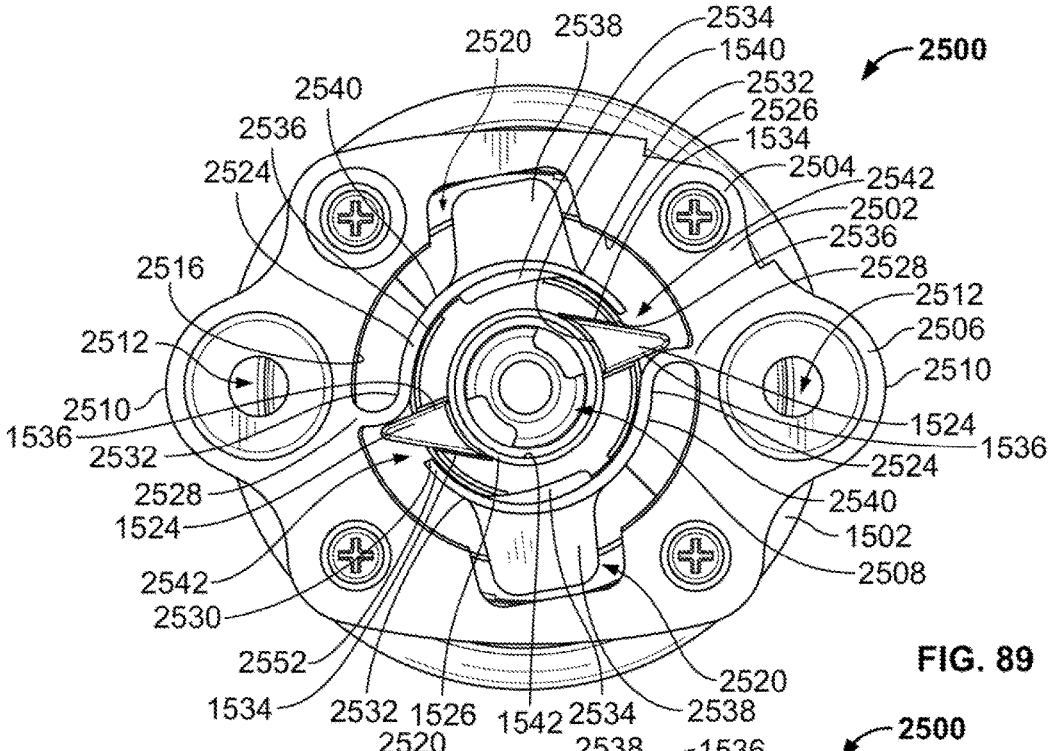
FIG. 89 is a top isometric view of the attachment mechanism of FIG. 84 in a first, or unlocked position.
Figure 90:
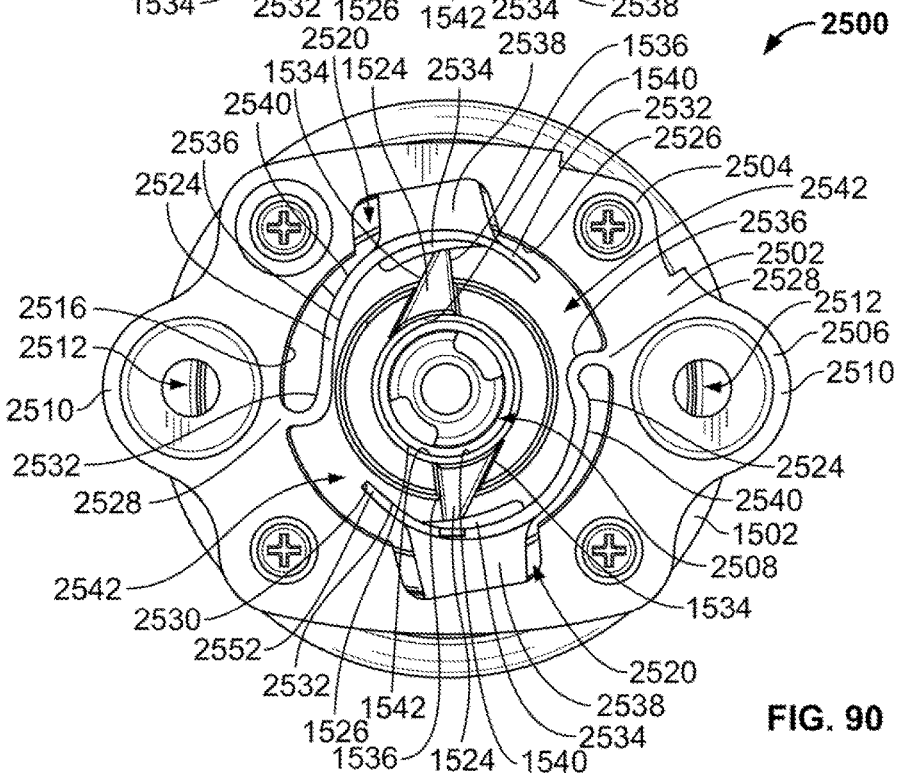
FIG. 90 is a top isometric view of the attachment mechanism of FIG. 84 in a second, or locked position.

With reference to FIG. 88, it may be seen that the base 2550 is substantially similar to the bases of previous embodiments and, more specifically, to the base shown in FIG. 76. The base 2550 includes a circular sidewall 2552 extending downwardly therefrom, which defines an orifice 2554 extending therethrough. The base 2550 further includes two oppositely disposed T-shaped brackets 2556 and two oppositely disposed L-shaped brackets 2558 extending radially from an exterior surface 2560 of the sidewall 2552. The sidewall 2552 further includes two extension portions 2562 extending downwardly therefrom. The extension portions 2562 are adapted to provide a support surface for the wing members 2538 during operation of the assembly, i.e., the wing members 2538 rest on the extension portions 2562 prior to and during use to provide stability.

Figure 91:
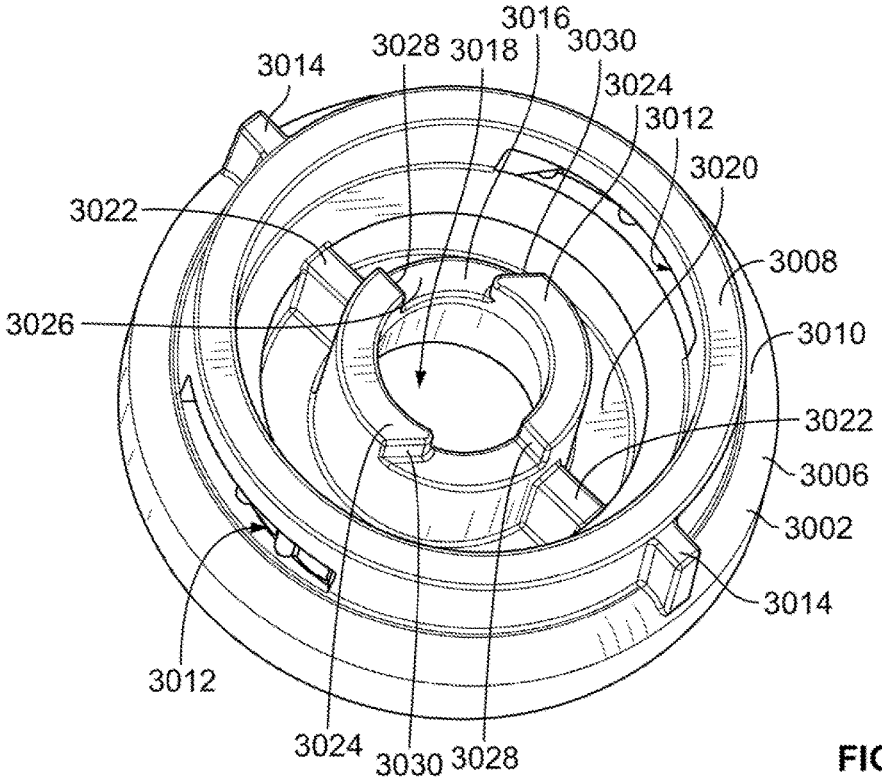
FIG. 91 is a top isometric view of a tenth embodiment of an annular ring.

Now turning to FIGS. 91-94, a tenth embodiment of an attachment mechanism 3000 is shown. The attachment mechanism 3000 includes a bracket or adapter, which is an annular ring 3002 in the present embodiment that is adapted to be inserted into a locking element 3004 (see FIG. 92). With reference to FIG. 91, the annular ring 3002 is similar to the annular rings of previously discussed embodiments and generally includes a U-shaped member 3006 and an annular riser 3008 extending upwardly from an exterior surface 3010 of the U-shaped member 3006. A plurality of elongate slots 3012 are disposed through the annular riser 3008 at an area adjacent where the annular riser 3008 is joined to the U-shaped member 3006. Two opposing rectilinear projections 3014 extend upwardly from the exterior surface 3010 along the annular riser 3008.

Still referring to FIG. 91, a pedestal 3016 is provided interiorly of the annular U-shaped member 3006, which is shaped to fittingly receive the pedestal and/or valve stem/valve assembly of a container through a circular orifice 3018 extending therethrough (not shown). The U-shaped member 3006 is connected to the pedestal 3016 by a medial wall portion 3020. The medial wall portion 3020 further includes two rectangular connectors 3022 that extend along the medial wall portion 3020 between the U-shaped member 3006 and the pedestal 3016. Two curved extensions 3024 extend upwardly from an upper surface 3026 of the pedestal 3016. The curved extensions 3024 include a flat end 3028 and an angled end 3030 adapted to interact with a resilient member 3032 as will be described in more detail hereinbelow. Similar to previous embodiments, the annular ring 3002 is adapted to be secured to portions of the mounting cup of a container.

Figure 92:
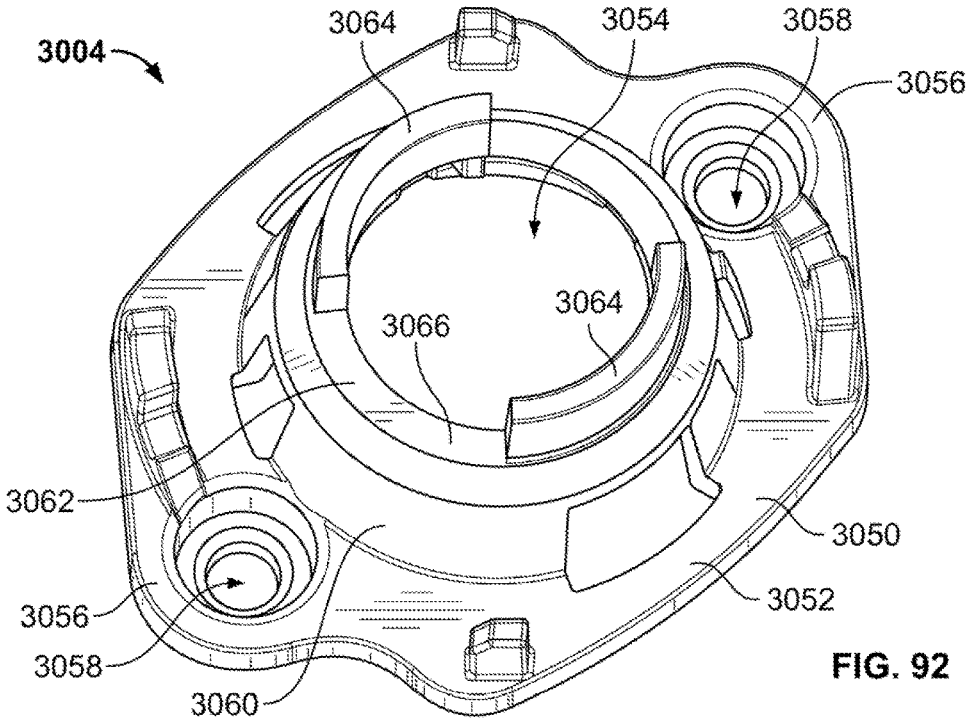
FIG. 92 is a bottom isometric view of a locking element adapted for use with the annular ring of FIG. 91.

Now turning to FIG. 92, the locking element 3004 is depicted, which is similar to the locking element depicted in FIG. 79. The locking element 3004 may be adapted to extend from any of the bases disclosed herein. The locking element 3004 includes a body 3050 having a substantially flat wall 3052. A circular orifice 3054 extends through the wall 3052. The body 3050 includes two ends 3056 with apertures 3058 extending therethrough, which are adapted to secure the locking element 3004 to a base (not shown). Still referring to FIG. 92, the body 3050 includes a circular sidewall 3060 extending downwardly therefrom, which further bounds the circular orifice 3054. The sidewall 3060 terminates at a lower ledge 3062 that extends interiorly therefrom. Two curved extension members 3064 extend outwardly from an exterior surface 3066 of the lower ledge 3062.

Figure 93:
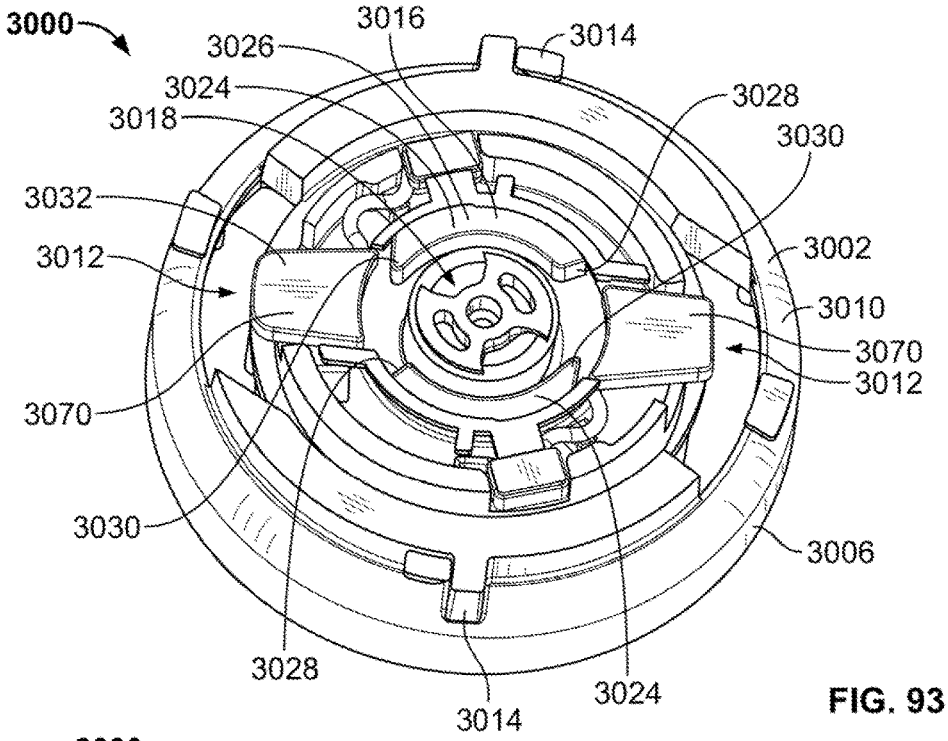
FIG. 93 is a top isometric view of the annular ring of FIG. 91 inserted into the locking element of FIG. 92 and further including a resilient member, wherein the annular ring is in a first, or unlocked position.
Figure 94:
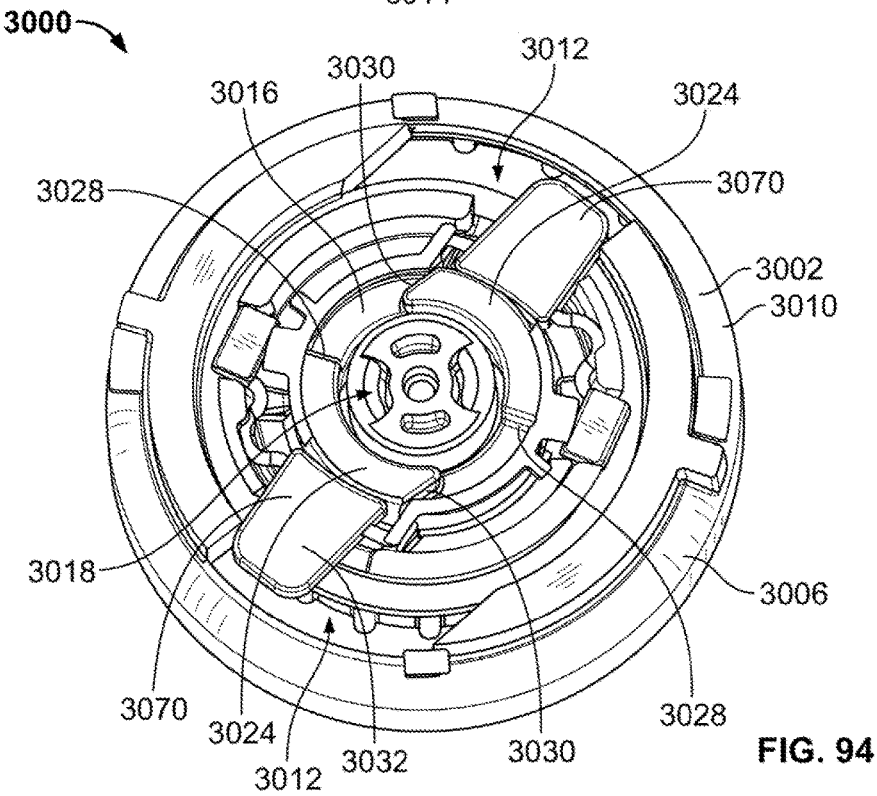
FIG. 94 is a top isometric view of the annular ring of FIG. 91 inserted into the locking ring of FIG. 92 and further including a resilient member, wherein the annular ring is in a second, or locked position.

As best seen in FIGS. 93 and 94, the locking element 3004 is adapted to be used in conjunction, for example, with the resilient member 3032, which is similar to the resilient member 2100 depicted in FIG. 80. FIGS. 93 and 94 depict portions of the annular riser 3008 removed for purposes of better illustrating pre and post operational states of the assembly. Turning again to FIG. 93, the annular ring 3002 is depicted as being disposed within the orifice 3054 of the locking element 3004 in a first or pre-operational state. The curved extensions 3024 of the annular ring 3002 are disposed away from wings 3070 of the resilient member 3032. To lock the container to the overcap, one or more of the container and overcap are rotated, which causes the angled ends 3030 of the curved extensions 3024 to contact and impinge against the wings 3070 of the resilient member 3032 to force the wings 3070 outwardly through the elongate slots 3012 of the annular ring 3002 (see FIG. 94).

Figure 95:
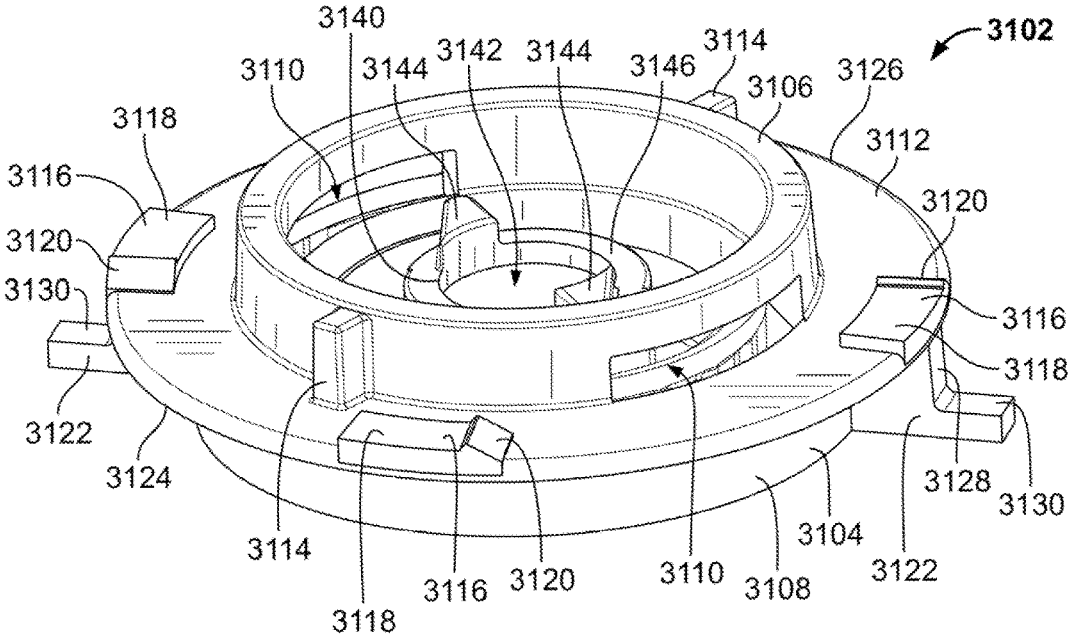
FIG. 95 is a top isometric view of an alternative embodiment of the annular ring of FIG. 57.
Figure 96:
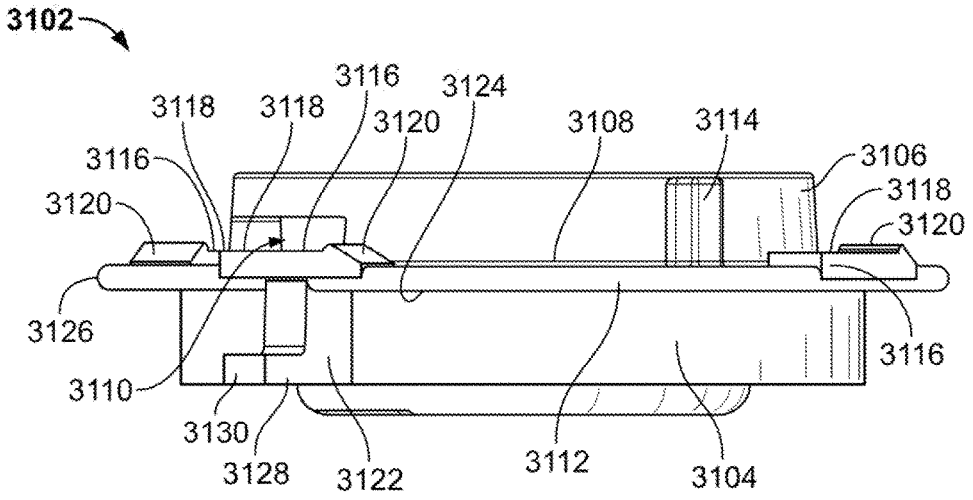
FIG. 96 is a side elevational view of the annular ring of FIG. 95.

FIGS. 95-99 depict a different embodiment of an attachment mechanism 3100 adapted to assist in securing an overcap to a container. A bracket or adapter, such as annular ring 3102, is depicted in FIGS. 95 and 96, which is similar to previously described embodiments. The annular ring 3102 generally comprises a U-shaped member 3104 and an annular riser 3106 extending upwardly from an exterior surface 3108 of the U-shaped member 3104. A plurality of elongate slots 3110 are disposed through the annular riser 3106 at an area adjacent where the annular riser 3106 is joined to the U-shaped member 3104. An annular ledge 3112 extends outwardly from the U-shaped member 3104 and circumscribes the entirety of the annular ring 3102. The ledge 3112 includes two oppositely disposed rectilinear members 3114 adjacent the annular riser 3106. The ledge 3112 further includes a plurality of stop members 3116, which each include a raised edge 3118 and a sloped end portion 3120. Two L-shaped brackets 3122 extend downwardly from an underside 3124 of the ledge 3112 and outwardly beyond a peripheral edge 3126 thereof. The brackets 3122 each include a vertical wall 3128 and a horizontal rectilinear wall 3130.

Still referring to FIGS. 95 and 96, a pedestal 3140 is provided interiorly of the annular U-shaped member 3104, which is shaped to fittingly receive the pedestal and/or valve stem/valve assembly of a container (not shown) through a circular orifice 3142 extending therethrough. The pedestal 3140 further includes a plurality of triangular protrusions 3144 extending outwardly from a top edge 3146 thereof. In the present embodiment two opposing protrusions 3144 are provided. Similar to previous embodiments, the annular ring 3102 is adapted to be secured to portions of the mounting cup of a container.

Figure 97:
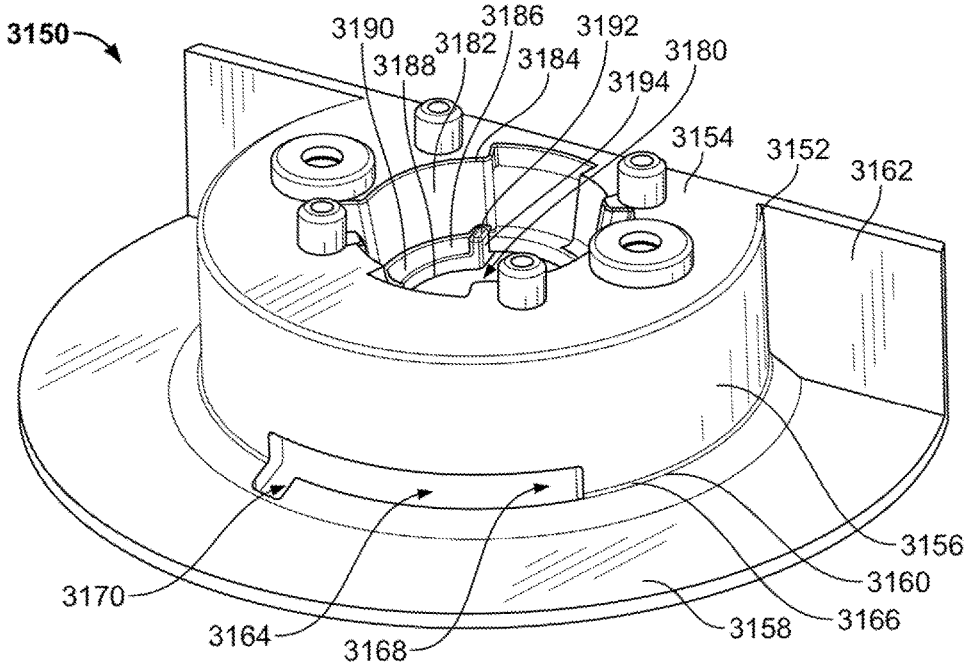
FIG. 97 is a top isometric view of a locking element adapted for use with the annular ring of FIG. 95.
Figure 98:
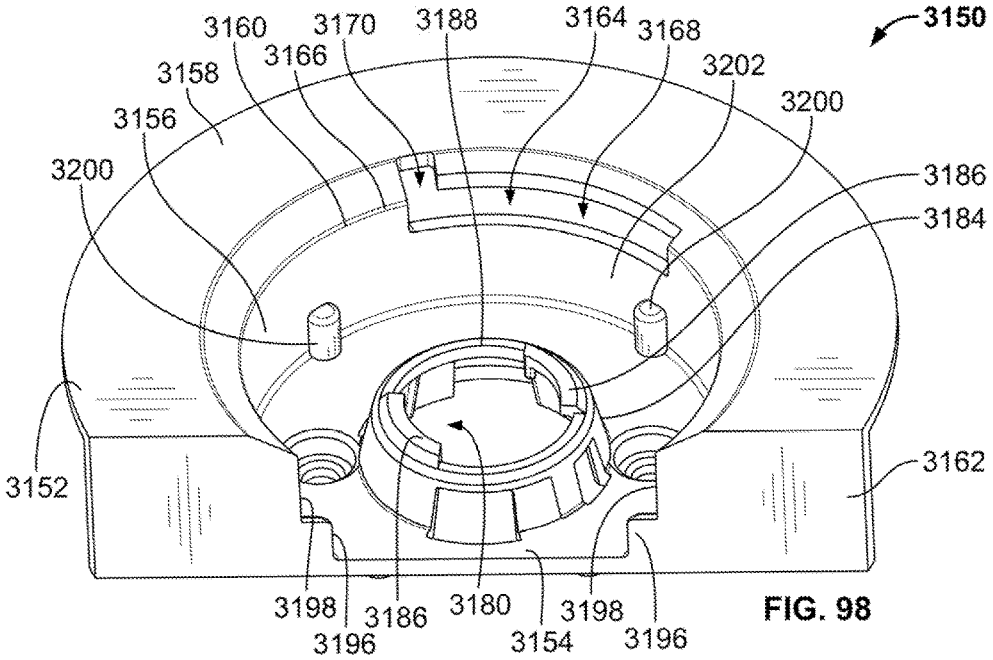
FIG. 98 is a bottom isometric view of the locking element of FIG. 97.
Figure 99:
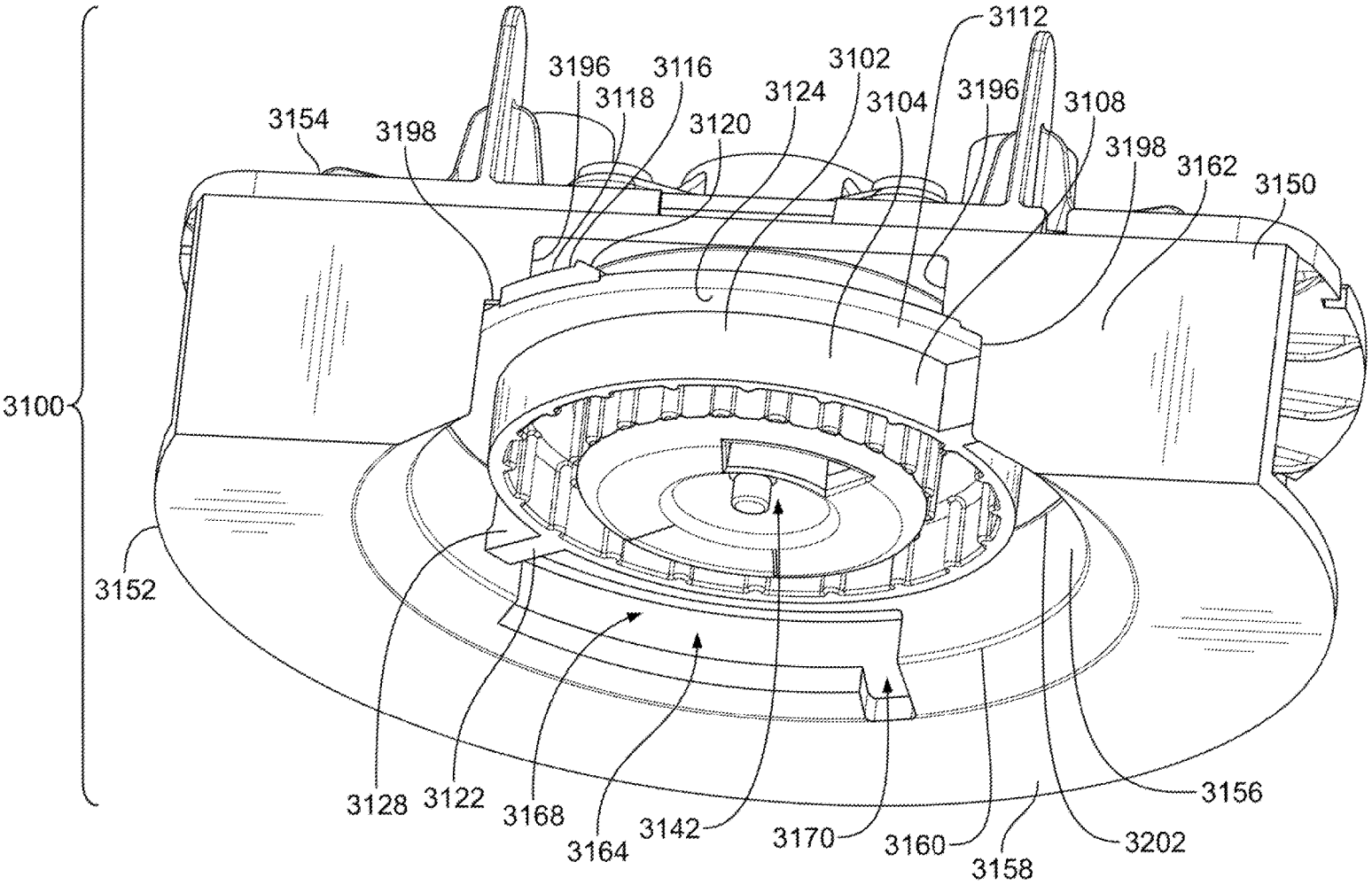
FIG. 99 is a bottom isometric view of the annular ring of FIG. 95 disposed within the locking element of FIG. 97 in a second, or locked position.

Now turning to FIGS. 97-99, a locking element 3150 is depicted that is adapted for use with the annular ring 3102. The locking element 3150 is similar to previous embodiments and is adapted to extend from a base portion (not shown) attached to an overcap. The locking element 3150 includes a housing 3152 with a flat top wall 3154 and a circular sidewall 3156 extending downwardly therefrom. A flared skirt portion 3158 extends outwardly from a lower edge 3160 of the sidewall 3156. The sidewall 3156 and the skirt portion 3158 are interrupted by a flat back wall 3162. An aperture 3164 is disposed within the sidewall 3156 at the lower edge 3166 thereof. The aperture 3164 includes an elongate opening 3168 and a smaller opening 3170 that extends onto portions of the flared skirt portion 3158.

With particular reference to FIGS. 97 and 98, an orifice 3180 is provided within the top wall 3154. A circular sidewall 3182 extends downwardly from an edge 3184 defining the orifice 3180. The sidewall 3182 includes two sloped ledges 3186 extending from a bottom edge 3188 thereof. The ledges 3186 each include a ramped portion 3190 and a stop member 3192 at an end 3194 thereof. The ledges 3186 are disposed on opposite sides of the locking orifice 3180 and are adapted to interact with portions of the annular ring 3102 as described in more detail below. The remaining structure of the locking element 3150 is substantially similar to previously described embodiments. Further, the present embodiment is further adapted to be used in conjunction with the resilient member shown in FIG. 80.

As best seen in FIG. 98, the back wall 3162 includes curved stop walls 3196 disposed adjacent an edge 3198 thereof. Anti-wobble ribs 3200 extend from the housing 3152 and are disposed adjacent an interior surface 3202 of the sidewall 3156. During attachment of the overcap to the container, the annular ring 3102 is inserted into the locking element 3150 (see FIG. 97) so that the horizontal rectilinear wall 3130 of the L-shaped bracket 3122 is aligned with and inserted into the smaller vertical opening 3170 in the sidewall 3156. Provision of such structure ensures that the annular ring 3102 is appropriately positioned prior to rotation to prevent damage to the assembly. Rotation of the assembly causes the triangular protrusions 3144 of the annular ring 3102 to contact the resilient member, which forces the wings of the resilient member outwardly through the elongate slots 3110 as noted in connection with previously disclosed embodiments. Full rotation and placement of the attachment mechanism 3100 in an operational state is accomplished when one of the stop walls 3196 (see FIG. 98) contacts and rides over one of the sloped end portions 3120 of one of the stop members 3116 (see FIG. 95). This interaction prevents the annular ring 3102 from rotating in an opposite direction and accidentally releasing the container from the overcap. Other stop members 3116 contact the anti-wobble ribs 3200 disposed on the locking element 3150 to provide further stability to the attachment mechanism 3100 and prevent over-rotation (see FIG. 98).

Figure 100:
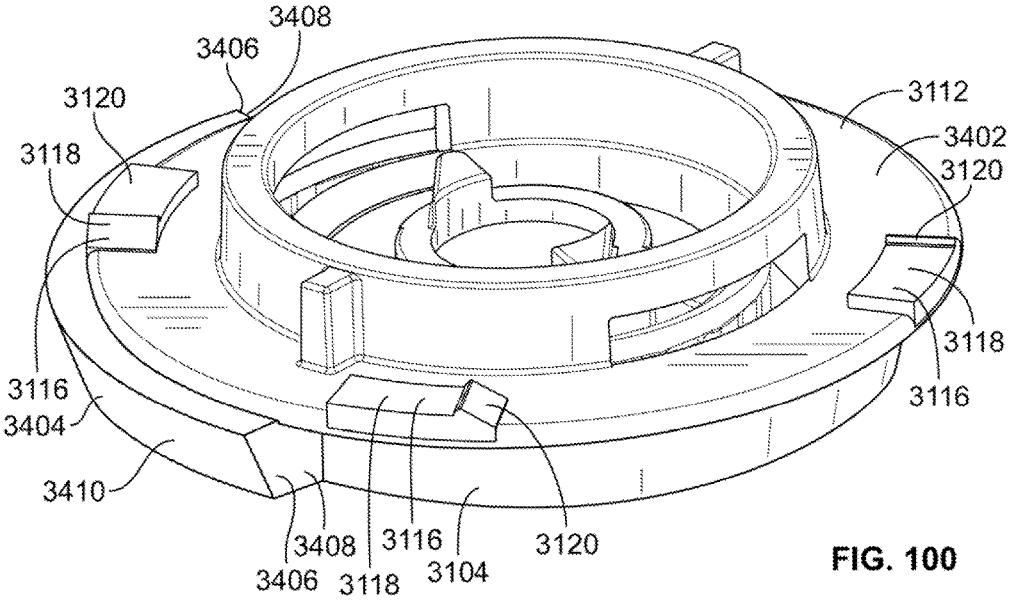
FIG. 100 is an isometric view of a different embodiment of an annular ring.
Figure 101:
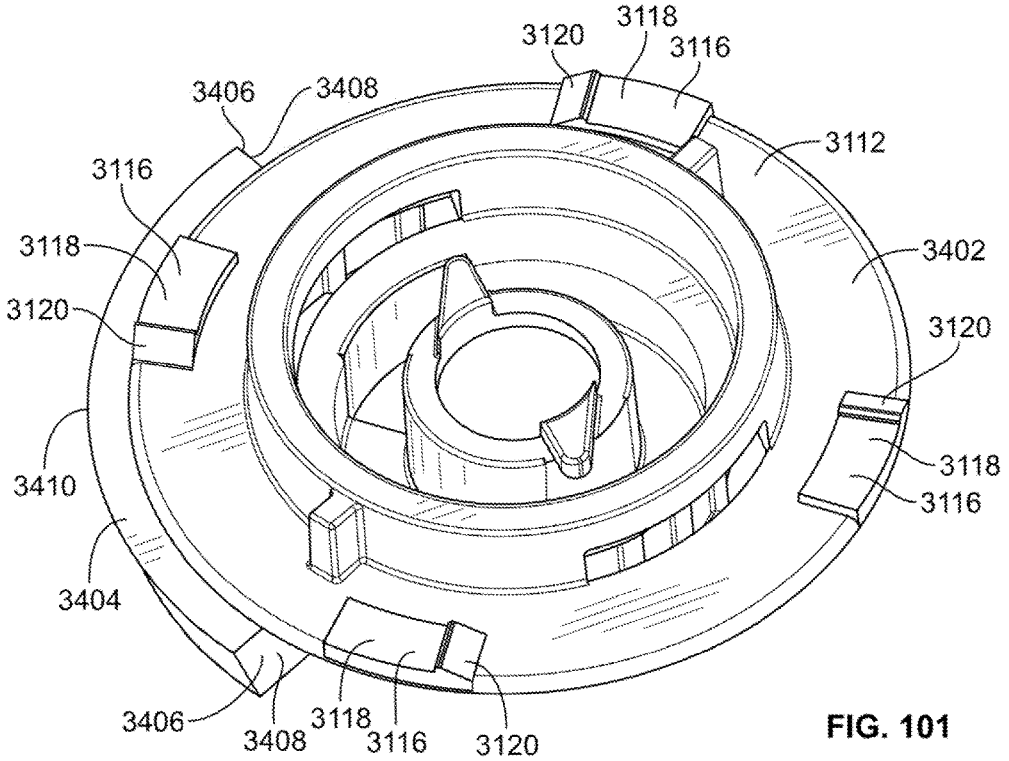
FIG. 101 is a top isometric view of the annular ring of FIG. 100.
Figure 102:
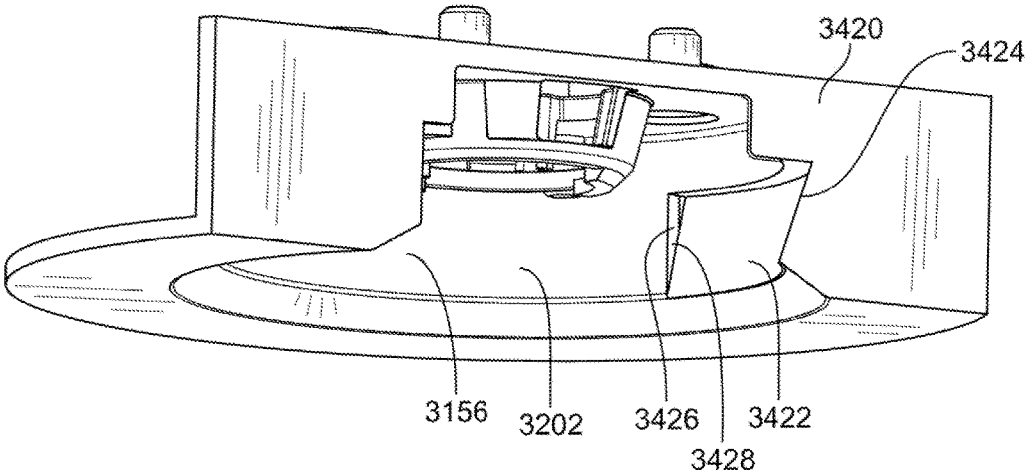
FIG. 102 is a bottom isometric view of a locking element adapted for use with the annular ring of FIG. 100.

An alternative embodiment of the attachment mechanism 3100 depicted in FIGS. 95-99 is shown in FIGS. 100-103 as attachment mechanism 3400, wherein the same reference numerals are used for like structure. The attachment mechanism 3400 includes an annular ring 3402, which is depicted in FIG. 100. The annular ring 3402 includes a curved wall 3404 extending outwardly from the U-shaped member 3104 and the ledge 3112. The wall 3404 includes two angled walls 3406 at ends 3408 thereof and an elongate angled sidewall 3410 that extends between the ends 3408. Now turning to FIGS. 102 and 103, a locking element 3420 is depicted that is similar to the locking element shown in FIGS. 98 and 99. The locking element 3420 includes an angled recess 3422 disposed within the inner surface 3202 of the sidewall 3156. The recess 3422 extends from a front edge 3424 of the sidewall 3156 and is bounded by a stop notch 3426 at an opposing end 3428 thereof.

Figure 103:
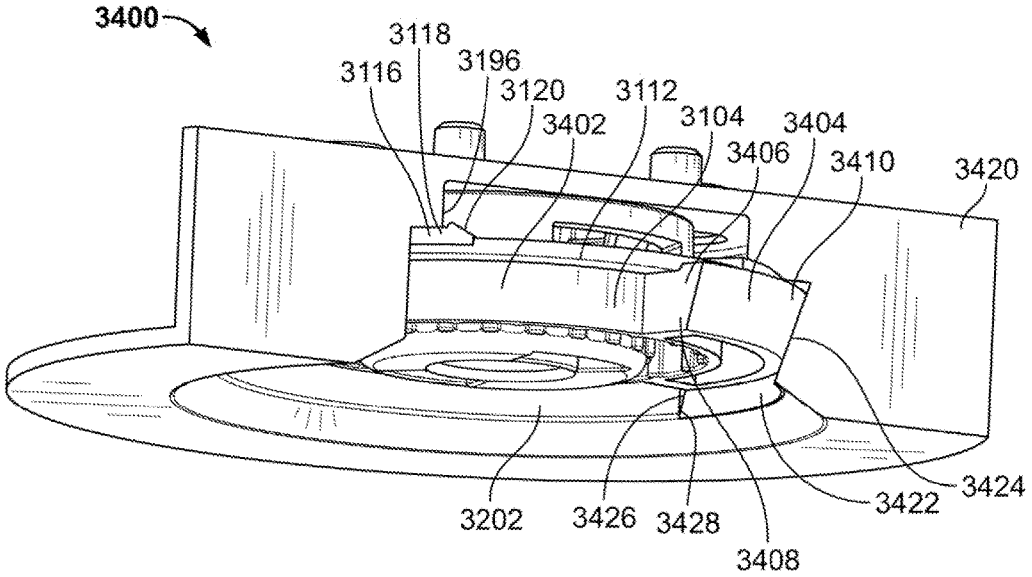
FIG. 103 is a bottom isometric view of the annular ring of FIG. 100 partially disposed within the locking element of FIG. 102.

To attach the overcap to the container, the annular ring 3402 is inserted into the locking element 3420. As best seen in FIG. 103, the curved wall 3404 is disposed adjacent and aligned with the front edge 3424 of the sidewall defining the recess 3422. Such structure provides a similar benefit as previously noted to ensure proper orientation of the annular ring 3402 and locking element 3420 so as to prevent inappropriate mating of the two which could cause damage to the attachment mechanism 3400. Rotation of the assembly causes the angled sidewall 3410 to contact and slide within the angled recess 3422 of the locking element 3420. When the angled sidewall 3410 contacts the stop notch 3426, the assembly is prevented from further rotation and is fully engaged. After completion of the rotation, one of the sloped end portions 3120 of one of the stop members 3116 is overridden by one of the stop walls 3196 to prevent accidental disengagement of the attachment mechanism 3400. Further, several of the stop members 3116 also contact the anti-wobble ribs 3200 disposed on the locking element 3420 to provide further stability to the attachment mechanism 3400. The present embodiment may also be provided with the previously noted structure to prevent over-rotation and increase the stability of the attachment mechanism 3400.

Figure 104:
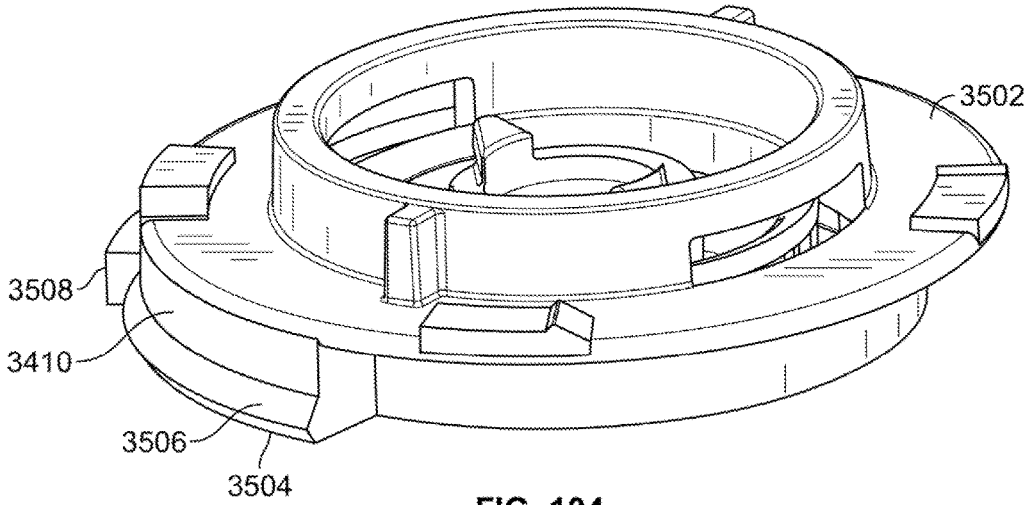
FIG. 104 is a top isometric view of a different embodiment of an annular ring.
Figure 105:
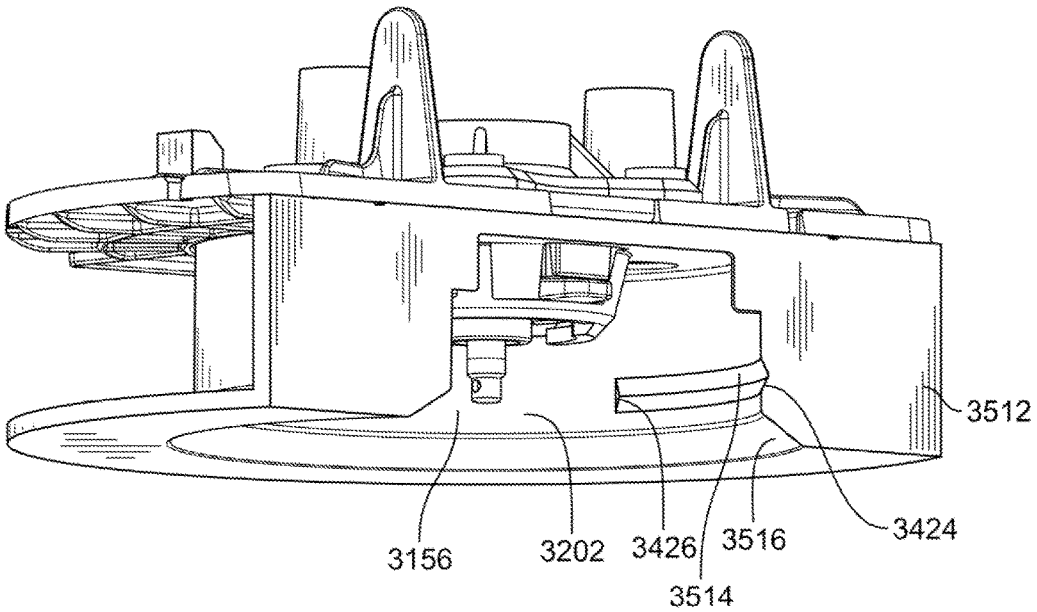
FIG. 105 is a bottom isometric view of a locking element adapted for use with the annular ring of FIG. 104.
Figure 106:
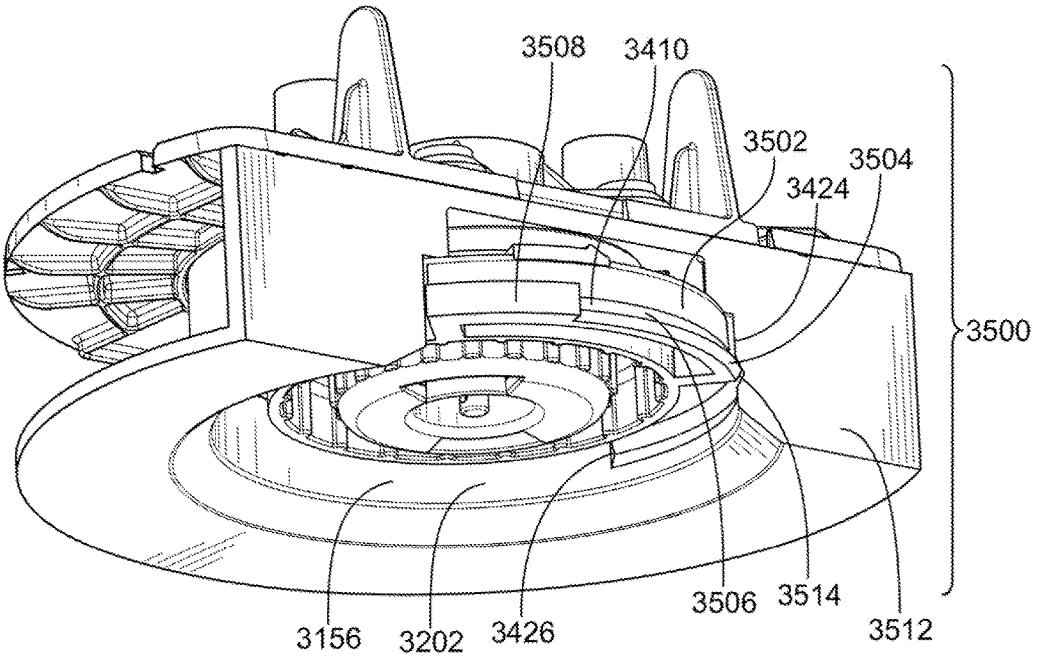

Yet a different embodiment of an attachment mechanism 3500 is depicted in FIGS. 104-106, which is similar to the attachment mechanism 3400 depicted in FIGS. 100-103, wherein the same reference numerals are used for like structure. The elongate angled sidewall 3410 on the annular ring 3502 of the present embodiment is provided with inwardly and outwardly angled sections 3504, 3506, respectively, as opposed to the uniformly outwardly angled wall of the prior embodiment (see FIG. 104). Further, a rectilinear member 3508 protrudes outwardly from the angled sidewall 3410 at one end thereof. Now turning to FIG. 105, a locking element 3512 is depicted that is similar to the locking element 3420 shown in FIGS. 102 and 103. The locking element 3512 includes an upper V-shaped groove 3514 and a lower angled portion 3516 disposed within the inner surface 3202 of the sidewall 3156. The V-shaped groove 3514 extends from the front edge 3424 of the sidewall 3156 and is bounded by the stop notch 3426 disposed at an opposing end thereof.

To attach the overcap to the container, the annular ring 3502 is inserted into the locking element 3512. As best seen in FIG. 106, the curved wall 3404 is disposed adjacent and aligned with the front edge 3424 of the sidewall defining the V-shaped groove 3514. Such structure provides a similar benefit as previously noted to ensure proper orientation of the annular ring 3502 and the locking member 3512 so as to prevent inappropriate mating of the two which could cause damage to the attachment mechanism 3500. Rotation of the assembly causes the angled sections 3504, 3506 of the angled sidewall 3410 to contact and slide within the V-shaped groove 3514 of the locking member 3512. When the angled sidewall 3410 contacts the stop notch 3426, the assembly is prevented from further rotation and is fully engaged. The present embodiment may also be provided with the previously noted structure to prevent over-rotation and increase the stability of the attachment mechanism 3500.

Figure 107:
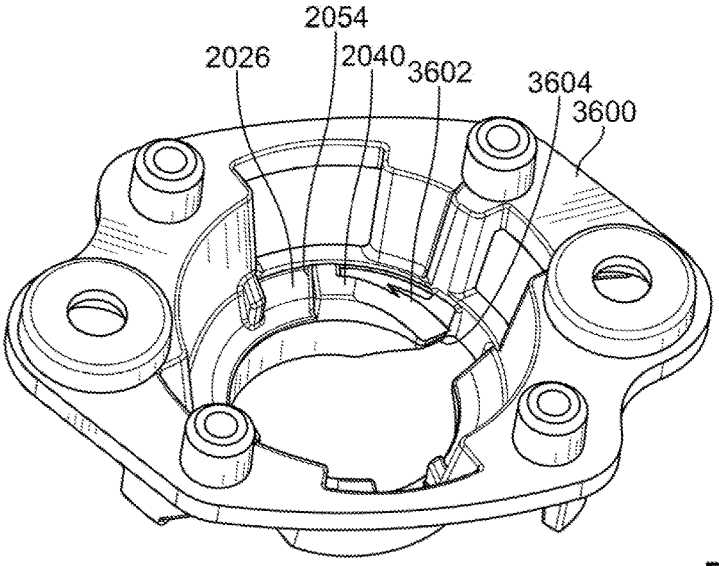

Now turning to FIG. 107, an alternative embodiment of a locking ring 3600 is depicted, which is similar to the locking ring 1950 shown in FIG. 77, wherein like structure is provided with the same reference numerals. The lower ledge 2026 includes two flat portions 2040. In the present embodiment, a ramped portion 3602 is provided on a side 3604 of the flat portion 2040 opposite the tapered portion 2054. The ramped portions 3602 assist in directing flanges of the annular rings, e.g., flange 1524, up to the flat portions 2040 to facilitate the operation of the attachment mechanism. The use of such ramped portions may be similarly made to any of the embodiments disclosed herein.

Figure 108B:
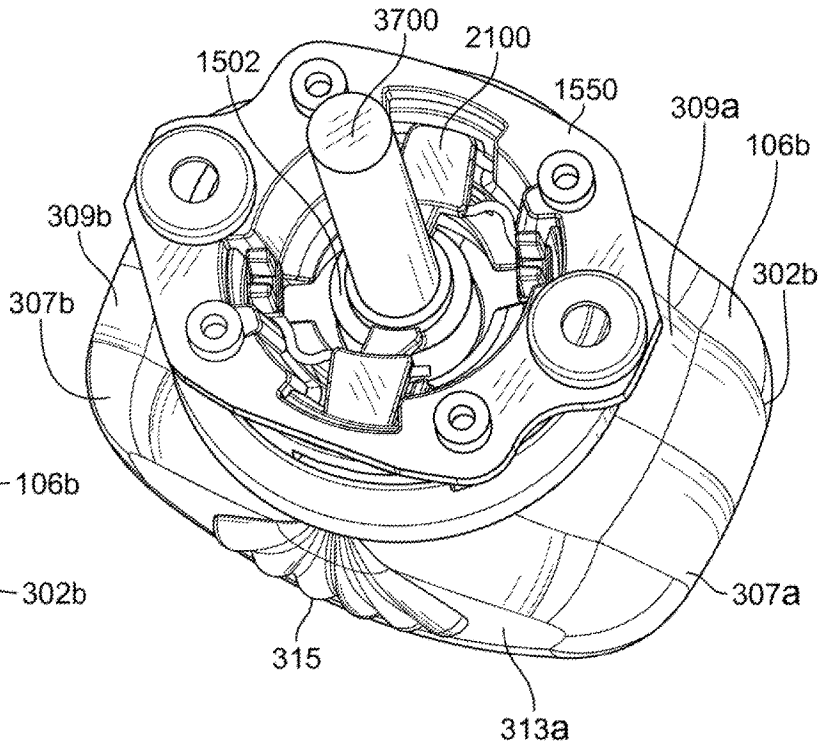
Figure 108A:
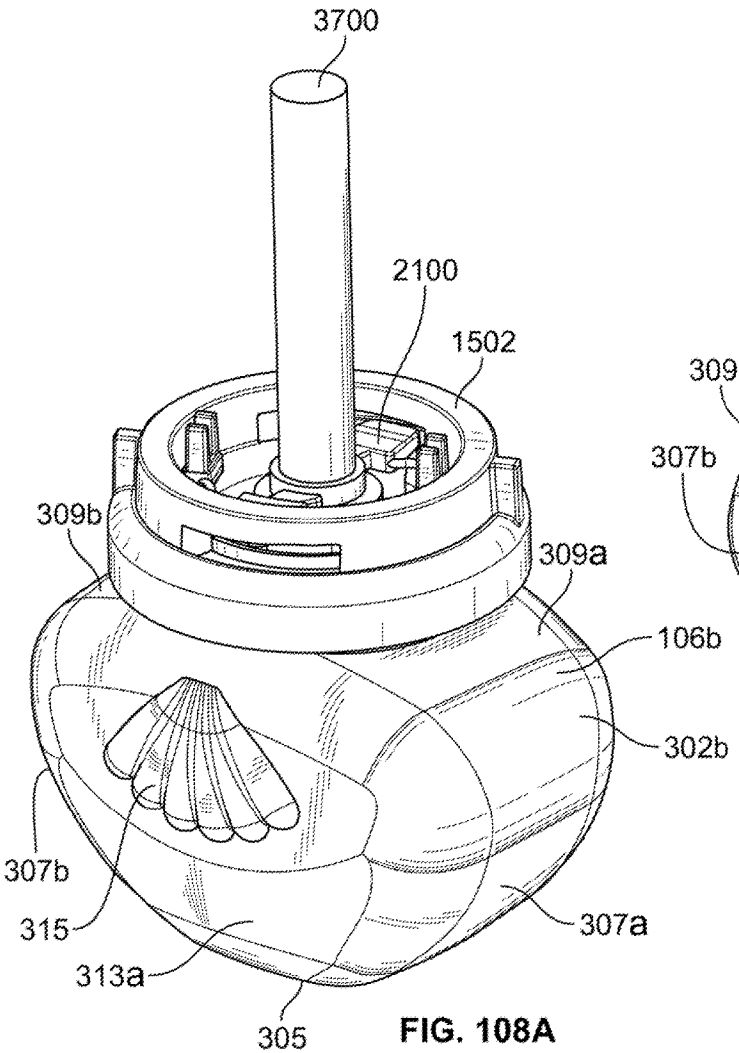
Figure 108C:
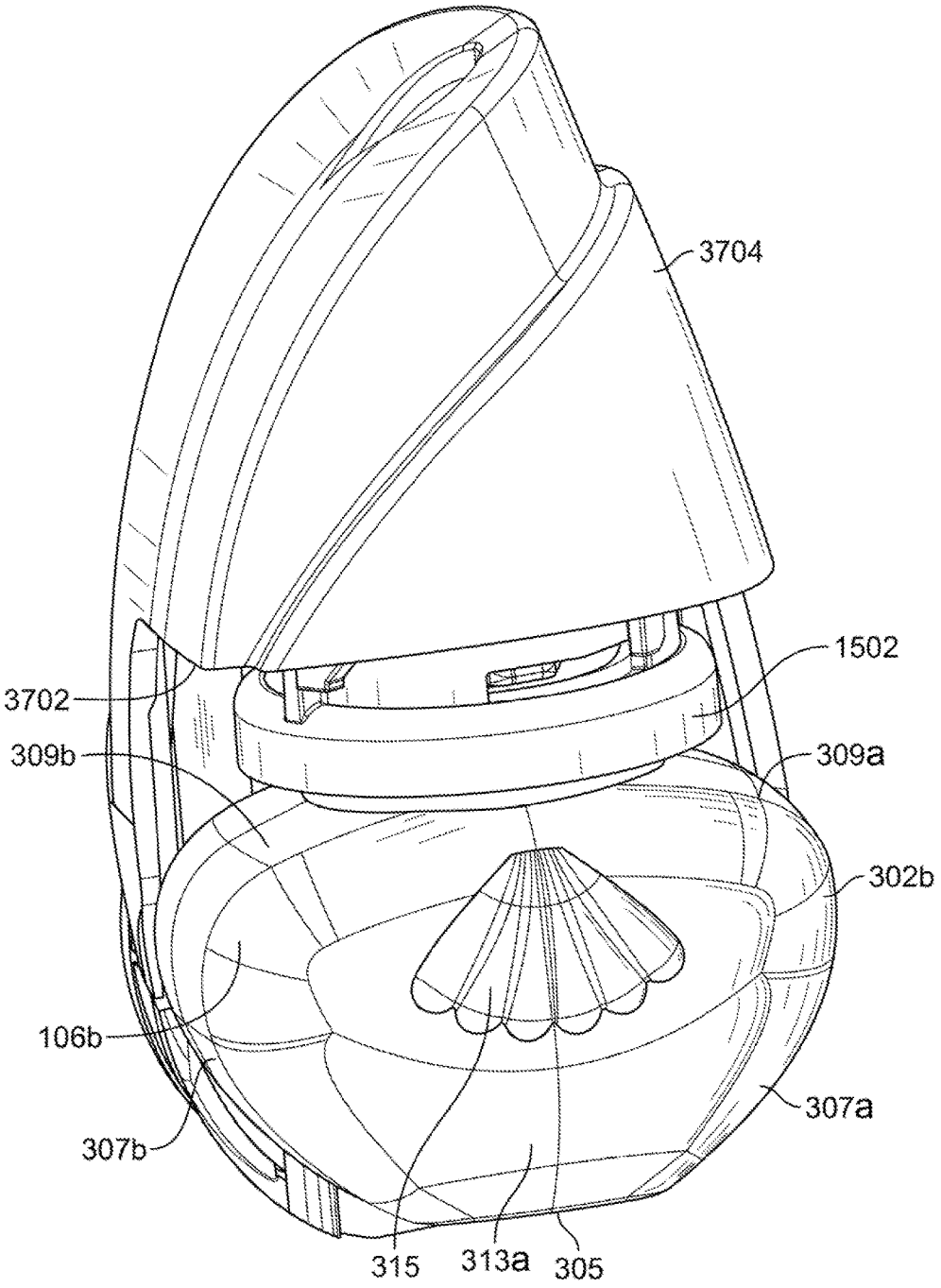

As previously noted herein, any number of containers may utilize the attachment mechanisms described herein. For example, one such example is shown in FIGS. 108A-108C, which depict the container 106*b* having the annular ring 1502 (originally depicted in FIGS. 57 and 58) disposed on the neck 311 (see FIG. 8B). The annular ring 1502 is adapted to interact with the base 1550 (originally depicted in FIGS. 59-62) and the resilient member 2100 (originally shown in FIG. 80). A wick 3700 is provided in the container 106*b* and extends upwardly therefrom. The container 106*b* having the annular ring 1502 attached thereto is adapted to lock into the base 1550, which is attached to an internal surface 3702 of a housing 3704. The operation of the annular ring 1502 with the resilient member 2100 and the base 1550 is the same as previously described herein. When in a locked position, the wick 3700 extends upwardly through the annular ring 1502 and the base 1550 and is disposed within the housing 3704 (see FIG. 108C). Similarly, the attachment mechanism may be used to secure the wick, a plug assembly, a cover, and/or any other element to the container 106*b* in manners as previously described herein.

A different example is depicted in FIGS. 109A and 109B. The container 106*c* includes the annular ring 1502 disposed on the neck 323 (see also FIG. 8C) and the resilient member 1800 (shown in FIG. 69) in combination therewith. The annular ring 1502 is adapted to interact with a locking element 3750 that is similar to the locking element 1600 (originally depicted in FIGS. 63-67). As best seen in FIG. 109B, the locking element 3750 includes an orifice 3752 adapted to allow product to be dispensed therethrough. The locking element 3750 interacts with the annular ring 1502 and the resilient member 1800 in a substantially similar way as described previously herein. In this embodiment, the locking element 3750 acts as a cover to the container 106*c*.

Now turning to FIG. 110, the container 106*d* is depicted that may be used in conjunction with any of the embodiments disclosed herein. For example, the container 106*d* is adapted to include the annular ring 1502 on the neck 311*d*. The annular ring 1502 is adapted to be used with the base 1550 and the locking element 1600 having the resilient member 1800 (not shown) in combination therewith, as described previously herein. In this embodiment, the attachment mechanism is adapted to attach a trigger spray cap (see FIG. 8*d*)) to the container 106*d*.

Although specific embodiments have been presented herein with respect to various annular rings being associated with various containers, it should be readily apparent to those skilled in the art that any attachment mechanism herein may be modified and used for any container. Further, any of the resilient members may be used with the annular rings disclosed herein, alone or in combination with any of the various locking members, locking orifices, and/or bases.

It is intended that the brackets or adapters of any of the embodiments disclosed herein may take on other forms than an annular member or ring attached to a mounting cup of a container. In some embodiments the mounting cup may be comprise varying curved and/or crimped surfaces, or there may be a single area of crimping, or there may be no mounting cup. Indeed, it is contemplated that any type of cylindrical or non-cylindrical container with a pressurized or non-pressurized product may utilize any of the disclosed brackets. One of ordinary skill in the art will readily see how the disclosed brackets or adapters may be modified to attach or otherwise be connected to any shape of container. Insofar as the bracket or adapter provides a platform for connecting a container to an overcap or other housing, which utilizes one of the advantageous attachment mechanisms described herein, it is intended that such an embodiment falls within the scope of the present disclosure.

Although specific numbers of protrusions/projections/flanges have been described with respect to the embodiments presented herein, it is contemplated that any number, shape, and size of protrusions/projections can be utilized so long as the function of the attachment mechanism is maintained. Further, reference has been made throughout to multiple ledges, tabs, and slots that do not necessarily need to be equidistant, symmetrical or similar in size and/or shape.

The slots described herein in connection with the various brackets, adapters, and annular rings may comprise a variety of shapes and sizes as known to those of skill in the art. Further, the slots may extend through the entirely of a surface that the slots are disposed within or partially through the surface. In one embodiment, the slots include a similarly shaped top edge and bottom edge to form a substantially rectangular opening. In different embodiments, the slot includes differently shaped top and bottom edges or comprises other shapes such as an oval. In another embodiment, the slots include a top edge with a flat portion and a sloped portion and a bottom edge with a substantially flat edge. The sloped portion is provided to assist in guiding the wing members through the slots. In this embodiment, the wing members flex outwardly through the slots and are guided onto the flat portion by engagement with the sloped portion.

Any of the embodiments described herein may be modified to include any of the structures or methodologies disclosed in connection with different embodiments. Further, the present disclosure is not limited to aerosol containers of the type specifically shown. Still further, the overcaps of any of the embodiments disclosed herein may be modified to work with any type of aerosol or non-aerosol container.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An attachment mechanism for a container, comprising:

a housing having a locking element extending therefrom;

at least one opening extending through the locking element to selectively receive a portion of the container; and a resilient member having a flexible portion disposed within the locking element when the locking element is in an unlocked position, a portion of the resilient member disposed outside the locking element when the locking element is in a locked position.

2. The attachment mechanism of claim 1, wherein the locking element extends from a base of the housing.

3. The attachment mechanism of claim 2, wherein the base includes at least one member adapted to support the resilient member.

4. The attachment mechanism of claim 3, wherein the at least one member includes a ramped portion and a flat portion, and wherein the ramped portion is adapted to assist in directing a flange of an annular ring up to the flat portion.

5. The attachment mechanism of claim 2 further including a locking member extending from the base, wherein the locking, member is disposed within the locking element.

6. The attachment mechanism of claim 5, wherein the resilient member is attached to the locking member.

7. The attachment mechanism of claim 5, wherein the locking member includes at least one T-shaped support member, the resilient member attached to the at least one T -shaped support member.

8. The attachment mechanism of claim 1, wherein the locking element includes at least one stop member.

9. A lock, comprising:

a locking element extending from a base, wherein the locking element includes a central orifice to receive a portion of a container and further includes an opening in a sidewall thereof; and a resilient member disposed within the locking element, the resilient member configured to flex toward the opening upon rotation of the locking element.

10. The lock of claim 9, wherein the resilient member includes a connector end and a flexible member.

11. The lock of claim 10, wherein an elongate wing member extends from the flexible member.

12. The lock of claim 10, wherein the connector end of the resilient member is attached to the base.

13. The lock of claim 10, wherein the flexible member comprises a resilient metallic material and the connector end comprises a thermoplastic material.

14. The lock of claim 9, wherein the sidewall includes at least one support wall extending outwardly therefrom, which is adapted to support the resilient member.

15. The lock of claim 9, wherein the resilient member includes two spring components disposed on opposing sides of the locking element.

16. The lock of claim 9, wherein the resilient member is integrally attached to at least one of the base and locking element.

17. An attachment mechanism, comprising:

a locking element including a sidewall defining a central orifice to receive a portion of a container, the orifice extending through the locking element;

an opening extending through the sidewall;

a resilient member disposed within the locking element; and a support positioned within the central orifice to align a portion of the resilient member with the opening.

18. The attachment mechanism of claim 17, wherein the resilient member has an elastic modulus of between about 1600 MPa to about 205000 MPa.

19. The attachment mechanism of claim 17, wherein the resilient member includes a first bowed portion, a wing extending from the first bowed portion, and a second bowed portion extending from the wing.

* * * * *